US009833379B2

(12) United States Patent
Eveleigh et al.

(10) Patent No.: US 9,833,379 B2
(45) Date of Patent: Dec. 5, 2017

(54) EYE WASH SYSTEM FOR EMERGENCY USAGE

(71) Applicant: Magarl, LLC, Naples, FL (US)

(72) Inventors: Robert B. Eveleigh, Naples, FL (US); Thomas R. Baker, Noblesville, IN (US); Cameron West, Greenfield, IN (US)

(73) Assignee: Magarl, LLC, Naples, FL (US)

( * ) Notice: Subject to any disclaimer, the term of this patent is extended or adjusted under 35 U.S.C. 154(b) by 36 days.

(21) Appl. No.: 14/528,404

(22) Filed: Oct. 30, 2014

(65) Prior Publication Data

US 2015/0113725 A1 Apr. 30, 2015

Related U.S. Application Data

(60) Provisional application No. 61/970,020, filed on Mar. 25, 2014, provisional application No. 61/897,554, filed on Oct. 30, 2013.

(51) Int. Cl.
*A61H 33/00* (2006.01)
*A61H 35/02* (2006.01)

(52) U.S. Cl.
CPC ..... *A61H 35/02* (2013.01); *A61H 33/0095* (2013.01); *A61H 33/6021* (2013.01);
(Continued)

(58) Field of Classification Search
CPC ..... A61H 55/02
(Continued)

(56) References Cited

U.S. PATENT DOCUMENTS 2,527,836 A 10/1950 Miller
D218,237 S 8/1970 Cline
(Continued)

FOREIGN PATENT DOCUMENTS

AU 2004100671 9/2004
AU 2009249423 11/2009
(Continued)

OTHER PUBLICATIONS

Product information sheet for Speakman® Heat Traced Combination Shower with Eye/Face Wash System SE-7000, 2 pgs. Jan. 2015.
(Continued)

*Primary Examiner* — Lori Baker
(74) *Attorney, Agent, or Firm* — John V. Daniluck; Bingham Greenebaum Doll LLP

(57) ABSTRACT

Methods and apparatus for washing systems, both industrial and residential. Some embodiments pertain to face washing systems that provide a gentle upward flow of water for washing a person's face, but which can be easily reconfigured to provide a downward flow of aerated water for washing of the user's hands. Other embodiments pertain to visual indicators to help a user in a dark environment in the use of an emergency eyewash system. Yet other embodiments pertain to eyewashing systems incorporating filters that are automatically flushed of debris. Still further embodiments pertain to emergency eyewashing systems in which a mixing chamber is located downstream of a thermostatically controlled valve to reduce the possibility of a hot temperature spike being provided to the eyewashing outlet apertures, which could be harmful to users.

21 Claims, 65 Drawing Sheets

(52) U.S. Cl.
CPC ..... *A61H 2201/0157* (2013.01); *A61H 2201/5043* (2013.01)

(58) Field of Classification Search
USPC ..... 4/619–660
See application file for complete search history.

(56) References Cited

U.S. PATENT DOCUMENTS

| | | | | |
|---|---|---|---|---|
| 3,925,829 | A | 12/1975 | Bost | |
| 3,962,733 | A | 6/1976 | Parry | |
| 4,012,798 | A | 3/1977 | Liautaud | |
| 4,084,270 | A | 4/1978 | Kersten, Jr. | |
| 4,259,953 | A | 4/1981 | Shaw | |
| 4,585,175 | A | 4/1986 | Formentos | |
| 4,675,924 | A | 6/1987 | Allison et al. | |
| 5,157,798 | A | 10/1992 | Van Kammen | |
| 5,251,345 | A | 10/1993 | Pechner | |
| 5,265,288 | A | 11/1993 | Allison | |
| 5,331,694 | A | 7/1994 | Mackenzie et al. | |
| 5,343,574 | A | 9/1994 | Butte | |
| 5,350,112 | A | 9/1994 | Stein | |
| 5,381,567 | A | 1/1995 | Tanner et al. | |
| 5,530,972 | A | 7/1996 | Tanner | |
| 5,623,990 | A | 4/1997 | Pirkle | |
| 5,647,531 | A | 7/1997 | Kline et al. | |
| D388,507 | S | 12/1997 | Gurries, II | |
| 5,740,569 | A | 4/1998 | Gurries, II et al. | |
| 5,754,990 | A | 5/1998 | Gurries, II | |
| 5,918,323 | A | 7/1999 | Smith | |
| D414,548 | S | 9/1999 | Westcott et al. | |
| 6,070,279 | A | 6/2000 | Lundstedt | |
| 6,119,947 | A | 9/2000 | Couture et al. | |
| D435,892 | S | 1/2001 | Henry et al. | |
| 6,173,458 | B1 | 1/2001 | Maddux | |
| D438,983 | S | 3/2001 | Stein | |
| 6,261,275 | B1 | 7/2001 | Hayes | |
| 6,279,179 | B1 * | 8/2001 | Register | E03C 1/05 250/214 R |
| 6,296,626 | B1 | 10/2001 | Stein | |
| 6,385,794 | B1 | 5/2002 | Miedzius et al. | |
| D466,589 | S | 12/2002 | Miedzius | |
| 6,520,431 | B2 | 2/2003 | Donovan | |
| 6,553,947 | B2 | 4/2003 | Bradenbaugh | |
| 6,611,972 | B2 | 9/2003 | Underbrink et al. | |
| 6,711,758 | B1 | 3/2004 | Terek et al. | |
| 6,782,568 | B2 | 8/2004 | Novak et al. | |
| 6,976,279 | B1 | 12/2005 | Berke et al. | |
| D514,197 | S | 1/2006 | Gilbert | |
| 7,007,316 | B2 | 3/2006 | Lutz | |
| 7,011,652 | B1 | 3/2006 | Berke et al. | |
| 7,159,252 | B2 | 1/2007 | Underbrink et al. | |
| 7,188,846 | B2 | 3/2007 | Deavila | |
| 7,201,732 | B2 * | 4/2007 | Anderson | A61M 5/1723 604/521 |
| 7,240,852 | B2 | 7/2007 | Taylor | |
| 7,240,853 | B2 | 7/2007 | Taylor | |
| 7,243,381 | B2 | 7/2007 | Lutz, II | |
| 7,244,246 | B2 | 7/2007 | Madritsch et al. | |
| D559,365 | S | 1/2008 | Plikuhn | |
| D585,117 | S | 1/2009 | Slothower | |
| D588,240 | S | 3/2009 | Hanna | |
| 7,799,003 | B2 | 9/2010 | Johnson et al. | |
| 7,806,348 | B2 | 10/2010 | Kline et al. | |
| 7,857,795 | B2 | 12/2010 | Perrin et al. | |
| 7,971,601 | B2 | 7/2011 | Lum et al. | |
| 8,034,036 | B2 | 10/2011 | Osborne | |
| 8,060,957 | B2 | 11/2011 | Johnson | |
| 8,064,758 | B2 | 11/2011 | Fabrizio | |
| D662,219 | S | 6/2012 | Perrin et al. | |
| D662,605 | S | 6/2012 | Perrin et al. | |
| 8,205,279 | B2 | 6/2012 | Devinat et al. | |
| D671,228 | S | 11/2012 | Perrin et al. | |
| 8,313,472 | B2 | 11/2012 | Devinat et al. | |
| 8,316,477 | B2 | 11/2012 | Smith et al. | |
| 8,316,478 | B2 * | 11/2012 | Strandberg | A61H 35/02 4/620 |
| D673,298 | S | 12/2012 | Perrin | |
| 8,371,825 | B2 * | 2/2013 | Devinat | A61H 35/02 29/888.021 |
| 8,435,220 | B2 | 5/2013 | Smith et al. | |
| D685,920 | S | 7/2013 | Perrin | |
| 8,490,895 | B2 | 7/2013 | Jaworski et al. | |
| 8,566,974 | B2 | 10/2013 | Strandberg et al. | |
| 8,591,479 | B2 | 11/2013 | Boissonneault et al. | |
| 8,747,374 | B2 | 6/2014 | Strandberg | |
| 2003/0218074 | A1 | 11/2003 | Beck et al. | |
| 2005/0054992 | A1 | 3/2005 | Madritsch et al. | |
| 2006/0096026 | A1 | 5/2006 | Lutz, II | |
| 2007/0089232 | A1 | 4/2007 | Smith et al. | |
| 2007/0089233 | A1 | 4/2007 | Smith et al. | |
| 2007/0089234 | A1 | 4/2007 | Copeland et al. | |
| 2007/0089235 | A1 | 4/2007 | Devinat et al. | |
| 2007/0092388 | A1 | 4/2007 | Devinat et al. | |
| 2007/0186341 | A1 | 8/2007 | Uffner et al. | |
| 2007/0204398 | A1 | 9/2007 | Dubois | |
| 2007/0278757 | A1 | 12/2007 | Deavila | |
| 2008/0039808 | A1 | 2/2008 | Val Madritsch et al. | |
| 2008/0281280 | A1 | 11/2008 | Jaworski et al. | |
| 2009/0308494 | A1 | 12/2009 | Linn | |
| 2010/0107327 | A1 | 5/2010 | Eveleigh | |
| 2011/0046582 | A1 | 2/2011 | Devinat et al. | |
| 2011/0056015 | A1 | 3/2011 | Perrin | |
| 2011/0225725 | A1 | 9/2011 | Kersten | |
| 2012/0057857 | A1 | 3/2012 | Kenney et al. | |
| 2012/0096639 | A1 | 4/2012 | Stanley et al. | |
| 2012/0240328 | A1 | 9/2012 | Dudley | |
| 2012/0324643 | A1 | 12/2012 | Ferry | |
| 2013/0042403 | A1 | 2/2013 | Strandberg et al. | |
| 2013/0283522 | A1 | 10/2013 | Novak | |
| 2013/0340160 | A1 | 12/2013 | Eveleigh et al. | |
| 2015/0113725 | A1 | 4/2015 | Eveleigh | |
| 2016/0095794 | A1 | 4/2016 | Eveleigh | |

FOREIGN PATENT DOCUMENTS

| | | |
|---|---|---|
| CA | 2570161 | 12/2005 |
| EP | 0723769 | 7/1996 |
| GB | 2485724 | 5/2012 |
| WO | 2011031674 | 3/2011 |

OTHER PUBLICATIONS

Product information for Speakman® Optimus™ Wall Mounted Eye and Face Wash Bowl SE-1000, 2 pgs. Oct. 2014.
Product information for Speakman® Optimus™ Wall Mounted Eye and Face Wash Bowl SE-1050, 2 pgs. Oct. 2014.
Product information for Speakman® Optimus™ Wall Mounted Eye and Face Wash Bowl SE-1055, 2 pgs. Oct. 2014.
Haws® Catalog of Decontamination Products: Axion MSR™, Eye/Face Wash Units, Showers/ Combination Units, 8 pgs. 2014.
Product Information for Speakman® Heat Traced Combination Shower with Eye/Face Wash System SE-7001 Jan. 2015.
Product Information for Guardian G1950P Safety Station with Eye/Face Wash, Plastic Bowl, 2 pgs. Jan. 2014.
Product Information for Bradley Combination Drench Shower and Halo Eyewash or Eye/Face Wash S19314 Series, 5 pgs. May 19, 2014.
Haws® Catalog of Axion® Thermostatic Mixing Valves, 6 pgs. 2014.
Product Information for Encon Galvanized Pipe, www.enconsafety.com, 3 pgs. Jul. 13, 2015.
U.S. Appl. No. 13/841,056, NF Office Action dated Jul. 28, 2016, 14 pages.
U.S. Appl. No. 13/841,056, Applicant Response dated Jan. 30, 2017, 32 pages.
U.S. Appl. No. 14/753,963, NF Office Action dated Feb. 9, 2017, 7 pages.

* cited by examiner

EYE WASH SYSTEM FOR EMERGENCY USAGE

CROSS REFERENCE TO RELATED APPLICATIONS

This application claims the benefit of priority to U.S. Provisional Patent Application Ser. No. 61/970,202, filed Mar. 25, 2014, and U.S. Provisional Patent Application Ser. No. 61/897,554, filed Oct. 30, 2013; both of which are incorporated herein by reference.

FIELD OF THE INVENTION

Various embodiments of the present invention pertain to methods and apparatus for emergency washing or residential washing, and in particular to eyewash, facewash, or bodywash apparatus.

BACKGROUND OF THE INVENTION

Emergency eyewashes and showers provide a rapid washing to a person contaminated with a dangerous chemical whether the exposure is in a research laboratory, a farm, or in the exhaust of a nitromethane burning AA fuel funny car. However, the systems provide no benefit, and further are a detriment for creating false hope if the equipment does not work.

Various existing emergency eyewash basins and showers utilize complex flow systems that require professional installation and adjustment. Therefore, if an emergency wash site does not work, the employer is required to "lock out" and "tag out" that site until it is repaired. Often, it takes days to schedule the professional to service the site, and further time delays are encountered to simply order the parts, which by their complexity are too expensive to be maintained in inventory at the worksite.

Yet other problems arise when it is difficult to check and adjust the operation of the emergency wash site. If it is not easy to determine that the equipment is working properly, then the employers may not apply appropriate resources to routinely check the equipment. Under such circumstances, the wash site may not provide sufficient flow, or may provide flow that is too hot, and any user of the wash site may suffer as a result.

Yet other eyewash basins are generally round in shape, or otherwise lacking in any geometric feature that can be felt by the hands of a user during an emergency. In such emergency conditions, the user may be temporarily blinded, and thus have difficulty aligning him/herself with the eyewash nozzles. Since time is important in washing contaminants from the eye, the additional seconds required for the person to align his/her eyes with the nozzle spray pattern could result in increased injury. Many such basins are generally featureless in terms of letting the user tacitly (by hand) locate themselves with their eyes shut.

Still further, many transportable emergency wash systems suffer from inadequate protection from damage to the wash site as it is being transported. The act of transport can include multiple types of single occurrence shocks to the equipment, such as during loading and unloading. Further, wash sites can be located near sources of vibration, such as a Hemi® running open headers. This can be a problem if parts of the wash system include electronic apparatus.

Further, it is becoming increasingly important for water to be conserved, and this is even more important in those situations in which the water at the wash site comes from a limited reservoir, or is otherwise limited by a failure in a thermostatically-controlled valve. During such valve failures, the amount of flow available is often less than about two gallons per minute. Some existing wash sites are not capable of providing an adequate wash to a contaminated user with such low flows.

Various embodiments of the present invention address some or all of these aspects, and still other aspects, in novel and unobvious ways.

SUMMARY OF THE INVENTION

Various embodiments of the present invention pertain to improvements in residential and emergency washing systems.

One embodiment of the present invention pertains to a washing system that includes a source of light adapted and configured to permit the user to locate a portion of their body (such as their face or eyes) relative to an upward stream of water. In some embodiments the source of light is directed generally upward from the center of the stream, and may not be incident upon the drainage basin. However, the location and direction of the source of light in some embodiments addresses the problem of a user wanting to quickly orient themselves relative to the source of water in a dark environment, and not necessarily relative to the drainage basin. However, in some embodiments it will be recognized that the location and direction of the source of light provides to the user an orientation for the user's face or eyes relative to both the water spray and the drainage basin.

Still further embodiments of the present invention pertain to a residential washing system in which a single washing outlet can provide either a gentle upward flow of water to wash the person's face, or a downward flow of aerated water accessible by the hands of the user. Preferably, the upwardly directed flow of water for face washing is generally consistent with the flow rates and fountain heights typically used for emergency eyewashing applications. In such applications the upward flow of water is more than about two inches high and less than about twelve inches high, the flow nozzles being adapted and configured to provide a gentle stream for a user that is bent over and facing downward toward the flow nozzles. In some embodiments the user rotates the nozzle assembly about ninety degrees to turn on one of the flows and simultaneously turn off the other flow. In still further embodiments the water outlet valve includes a first flow control valve that limits the amount of water being provided upward for the face or eye wash, and yet another fluid circuit having either no flow control valve or a flow control valve of a higher flow value, for providing increased downward flow through the aerated nozzle.

Yet other embodiments of the present invention pertain to emergency washing system in which the water nozzle washing assembly can provide either an upward flow of water in two fountains (for right and left eyewashing), or a single, generally continuous pattern directed upward (for face washing). The nozzle assembly is provided with water from a water supply fitting that has a fixed spatial orientation. As the user rotates the water supply nozzle, the supply fitting stays fixed, and this relative rotation turns on the flow of water to one of the sets of nozzles, and turns off the flow of water to the other set of nozzles.

Yet another embodiment of the present invention pertains to an eyewashing system that includes a mixing apparatus that is adapted and configured to lessen any hot temperature spikes in the flow of water being provided to an emergency washing system. In some embodiments, there is a thermostatically controlled valve that receives hot water and cold water, and provides a mixture of the two at an outlet. However, it has been found that some thermostatically controlled valves have a response characteristic that provides a mixed outlet flow that is temporarily too hot (in some cases, a "spike"), and which would be discouraging or harmful to the user. Some embodiments include a mixing apparatus that stores a volume of water, which over time will have a temperature about the same as ambient temperature. Water from the thermostatically controlled valve outlet is provided to this mixing apparatus, which includes an inner volume having a porous and/or circuitous inner flow path that mixes the water from the valve with the internal, ambient temperature water, and producing an outlet flow to the shutoff valve of the emergency washing system that has little if any "spike."

Still further embodiments of the present invention include a shower head for an emergency washing system. Water is received within the shower head, and after entering the shower head apparatus the water impinges on a deflecting member. The deflecting member deflects some of the water backward and laterally to help equally distribute the flow across the area of the shower head, but also directly flows some of the inlet water directly onto the user. This latter directed flow passes through a set of orifices in the deflecting member that are substantially in alignment with a second pair of orifices in a downstream dispensing plate. In some embodiments, there is direct "line of sight" from the user through the holes in the dispensing place through the holes in a deflecting member to the water inlet to the shower head. However, it has been found that complete or total line of sight between the two patterns of flow orifices may not be preferable in some embodiments, such that the first set of orifices in the deflecting member is oriented to impinge slightly on a boundary of the second set of orifices in the dispensing plate.

Yet other embodiments of the present invention pertain to an emergency eyewashing system, in which water is supplied to left and right fountains of water for washing corresponding left and right eyes of the user. Preferably, the system includes right and left filters for washing the water before it is sprayed toward the user. In some embodiments, there is a drainage aperture between the left and right filters, such that after the emergency usage has occurred, that the water contained in the fixture on the outlet side of each filter is able to drain across the filter (i.e., from filter outlet to filter inlet) toward a drain aperture for gravity assisted draining of the water and simultaneous washing of any debris collected on the inlet side of the filter. In some embodiments one or more of these filters are substantially disc-shaped, with the disc being supported vertically from an edge.

Still further descriptions of various embodiments of the present invention can be found in the paragraphs X1 through Xn (and including the paragraphs that modify these paragraphs X1 through Xn) located toward the end of the specification. It will be appreciated that the various apparatus and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

DESCRIPTION OF THE DRAWINGS

Some of the figures shown herein may include dimensions. Further, some of the figures shown herein may have been created from scaled drawings or from photographs that are scalable. It is understood that such dimensions, or the relative scaling within a figure, are by way of example, and not to be construed as limiting.

FIG. 1-2 is a front elevational view of the apparatus of FIG. 1-2

FIG. 1-3 is a side elevational view of the apparatus of FIG. 1-1

FIG. 1-4 is a top plan view of the apparatus of FIG. 1-1.

FIG. 1-5 is a right side perspective view of a portion of the apparatus of FIG. 1-1.

FIG. 1-6 is a right side cross-sectional view of the apparatus of FIG. 1-5, shown in solid.

FIG. 1-7 is a right side cross sectional view of the apparatus of FIG. 1-5, shown in cross sectional view.

FIG. 1-8 is a right, top, perspective cutaway of the apparatus of FIG. 1-7.

FIG. 1-9 is a top, perspective view of an eyepiece according to one embodiment of the present invention.

FIG. 2-1A shows a top external view of a thermostatic control valve according to one embodiment of the present invention.

FIG. 2-1B shows a side elevational view of the valve of FIG. 2-1A

FIG. 2-1C shows a front plan view of the valve of FIG. 2-1A.

FIG. 2-1D shows a side elevational view of the valve of FIG. 2-1A

FIG. 2-1E shows a bottom plan view of the valve of FIG. 2-1A.

FIG. 2-2A shows a cutaway view of a valve having a bottom outlet.

FIG. 2-2B shows a cutaway view of a valve having a top outlet.

FIG. 2-2C shows a cutaway view of a valve having top and bottom outlets.

FIG. 2-3 is a cutaway view of a thermostatically controlled valve according to another embodiment of the present invention, with the left side of the valve showing a top-facing inlet, in the right side of the valve showing a bottom-facing inlet.

FIG. 2-4 is an enlargement of a portion of FIG. 2-4.

FIG. 3-1A is a front, top, perspective photographic representation of an apparatus according to one embodiment of the present invention.

FIG. 3-1B is a symbolic schematic representation of the flow system of the apparatus of FIG. 3-1A.

FIG. 3-1C is a cutaway side view of an accumulator (diffuser) according to one embodiment of the present invention.

FIG. 3-2 is a top and side perspective photographic representation of the apparatus of FIG. 3-1A.

FIG. 3-3 is a left side, top perspective photographic representation of the apparatus of FIG. 3-1A.

FIG. 3-4 is a photographic representation of a thermostatic control valve from the apparatus of FIG. 3-1A.

FIG. 3-5 is a photograph of the front and back halves of the eye/face wash block (outlet valve) of FIG. 3-1A.

FIG. 3-6A is a backside photographic representation of a showerhead assembly according to one embodiment of the present invention.

FIG. 3-6B is a front side photographic representation of the showerhead of FIG. 3-6A.

FIG. 3-7 is an exploded, side by side photographic representation of the apparatus of FIG. 3-6B.

FIG. 3-8 is a close up photographic representation of the dispersing member of FIG. 3-7.

FIG. 4-9 is a photographic representation of a transportable eyewash according to one embodiment of the present invention.

FIG. 4-10 is a schematic flowchart of the eyewash system of FIG. 9.

FIG. 4-11A is a photographic representation of the valve body of the system of FIG. 9, with the inner valve removed and positioned to be fully opened.

FIG. 4-11B is a photographic representation of the block (valve body) of the system of FIG. 9, with the inner diverter pin (valve) removed and positioned to be closed, and emphasizing a nonclosable flow area.

FIG. 5-1 is a top photographic representation of an eyewash valve assembly according to one embodiment of the present invention.

FIG. 5-2 is a bottom photographic representation of the apparatus of FIG. 5-1.

FIG. 5-3 is a perspective photographic representation of the apparatus of FIG. 5-1.

FIG. 5-4 is a perspective photographic representation of the apparatus of FIG. 5-1.

FIG. 5-5 is a photographic top side view of various components of the apparatus of FIG. 5-1.

FIG. 5-6 is a photographic bottom side view of various components of the apparatus of FIG. 5-1, with the exception that the apparatus at the top is a side photographic representation.

FIG. 5-7 is a top photographic representation of a basin according to one embodiment of the present invention.

FIG. 5-8 is a photographic representation of the bottom of the apparatus of FIG. 5-7.

FIG. 5-9 is a close-up photograph of a portion of the apparatus of FIG. 5-7.

FIG. 5-10 is a photographic representation of a portion of the apparatus of FIG. 5-8.

FIG. 5-11 is a side photographic representation of a portion of an eyewash assembly according to one embodiment of the present invention.

FIG. 5-12 is a schematic cutaway representation of an expulsion valve according to one embodiment of the present invention.

FIG. 5-13 is a hydraulic schematic representation of a system according to one embodiment of the present invention.

FIG. 5-14 is a hydraulic schematic representation of a system according to one embodiment of the present invention.

FIG. 6-1 is a perspective photographic representation of a transportable eyewash system according to another embodiment of the present invention.

FIG. 6-2 is a front photographic representation of the apparatus of FIG. 6-1.

FIG. 6-3 is a side and frontal perspective photographic representation of the bottom of the apparatus of FIG. 6-1.

FIG. 6-4 is a hydraulic schematic representation of a transportable system according to one embodiment of the present invention.

FIG. 6-5 is a hydraulic schematic representation of a transportable system according to one embodiment of the present invention.

FIG. 7-1 is a photographic representation from the side of an emergency eye wash system according to one embodiment of the present invention.

FIG. 7-2 is a close up photographic representation of a portion of the system of FIG. 7-1.

FIG. 7-3 is a cutaway view of a CAD model of an outlet valve according to another embodiment of the present invention.

FIG. 7-4 is a different cutaway of the outlet valve of FIG. 7-3.

FIG. 7-5 is a top view of right and left of eye wash dispensing caps according to another embodiment of the present invention.

FIG. 7-6 is a top view of right and left of eye wash dispensing caps according to another embodiment of the present invention.

FIG. 7-7 is a top view of right and left of eye wash dispensing caps according to another embodiment of the present invention.

FIG. 7-8 is a top view of right and left of eye wash dispensing caps according to another embodiment of the present invention.

FIG. 7-9 is a photographic representation of portions of a showerhead assembly according to another embodiment of the present invention.

FIG. 7-10 is a photographic representation of the components of FIG. 7-11 attached to one another.

FIG. 7-11A shows top and side orthogonal views of the central deflector of FIG. 7-11.

FIG. 7-11B is a top plan scaled line drawing of the apparatus of FIG. 7-10.

FIG. 7-11C is a side elevational and orthogonal scaled line drawing of the apparatus of FIG. 7-11B.

FIG. 7-11D is a blow-up of the central portion of FIG. 7-11B.

FIG. 7-12 is a top, front perspective line drawing of portions of an eye wash system according to another embodiment of the present invention.

FIG. 7-13 is a side elevational, cross-sectional representation of a portion of the apparatus of FIG. 7-12 as taken down the middle of the apparatus.

FIG. 7-14 is a top, right side perspective line drawing of an eye wash system according to another embodiment of the present invention.

FIG. 7-15 is a top, front perspective line drawing of portions of an eye wash system according to another embodiment of the present invention.

FIG. 7-16 is a side elevational, cross-sectional representation of a portion of the apparatus of FIG. 7-15 as taken down the middle of the apparatus.

FIG. 8-1 is a top plan view of an apparatus according to another embodiment of the present invention.

FIG. 8-2 shows schematic cross sectional views of FIG. 8-1 with the nozzles in a first position (top), and in a second, rotated position (bottom).

FIG. 8-3 is a top plan view of an apparatus according to another embodiment of the present invention.

FIG. 8-4A shows schematic cross sectional views of FIG. 8-1 with the nozzles in a first position (top), and in a second, rotated position (bottom).

FIG. 8-4B is a cross sectional view of an alternative of FIGS. 8-1, and including a flow control valve for metering and/or limiting of the output flow of the eyewash apertures to a predetermined range.

FIG. 8-5 is a top plan view of an apparatus according to another embodiment of the present invention.

FIG. 8-6 is a side elevational view of the apparatus of FIG. 8-5.

FIG. 8-7 is a front elevational view of the apparatus of FIG. 8-5.

FIG. 8-8 shows the apparatus of FIG. 8-6 with the nozzles rotated to a second position.

FIG. 8-9 is a top plan view of an apparatus according to another embodiment of the present invention, adjusted to provide a face wash.

FIG. 8-10 shows the apparatus of FIG. 8-9 adjusted to provide an eyewash.

FIG. 8-11 shows cross sectional views of the two positions of the fluid connection between the inner flow passage and the face wash apertures (top view) and the eyewash apertures (bottom view).

FIG. 9-1 is a front elevational view of an apparatus according to yet another embodiment of the present invention.

FIG. 9-2 is a side elevational view of the apparatus of FIG. 9-1.

ELEMENT NUMBERING

Figure 1:
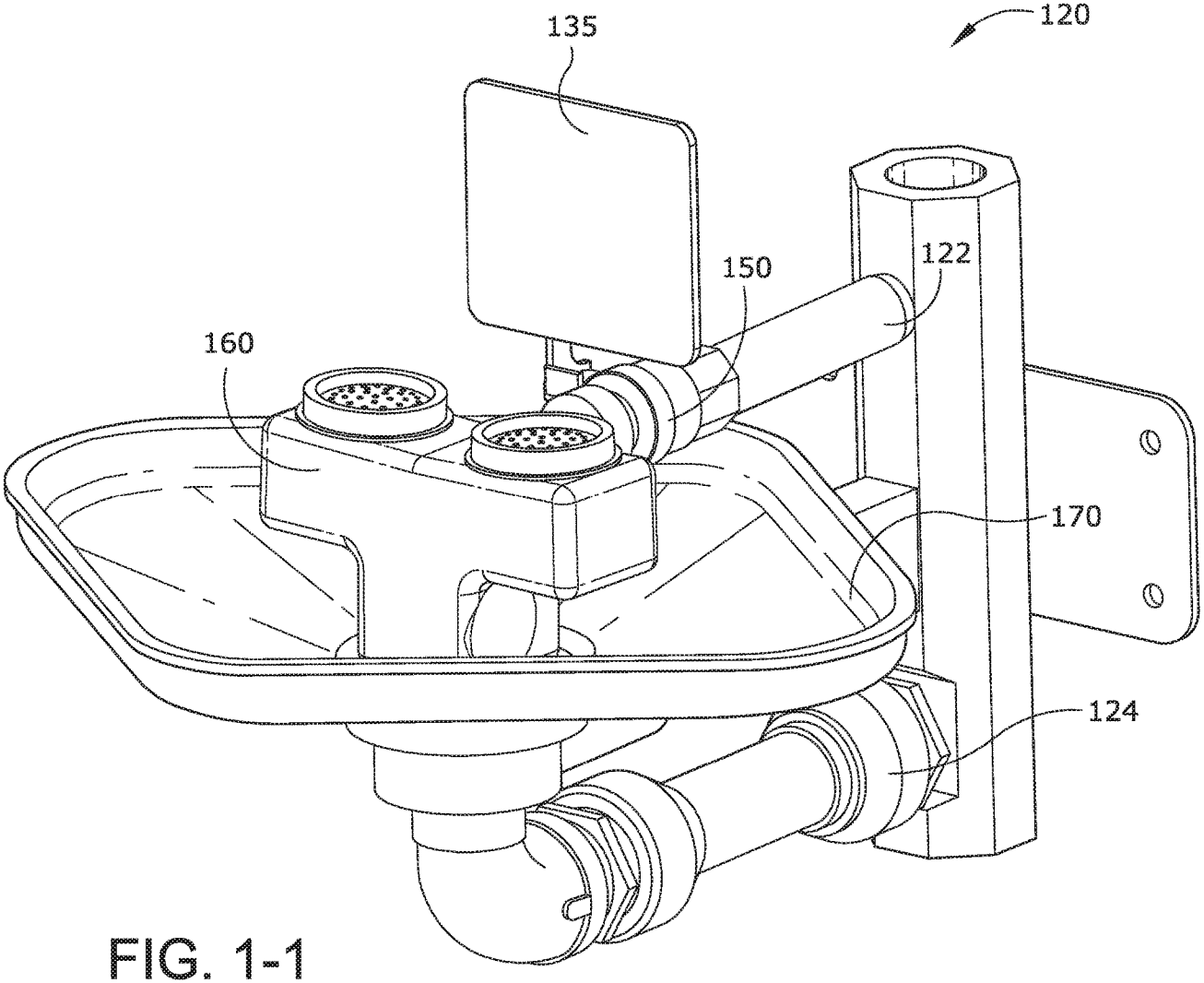
FIG. 1-1 is a right side, top perspective view of an emergency eye wash according to 1 embodiment of the present invention.

The following is a list of element numbers and at least one noun used to describe that element. It is understood that none of the embodiments disclosed herein are limited to these nouns, and these element numbers can further include other words that would be understood by a person of ordinary skill reading and reviewing this disclosure in its entirety.

| | |
|---|---|
| 10 | System |
| 11 | cart |
| 12 | deck |
| 13 | legs |
| 14 | wheels |
| 15 | lid |
| 20 | eye wash system |
| 21 | dispensing caps |
| a | apertures |
| b | smaller apertures |
| c | larger apertures |
| d | aerated faucet |
| 22 | water tank |
| 23 | quick connect fitting |
| 24 | hot source |
| 25 | support arm |
| 26 | stand |
| 28 | drain |
| 29 | catch basin |
| 30 | thermostatically controlled valve |
| 31 | cold inlet |
| 32 | tempered fluid outlet |
| 33 | hot inlet |
| 34 | body |
| 35 | panel |
| 36 | cartridge |
| 37 | mixing outlets |
| 38 | metering section/ flow restrictor |
| 40 | diffusing heat exchanger |
| 41 | inlet |
| 42 | outlet |
| 43 | serpentine passage |
| 44 | apertures |
| 50 | shut-off valve |
| 51 | quick connect |
| 52 | paddle shut-off |
| 53 | purge line |
| 56 | filter |
| a | groove |
| 58 | expulsion valve |
| a | inlet |
| b | outlet |
| c | flapper |

-continued

| | |
|---|---|
| 60 | outlet valve; nozzle assembly |
| 61 | body |
| a | indexing |
| 62 | internal chamber |
| 63 | water inlet |
| a | secondary outlet |
| 64 | eyewash outlets |
| 64a | filters |
| 65 | internal connection |
| 66 | variable orifice valve; flow control device |
| a | fixed member |
| b | flexible member; variable member |
| 67 | interface |
| 68 | outlet |
| 69 | seal |
| 70 | return wash basin |
| 71 | indexing feature |
| 72 | Drain, variable drain, fixed |
| 73 | attachment feature |
| 74 | tactile features |
| 75 | lip |
| 80 | shower head assembly |
| 81 | inlet |
| 82 | bowl |
| 83 | depressions |
| 84 | dispersing member |
| 85 | stand offs |
| a | peripheral |
| b | central |
| 86 | central deflector; deflecting member |
| a | aligned aperture |
| b | central attachment |
| 87 | apertures |
| a | aligned aperture |
| b | second, outer pattern |
| c | boundary |
| 88 | ridges |
| 90 | heater |
| 90C | cold inlet |
| 91 | source of electricity |
| 92 | shock mounts |
| 94 | heat exchanger |
| 96 | thermal switch |
| 98 | visual indicator |
| a | light |
| b | battery; photocell |
| c | sensor, water or position |
| d | light emitting material |
| e | housing |
| f | encapsulation material |
| 99 | Thermometer |
| V20 | thermostatically controlled valve |
| V22 | tower casing |
| V24 | thermostat assembly |
| V30 | base casing |
| V32 | metering section |
| V34 | check valve housings |
| V36 | threaded interface |
| V40 | check valve assembly |
| V42 | bonnet |
| V43 | spring support |
| V44 | outlet seal |
| V45 | chamber |
| V46 | spring |

-continued

| | |
|---|---|
| V47a | disk |
| V47b | gasket |
| V48 | screw |
| V49 | acorn nut |
| V50 | Outlet |
| VCL | vertical center line |
| LCL | lateral center line |

DESCRIPTION OF THE PREFERRED EMBODIMENT

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. At least one embodiment of the present invention will be described and shown, and this application may show and/or describe other embodiments of the present invention.

It is understood that any reference to "the invention" is a reference to an embodiment of a family of inventions, with no single embodiment including an apparatus, process, or composition that should be included in all embodiments, unless otherwise explicitly stated. Further, although there may be discussion with regards to "advantages" provided by some embodiments of the present invention, it is understood that yet other embodiments may not include those same advantages, or may include yet different advantages. Any advantages described herein are not to be construed as limiting to any of the claims. The usage of words indicating preference, such as "preferably," refers to features and aspects that are present in at least one embodiment, but which are optional for some embodiments.

The use of an N-series prefix for an element number (NXX.XX) refers to an element that is the same as the non-prefixed element (XX.XX), except as shown and described. As an example, an element 1020.1 would be the same as element 20.1, except for those different features of element 1020.1 shown and described. Further, common elements and common features of related elements may be drawn in the same manner in different figures, and/or use the same symbology in different figures. As such, it is not necessary to describe the features of 1020.1 and 20.1 that are the same, since these common features are apparent to a person of ordinary skill in the related field of technology. Further, it is understood that the features 1020.1 and 20.1 may be backward compatible, such that a feature (NXX.XX) may include features compatible with other various embodiments (MXX.XX), as would be understood by those of ordinary skill in the art. This description convention also applies to the use of prime (′), double prime (″), and triple prime (‴) suffixed element numbers. Therefore, it is not necessary to describe the features of 20.1, 20.1′, 20.1″, and 20.1‴ that are the same, since these common features are apparent to persons of ordinary skill in the related field of technology.

Although various specific quantities (spatial dimensions, temperatures, pressures, times, force, resistance, current, voltage, concentrations, wavelengths, frequencies, heat transfer coefficients, dimensionless parameters, etc.) may be stated herein, such specific quantities are presented as examples only, and further, unless otherwise explicitly noted, are approximate values, and should be considered as if the word "about" prefaced each quantity. Further, with discussion pertaining to a specific composition of matter, that description is by example only, and does not limit the applicability of other species of that composition, nor does it limit the applicability of other compositions unrelated to the cited composition.

What follows are paragraphs that express particular embodiments of the present invention. In those paragraphs that follow, some element numbers are prefixed with an "X" indicating that the words pertain to any of the similar features shown in the drawings or described in the text.

Various references may be made to one or more processes, algorithms, operational methods, or logic, accompanied by a diagram showing such organized in a particular sequence. It is understood that the order of such a sequence is by example only, and is not intended to be limiting on any embodiment of the invention.

Various references may be made to one or more methods of manufacturing. It is understood that these are by way of example only, and various embodiments of the invention can be fabricated in a wide variety of ways, such as by casting, centering, welding, electrodischarge machining, milling, as examples. Further, various other embodiment may be fabricated by any of the various additive manufacturing methods, some of which are referred to 3-D printing.

This document may use different words to describe the same element number, or to refer to an element number in a specific family of features (NXX.XX). It is understood that such multiple usage is not intended to provide a redefinition of any language herein. It is understood that such words demonstrate that the particular feature can be considered in various linguistical ways, such ways not necessarily being additive or exclusive.

Reference will be made to an eyewash system and various components of the system. It is understood that the system and various components are further compatible with face wash and body wash systems and components.

The figures herein prefaced with the number "1" pertain to an emergency eye wash 120 according to one embodiment of the present invention. Further, all element numbers in the 100 series pertain to various components and features of eyewash 120. The figures herein prefaced with the number "2" pertain to a eyewash system 220 according to one embodiment of the present invention.

Eyewash 120 includes a valve block 160 provided with water from an inlet 122, and providing a spray of water through a pair of eyepieces 121 to a person needing an emergency eyewash. Apparatus 120 can be attached to a wall by a support bracket 126, which can be coupled to an attachment plate attached to the wall. Water flowing out of block 160 is captured in a bowl 170 that provides the water to and outlet drain 124.

Figures 1, 2:
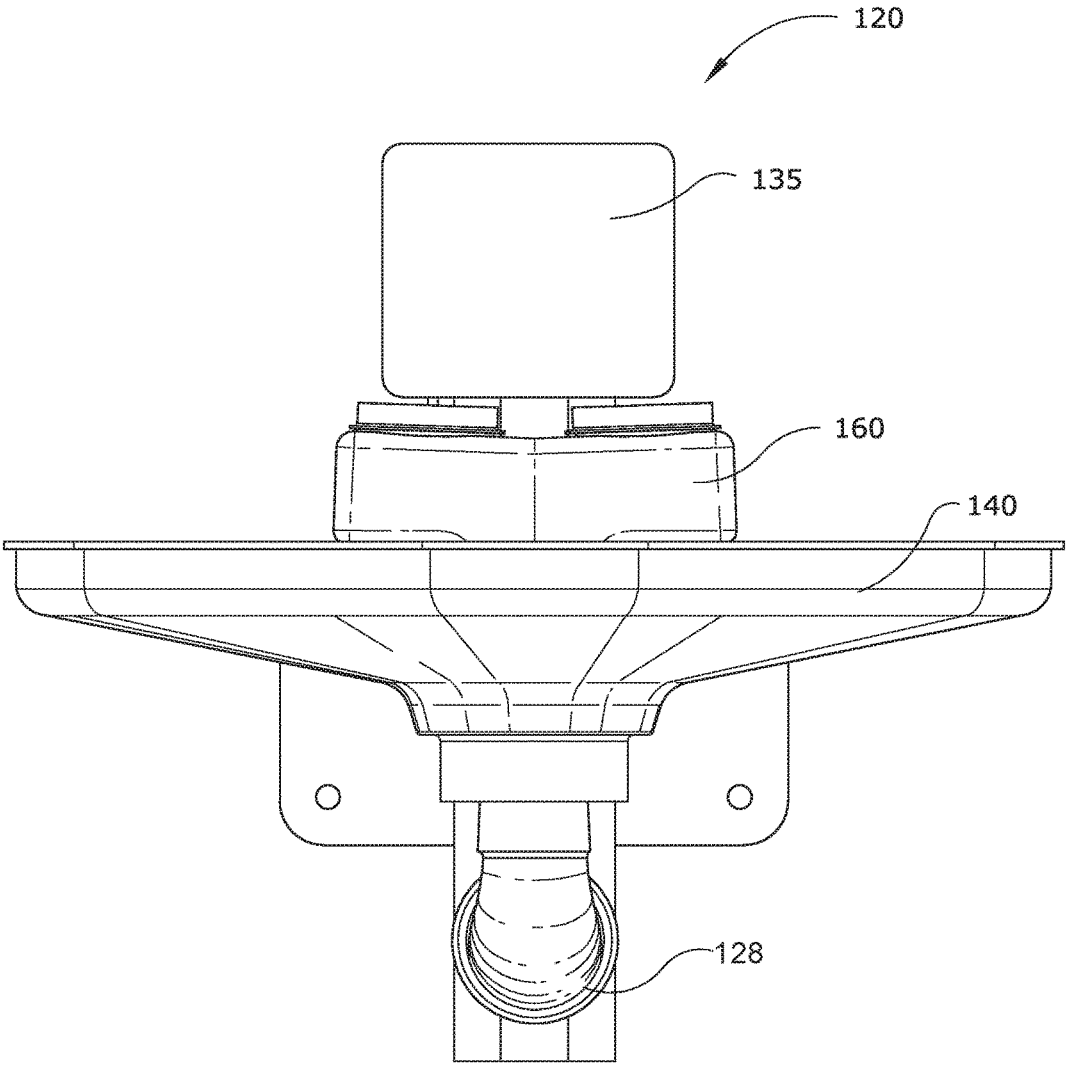
Figures 1, 2, 3:
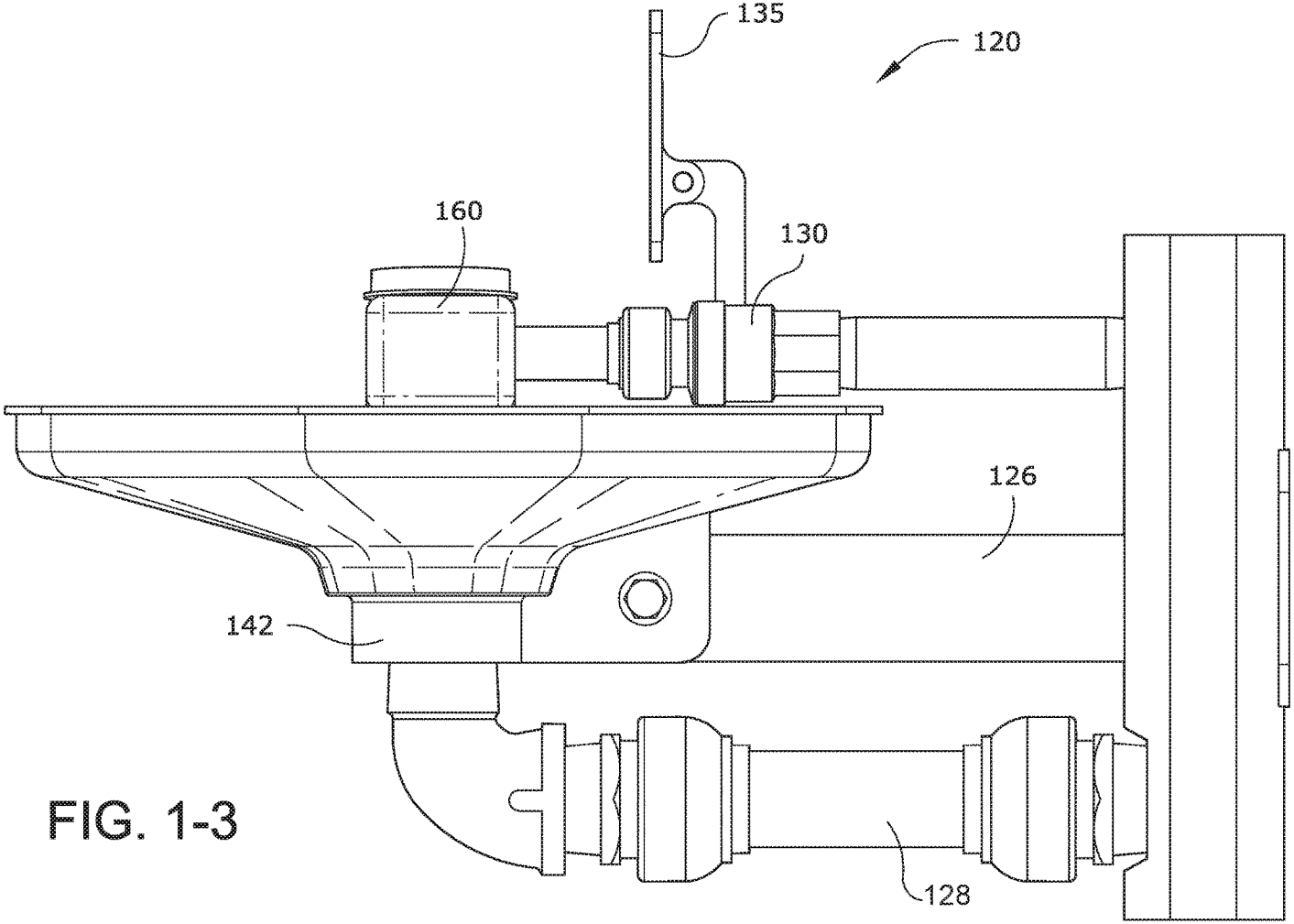

Eyewash 120 includes a shutoff valve 160 that must be actuated by the user before water will exit from eyepieces 121. As best seen in FIGS. 1-3, shutoff valve 150 is placed in the central inlet line 122, and in some embodiments is a ball-type valve. The ball can be rotated so as to begin the flow of water by the user pushing forward on centrally located paddle 152. Panel 152 is connected by an arm of 135 to the axis of ball valve 150. Preferably, panel 152 is centrally located relative to eyepieces 121, so that persons that are left-handed can use eyewash 120 as easily as persons that are right-handed.

It has been found that other emergency eyewash typically have a mechanism on the right side of the eyewash that must be operated in order to achieve the washing flow. With such eyewash is, a person that is left-handed is largely put at a disadvantage, and may waste time trying to locate the right-handed mechanism. Further, panel 152 is up right and prominent, making it easy to see. In some embodiments, panel 152 includes a large, substantially flat surface upon which warning labels and instructional labels can be applied.

Referring to FIG. 1-4, head block 160 connects to shutoff valve 150 by way of a 2 and quick-release seal 169. In some embodiments, seal 169 includes a plurality of "shark teeth" that can provide a quickly-made seal between the inlet pipe of head block 160 and the outlet of shutoff valve.

In some embodiments head block 160 includes right and left hinged panels by which the user can quickly disconnect head block 160 from eyewash 120. The person can place their fingers on the panels, and rotate the paddles such that the distal ends of the paddles press against the face of seal 160. In so doing, the user can easily remove head block 160 by simply pulling it toward them while the seals are compressed. Preferably, head block 160 is not mechanically linked to the drain of bowl 170, such that the connection between the inlet pipe of the head block and the outlet of the shutoff valve is the only connection that needs to be made.

FIGS. 1-5, 1-6, 1-7, and 1-8 show various details of head block 160 and shutoff valve 150. It can be seen that head block 160 includes an inlet passage 162 that provides water from shutoff valve 130 to a central manifold 164. Manifold 164 extends both right and left toward eyepieces 120, and further extends downward toward a cavity 168.

In some embodiments, cavity 168 includes material for conditioning the water that is sprayed out of eyepieces 121. This material can be a filter material, activated charcoal, and astringent, or other apparatus useful to protect and wash eyes that have been exposed to a damaging chemical. Further, this protective material can be easily removed from head block 160, which is useful for those protective materials that lose their beneficial qualities after a period of time.

FIG. 1-9 shows a close-up of an eyepiece 121. Eyepiece 120 includes a plurality of spray holes, some of which are located in an outermost ring 121*a*, others of which are located in a middle ring 121*b*, and yet others that are centrally located. Eyepiece 120 further includes a sealing lip 121*e* that provides for easy installation and removal of eyepiece 120. Preferably, eyepiece 120 is fabricated from a flexible material that a person can easily manipulate to break off scale deposits.

FIGS. 2-1 to 2-4 show various embodiments of a thermostatically controlled valve V20 according to one embodiment of the present invention. It is understood that the prefix "V" to an element number refers only to the examples of FIGS. 2-1 through 2-4, although it is understood that such a thermostatically controlled as valve V20 can be used with any of the emergency wash systems shown herein.

FIG. 2-1 shows external orthogonal views of a valve V20 according to one embodiment of the present invention. Valve V20 is a thermostatically controlled valve, having a tower casing V22 coupled to a valve casing or housing V30. Housing V30 includes right and left ports for the inlet of water, and further includes a housing extension having an outlet V50 to provide a flow of tempered water.

Figures 1A, 3:
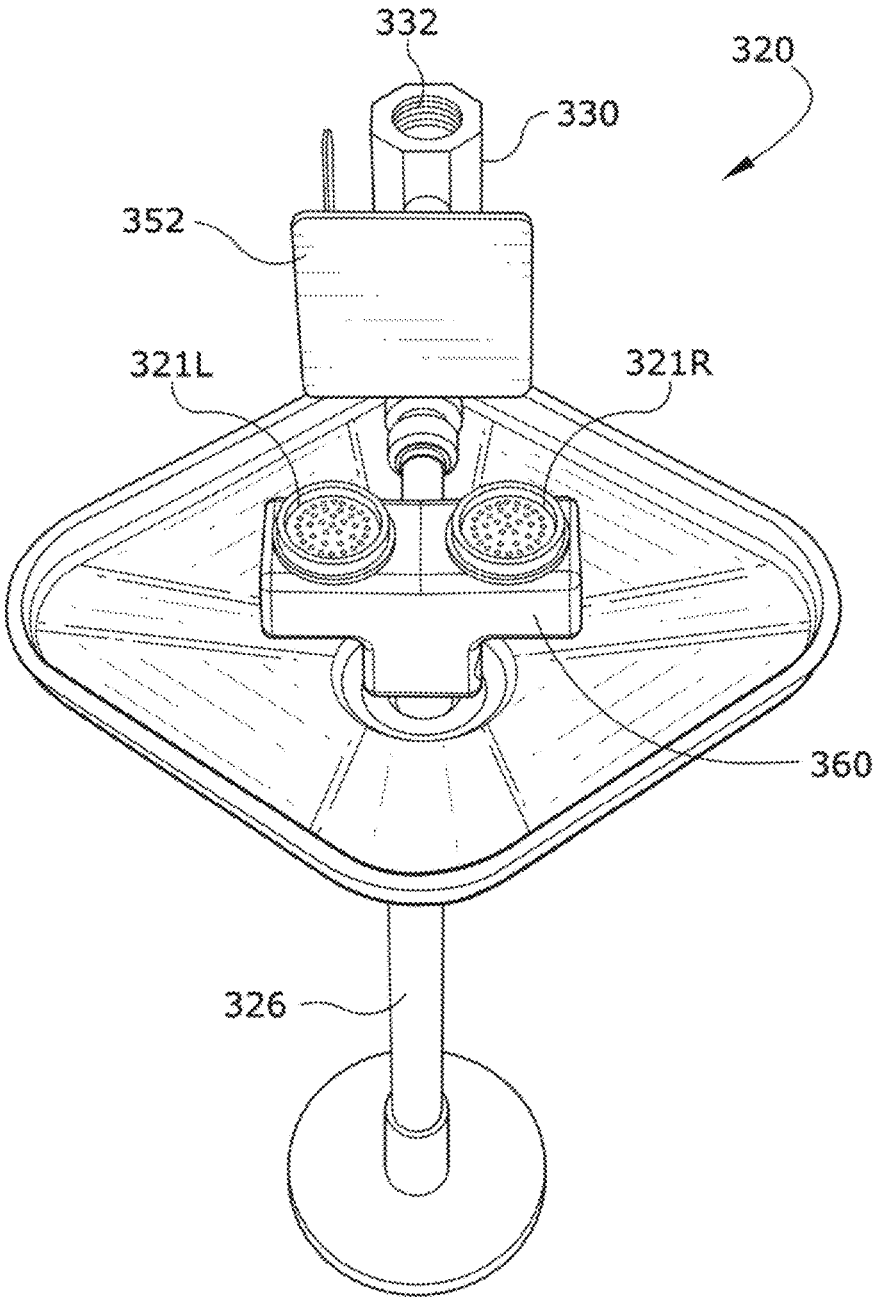
Figures 1B, 3:
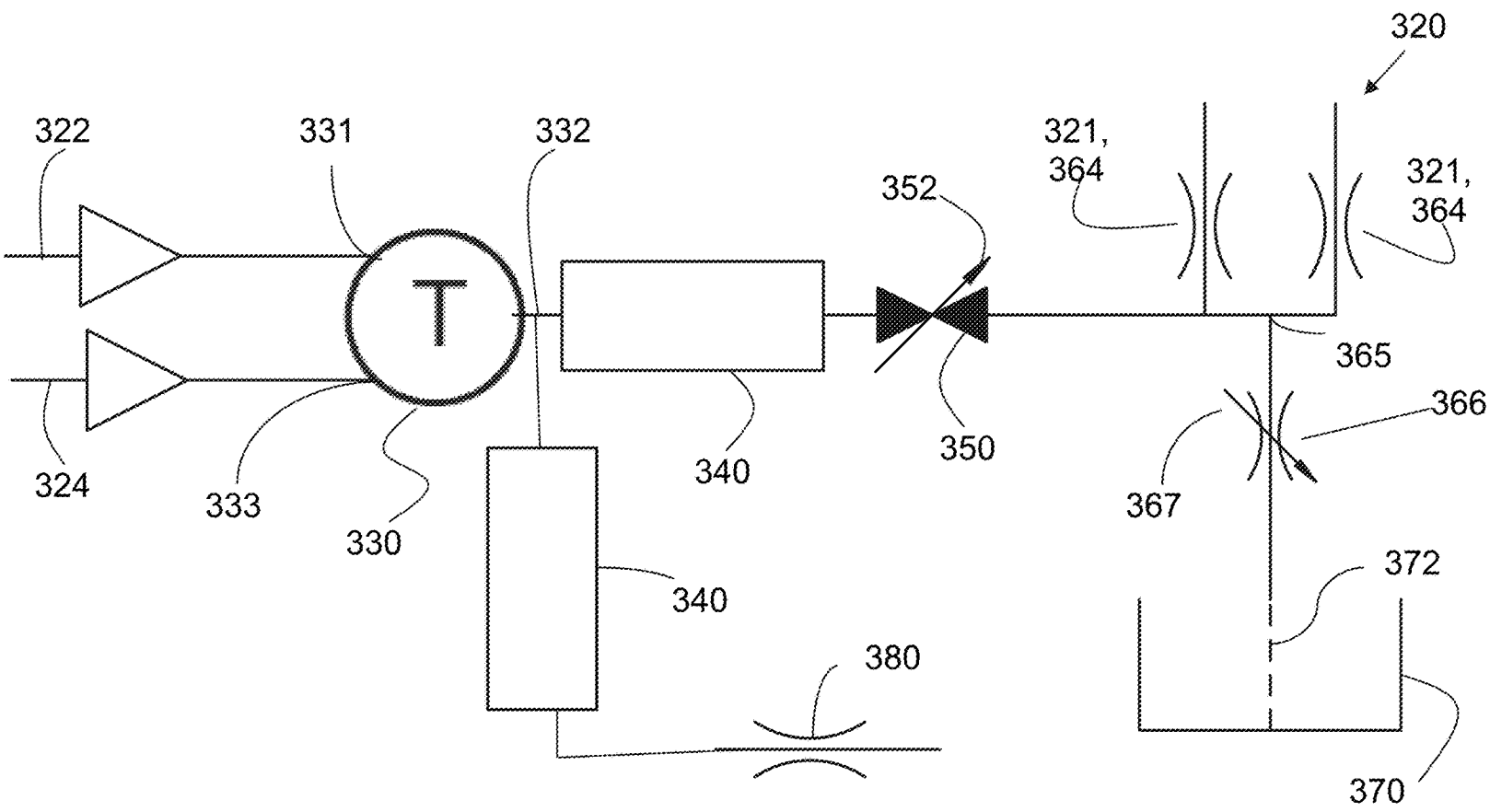
Figures 1C, 3:
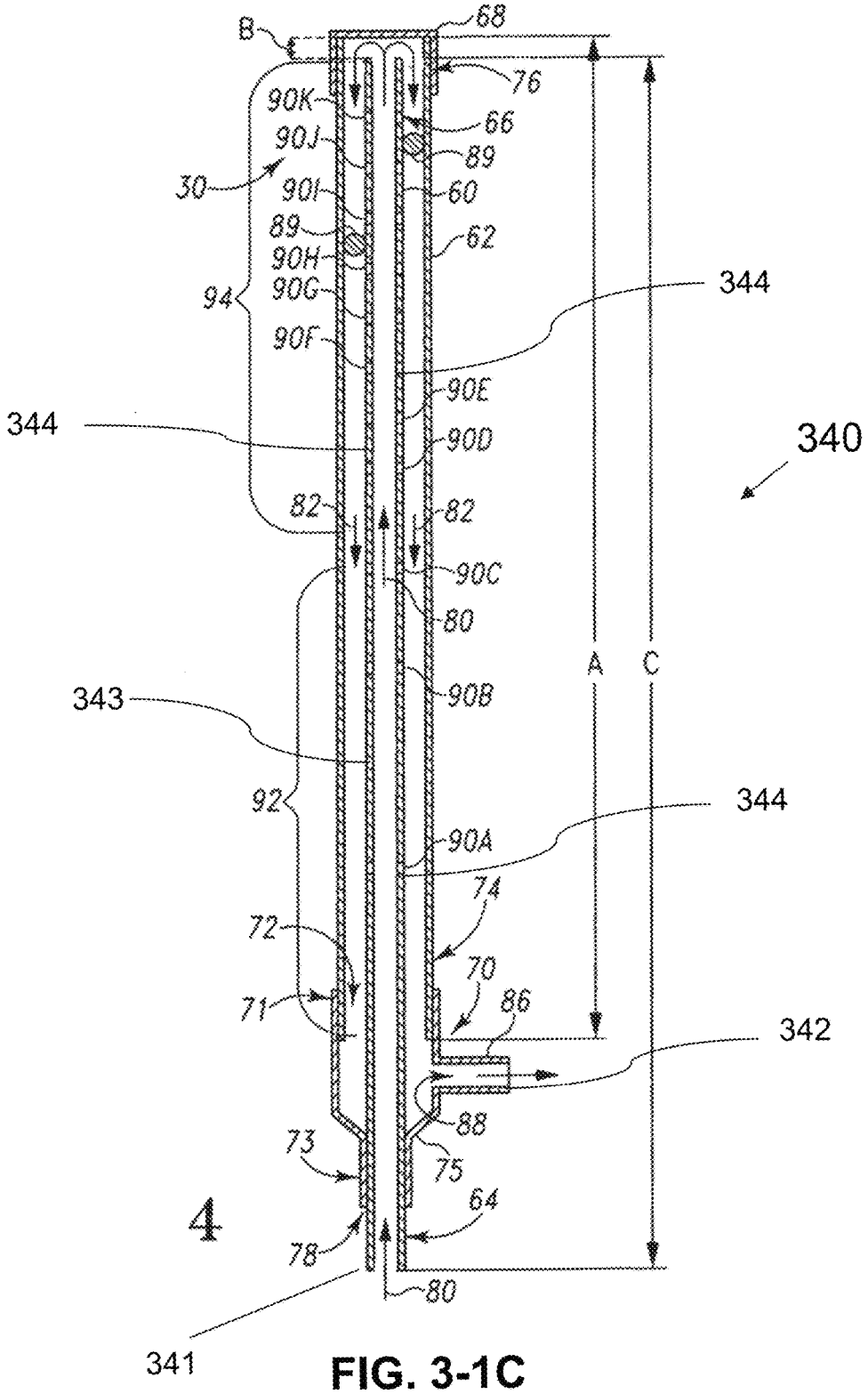
Figures 2, 3:
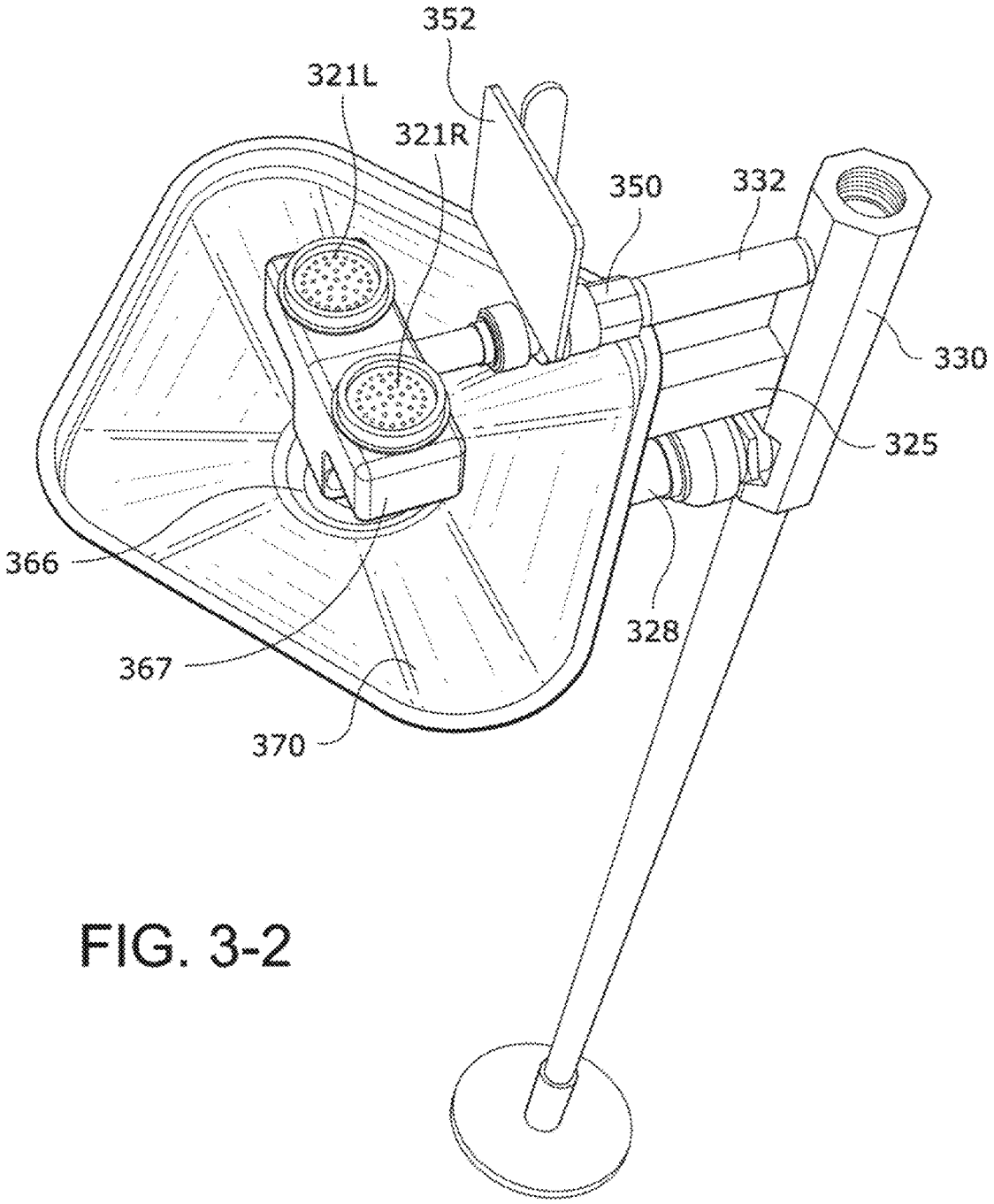
Figure 3:
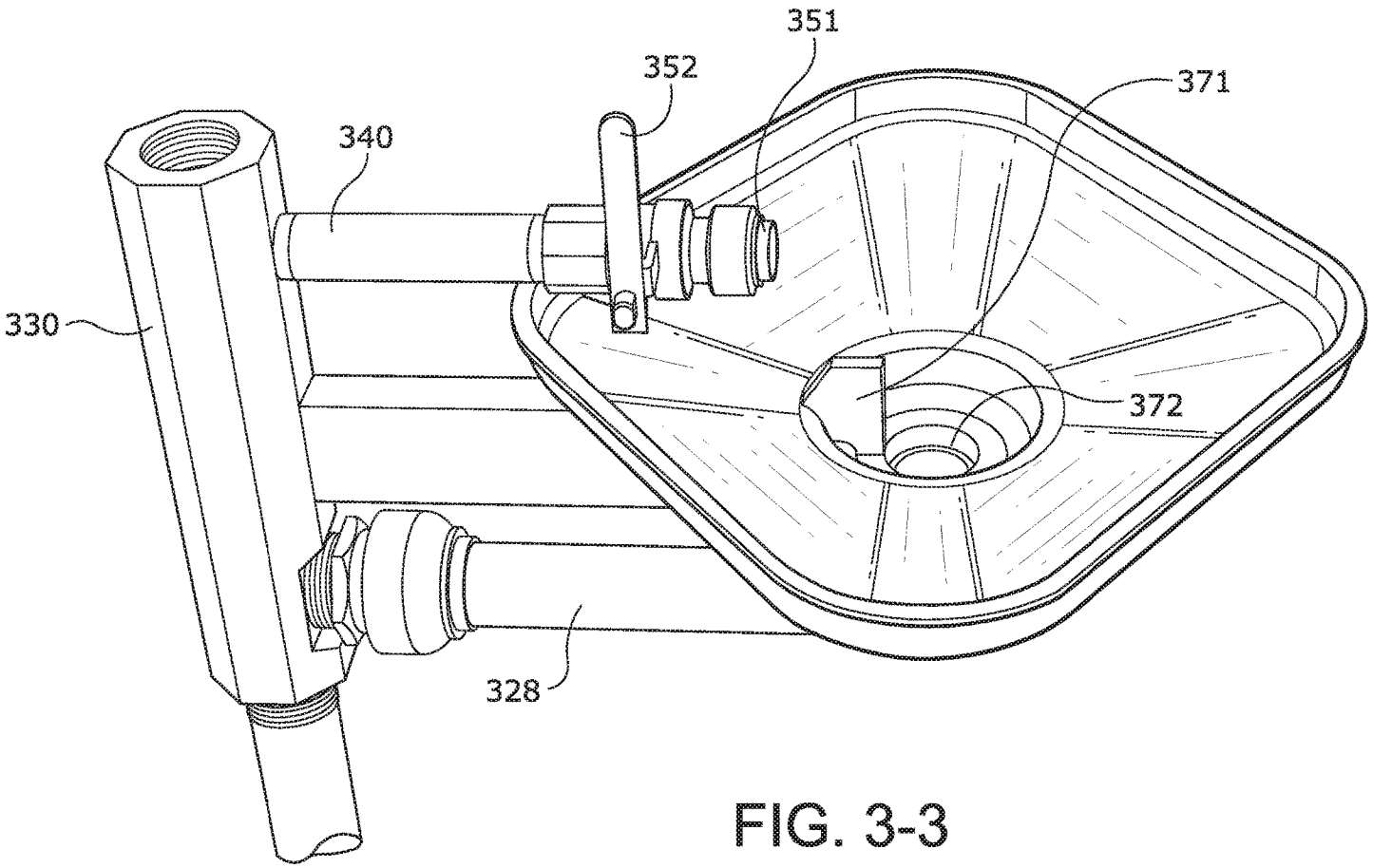
Figures 3, 4:
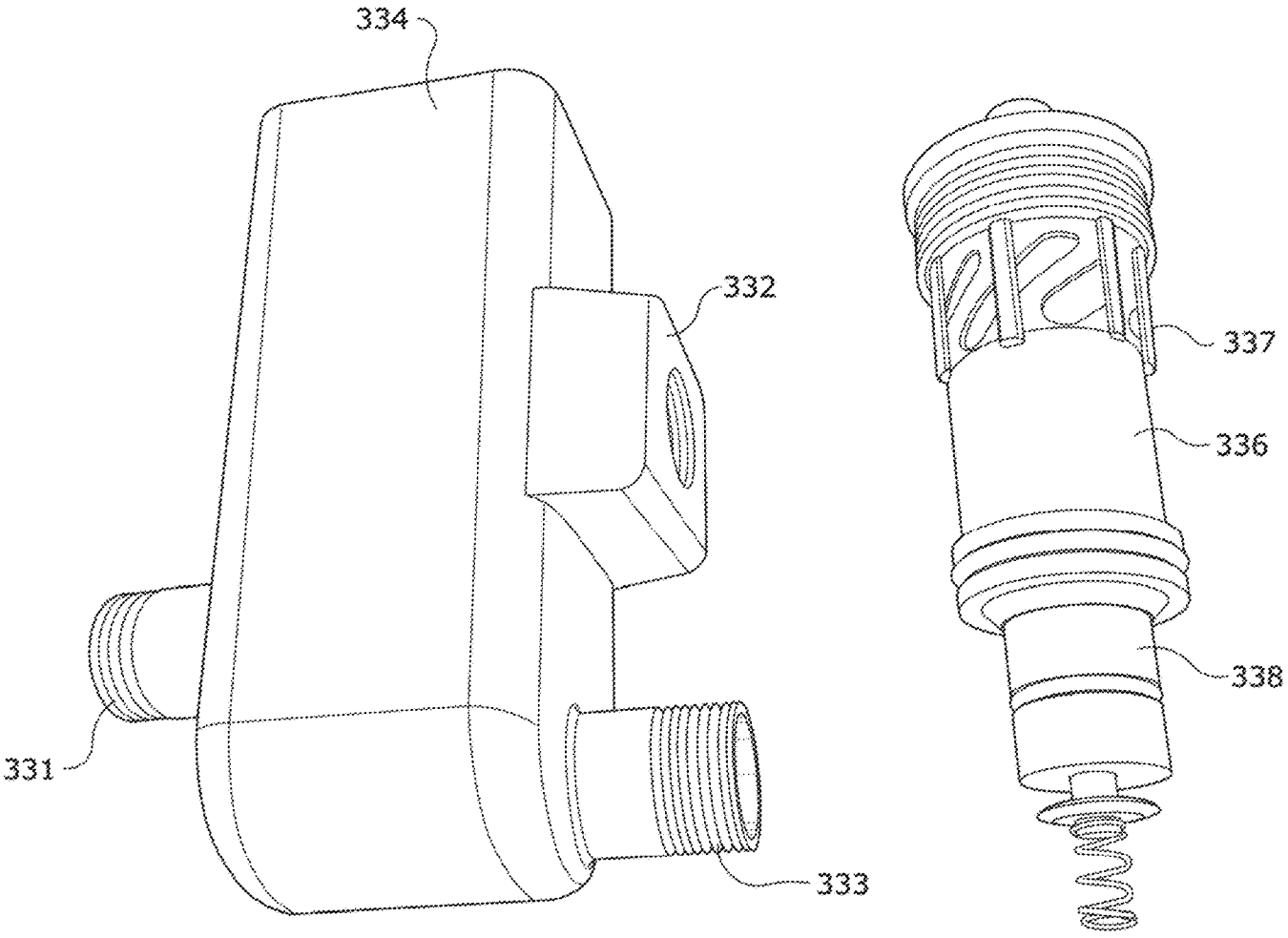
Figures 3, 4, 5:
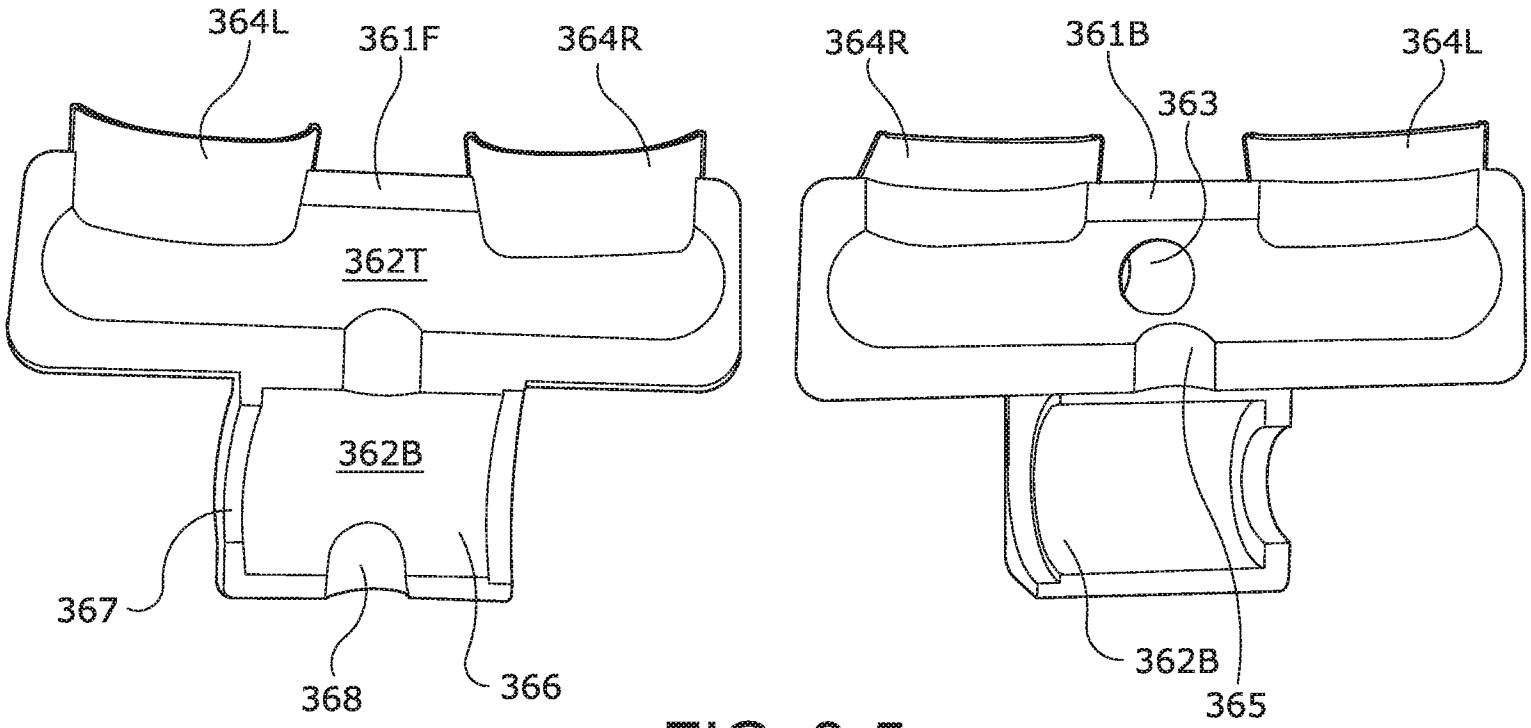
Figures 3, 4, 5, 6, 6A:
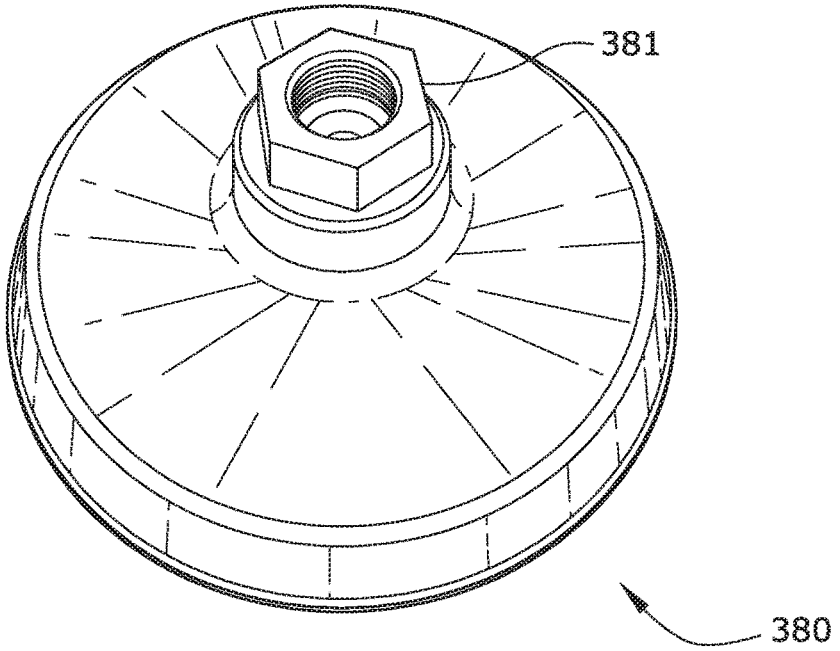
Figures 3, 4, 5, 6, 6B:
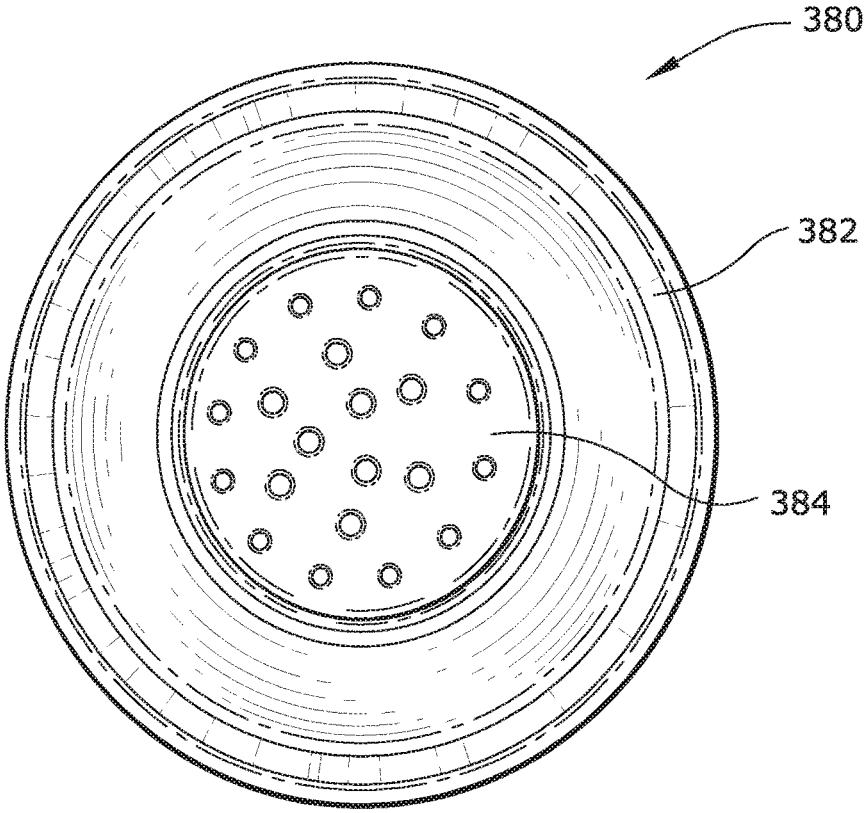
Figures 3, 4, 5, 6, 7:
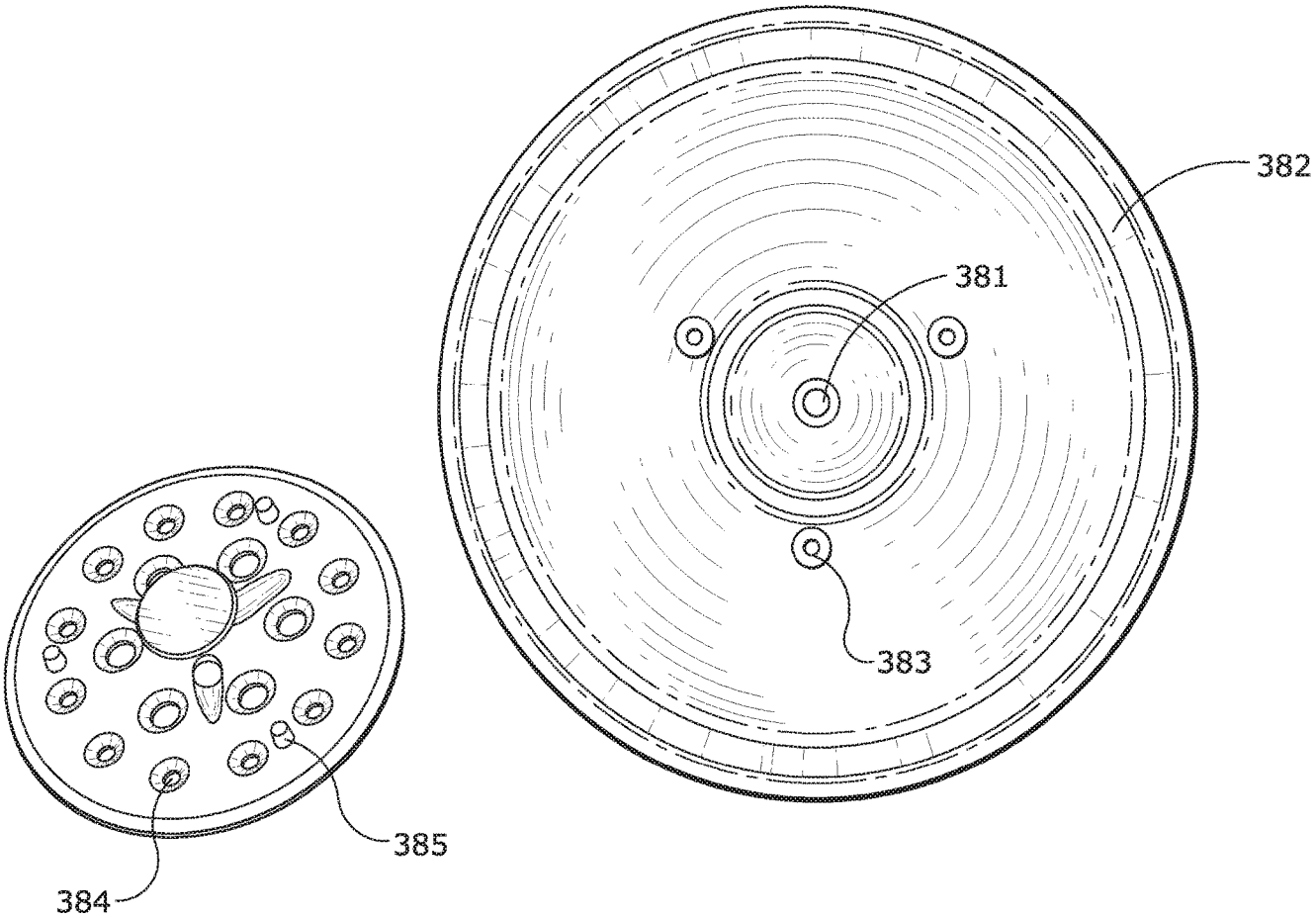
Figures 3, 4, 5, 6, 7, 8:
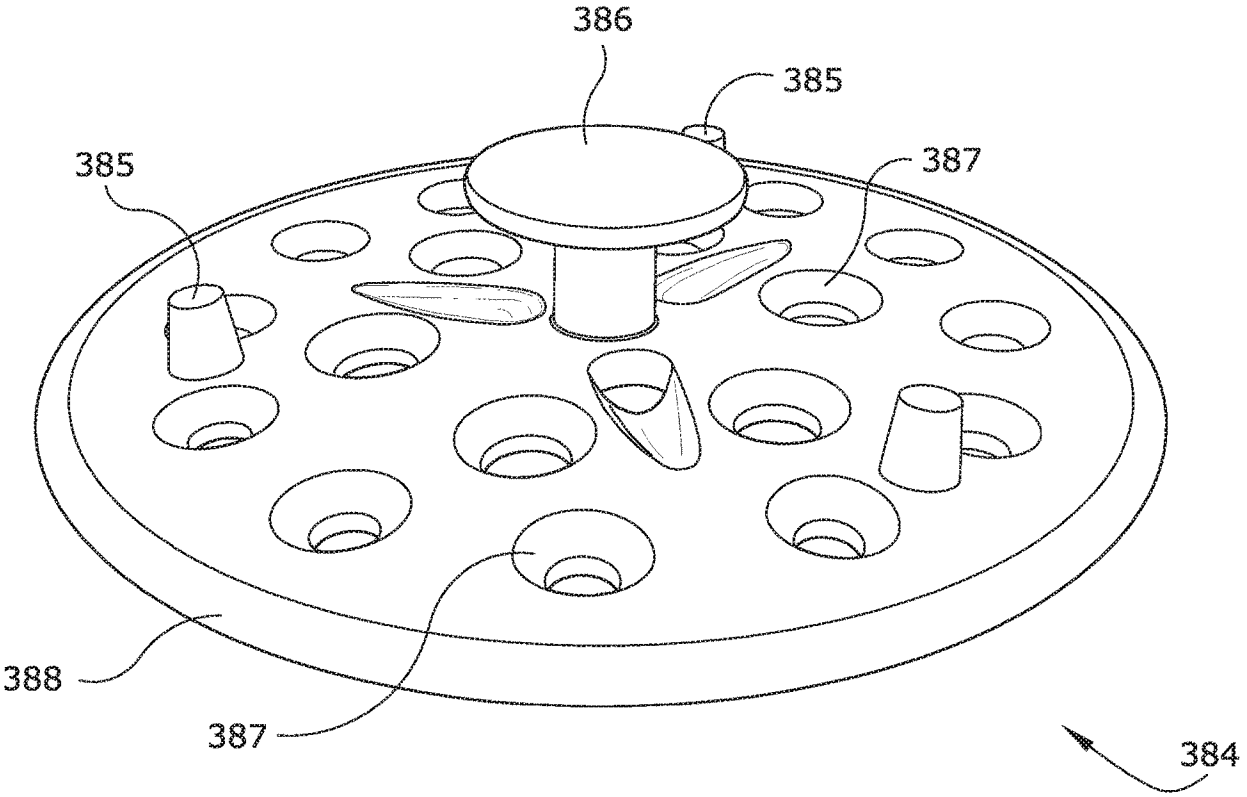
Figures 4, 5, 6, 7, 8, 9:
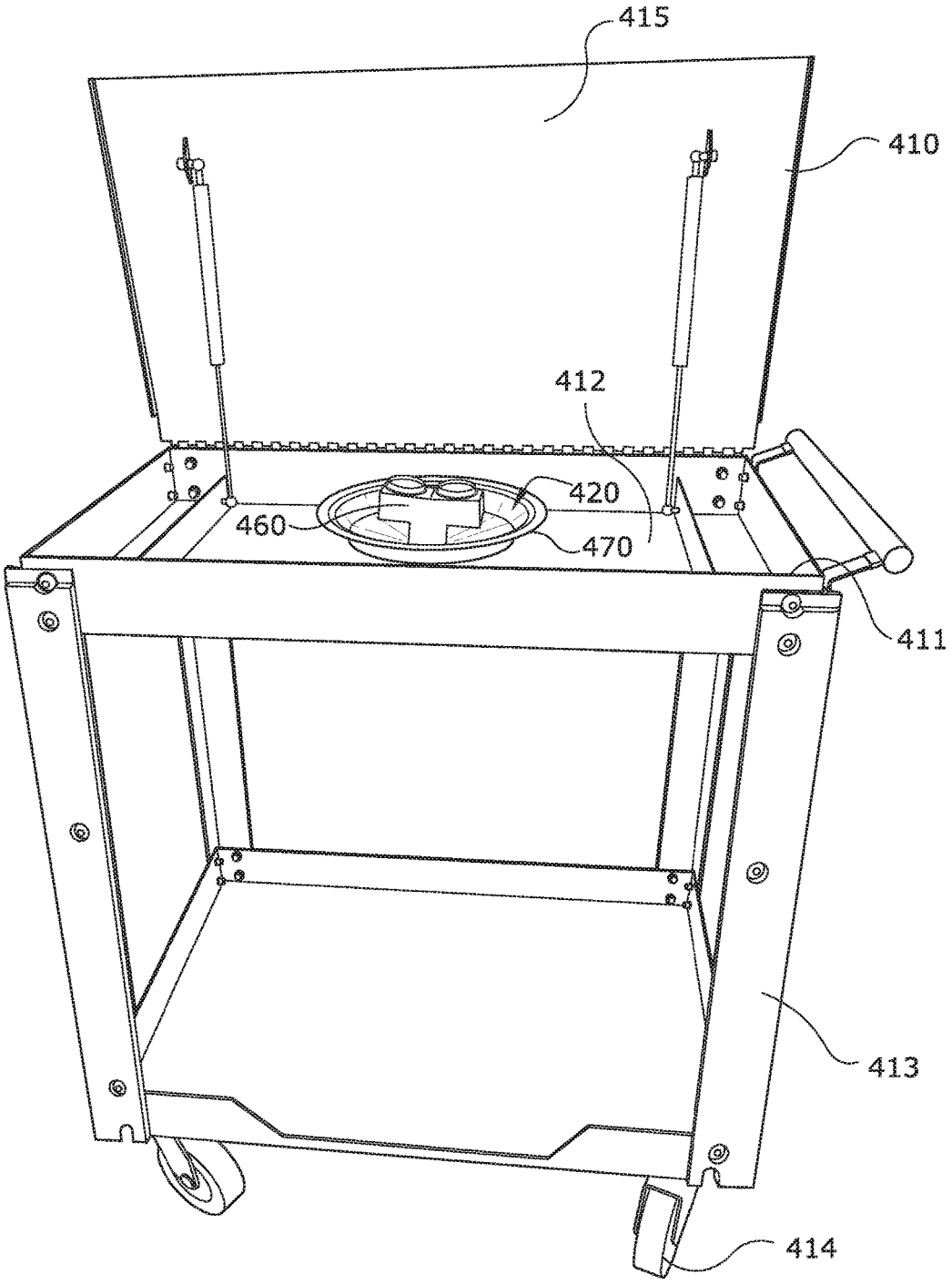
Figures 4, 5, 6, 7, 8, 9, 10:
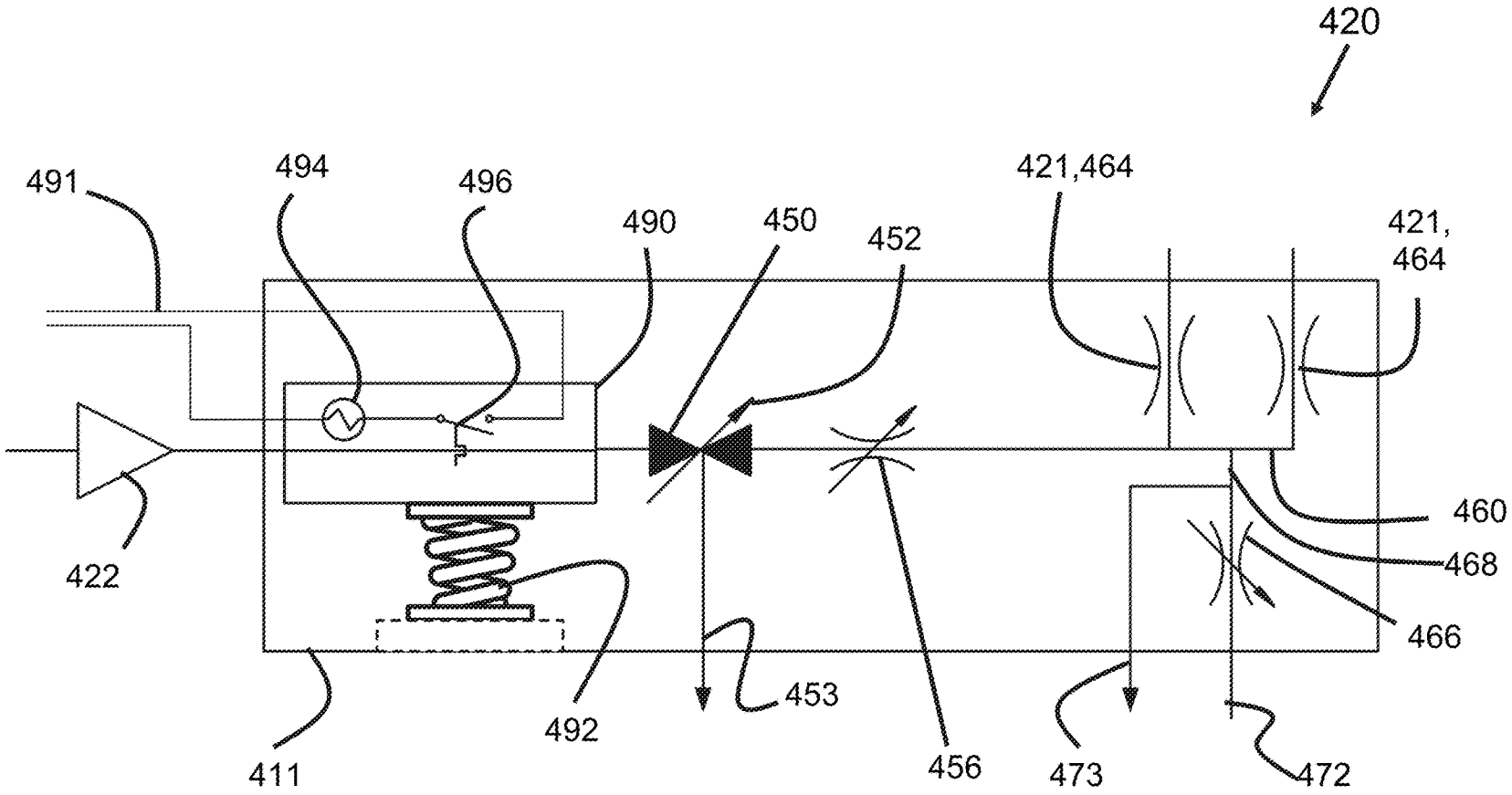
Figures 4, 5, 6, 7, 8, 9, 10, 11, 11B:
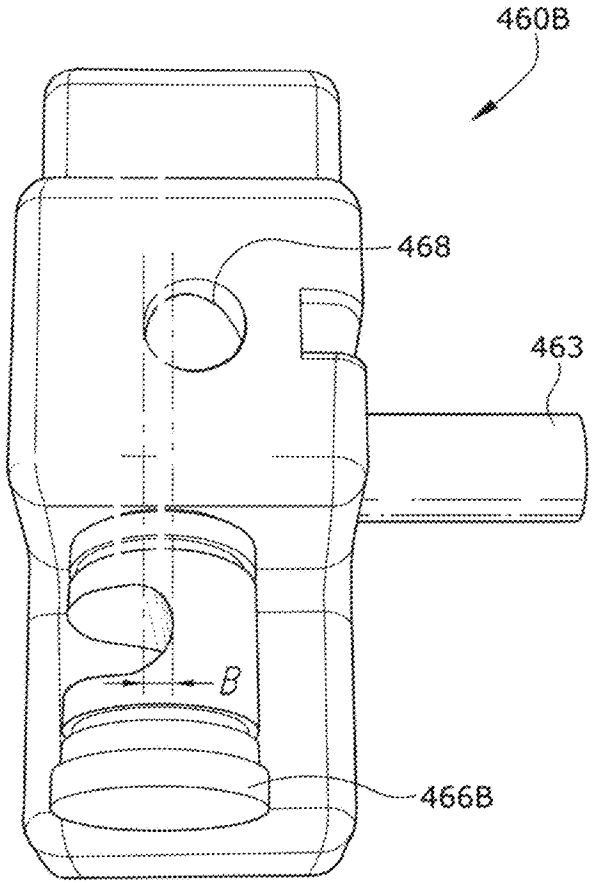
Figures 4, 5, 6, 7, 8, 9, 10, 11, 11A:
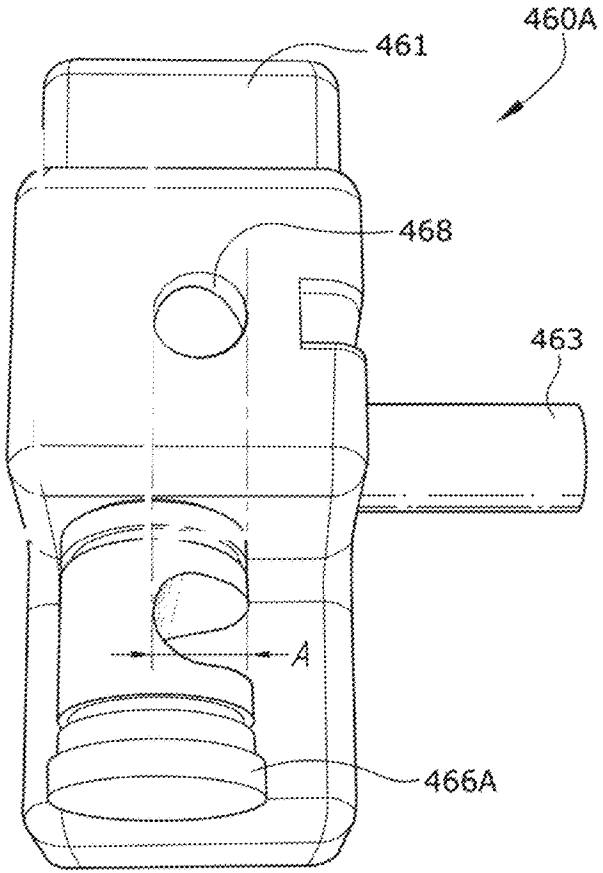
Figures 1, 5:
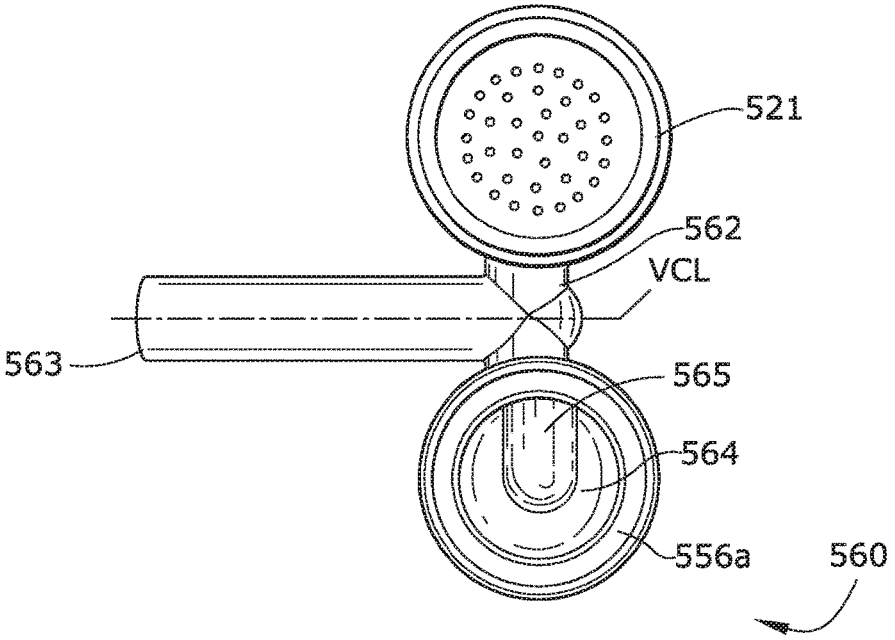
Figures 2, 5:
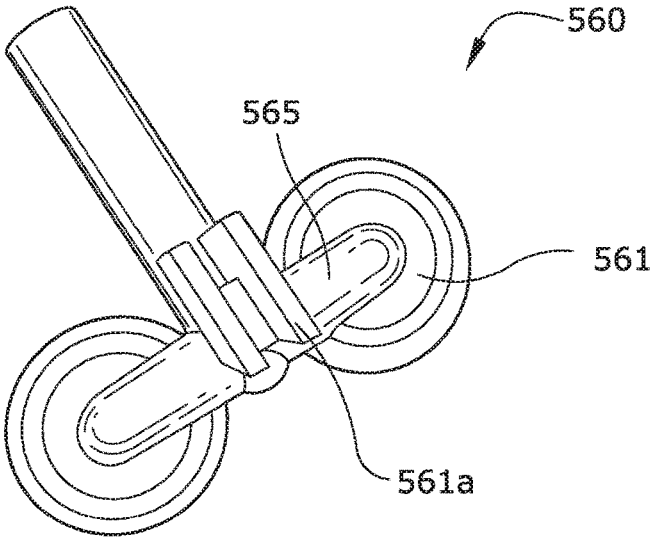
Figures 3, 5:
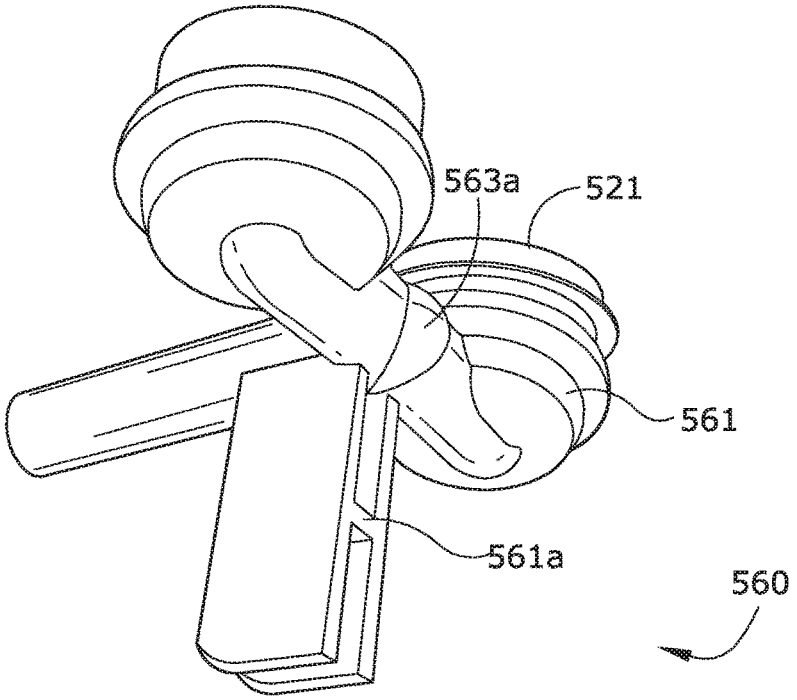
Figures 4, 5:
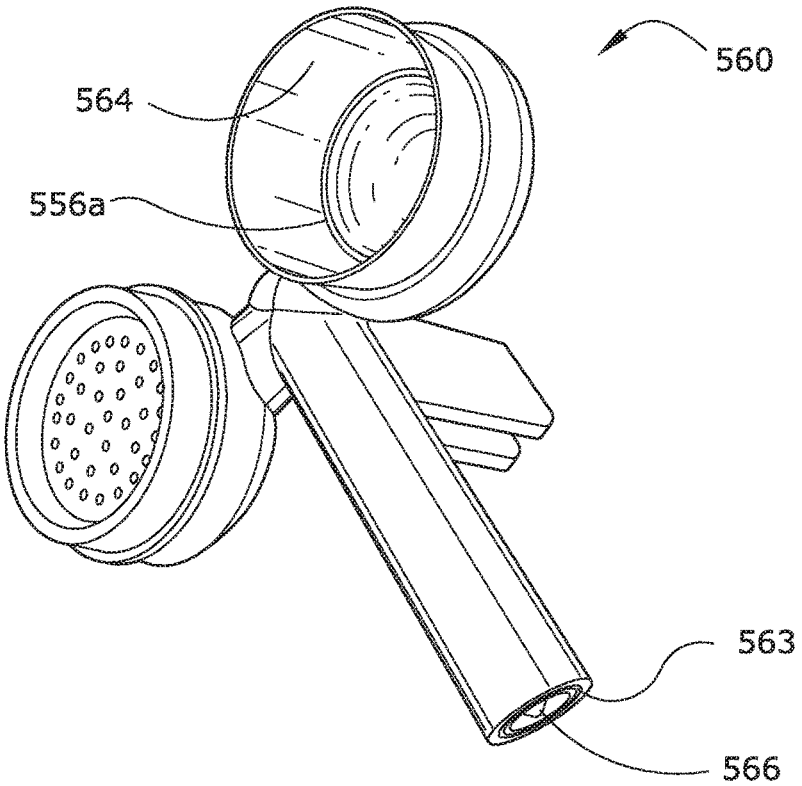
Figures 5, 6:
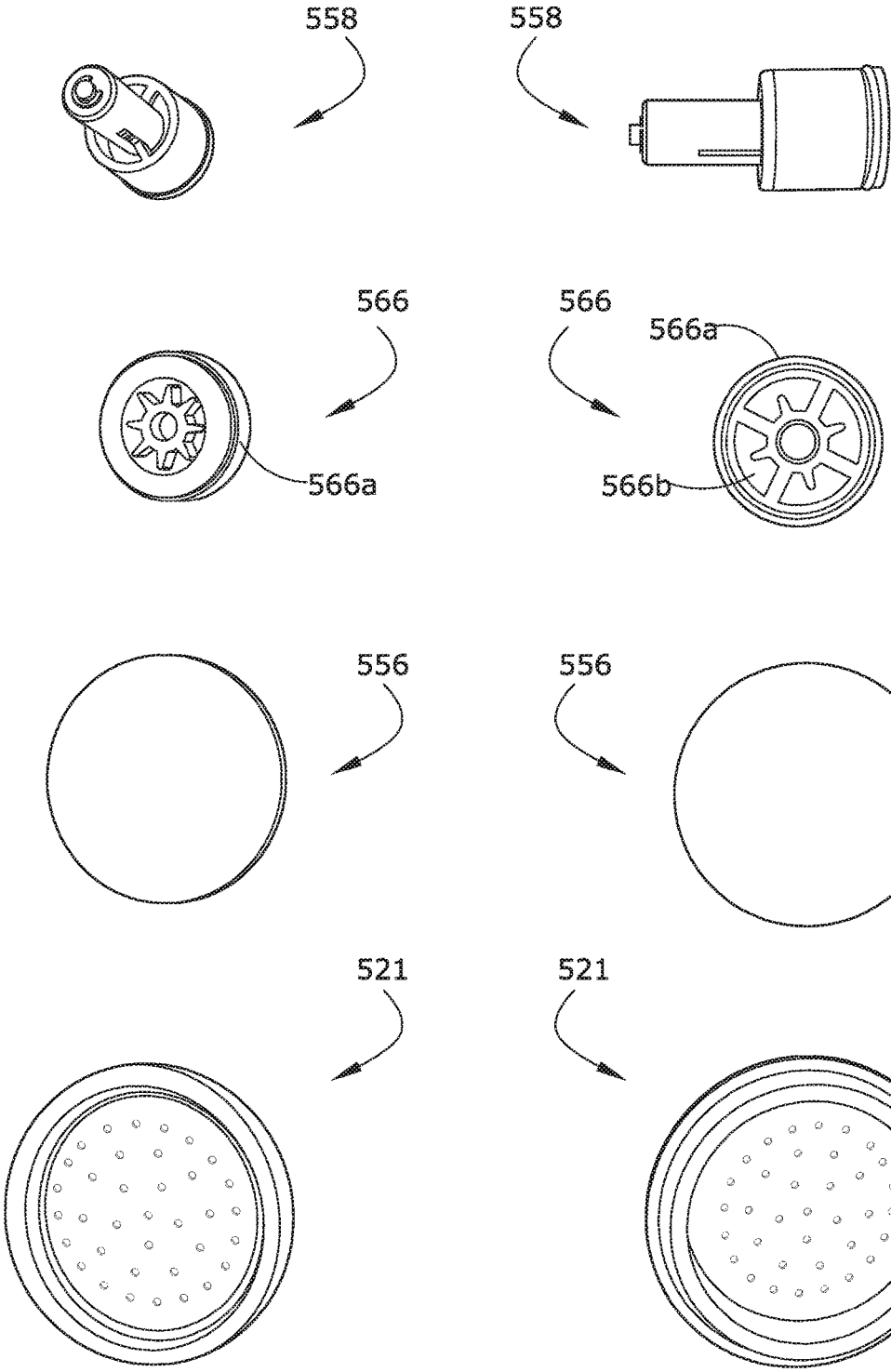
Figures 5, 6, 7:
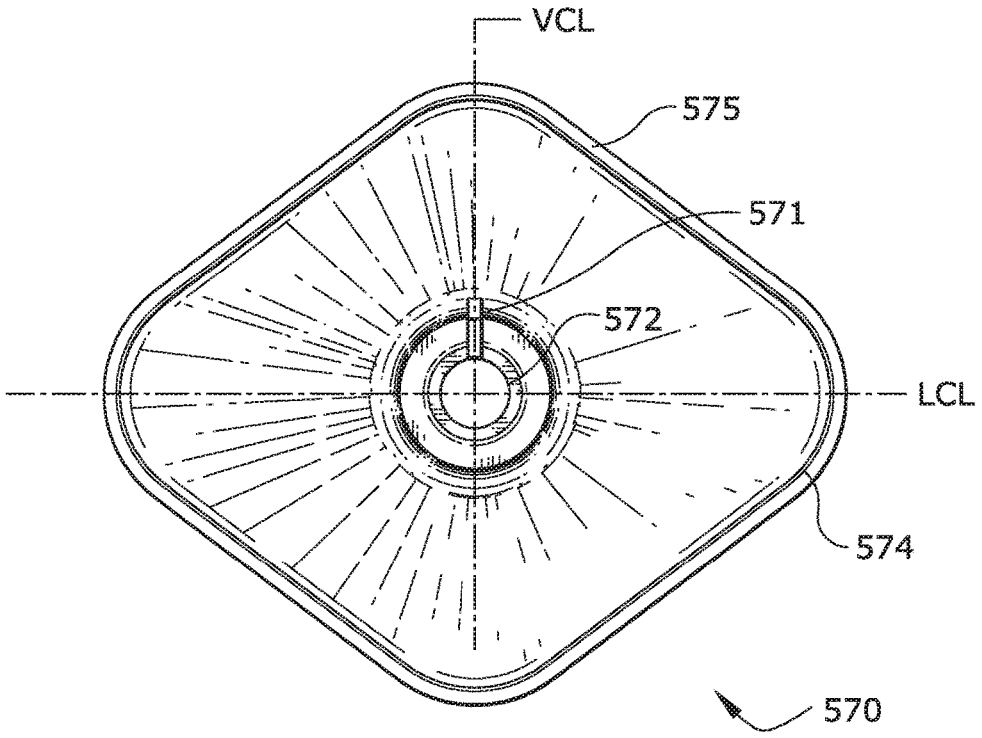
Figures 5, 6, 7, 8:
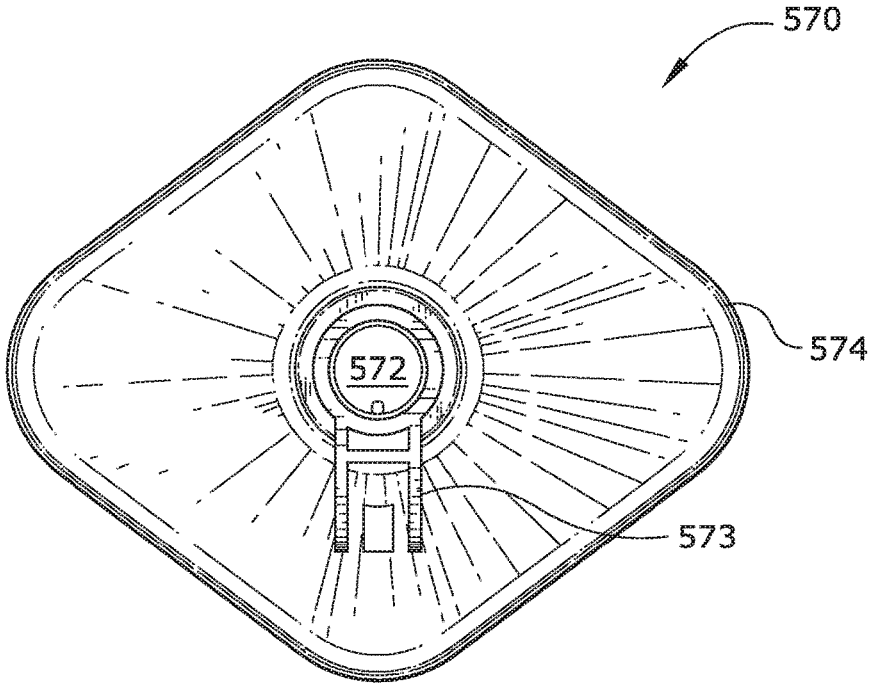
Figures 5, 6, 7, 8, 9:
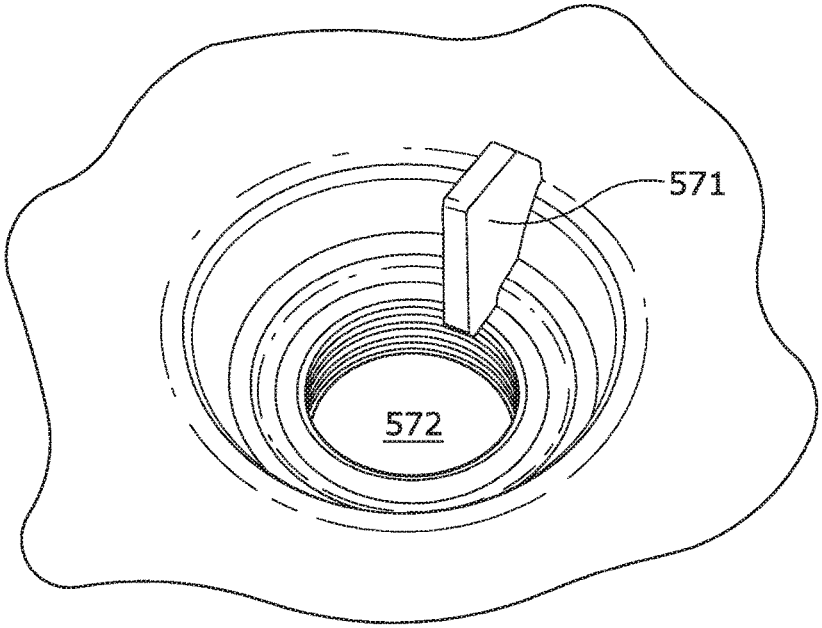
Figures 5, 6, 7, 8, 9, 10:
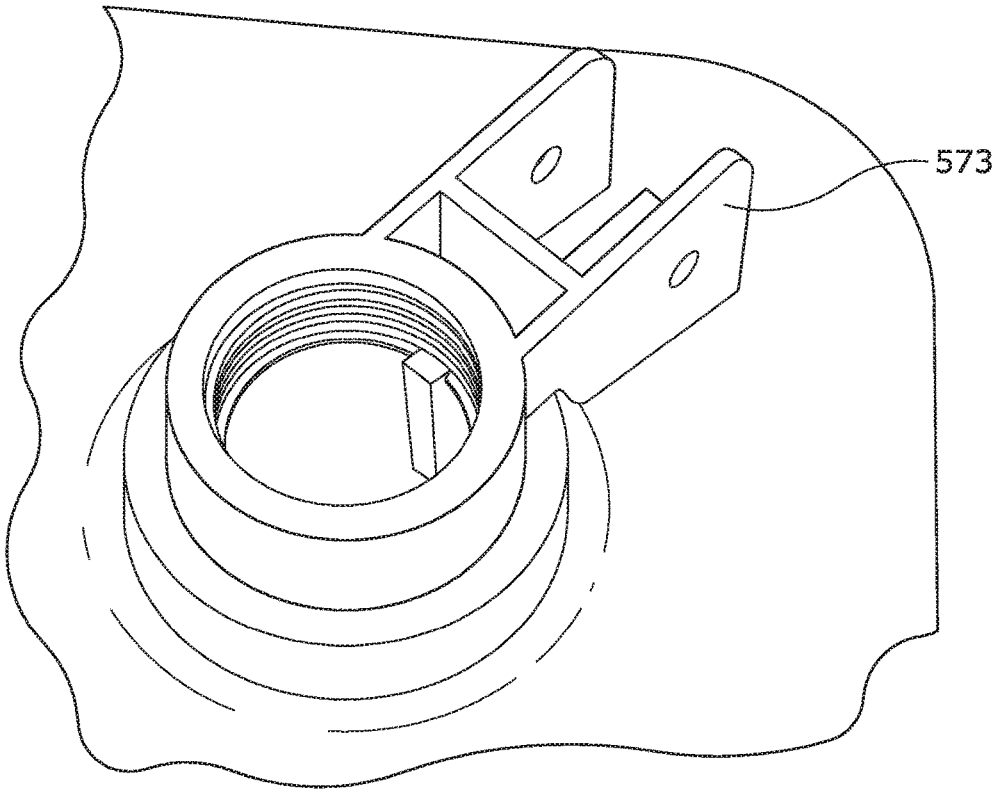
Figures 5, 6, 7, 8, 9, 10, 11:
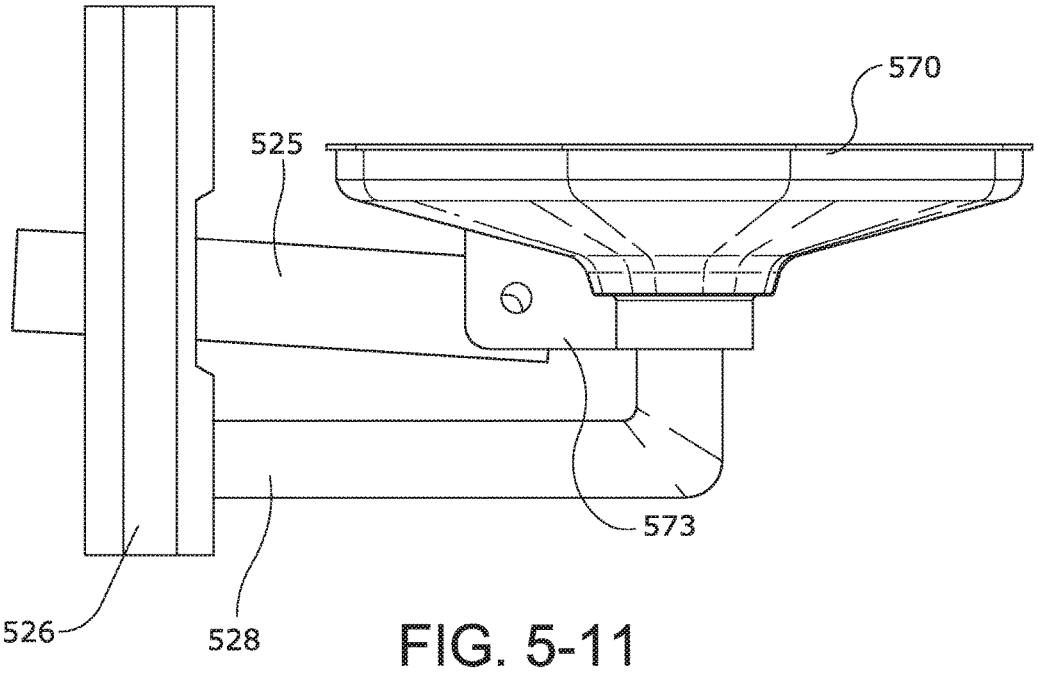
Figures 5, 6, 7, 8, 9, 10, 11, 12:
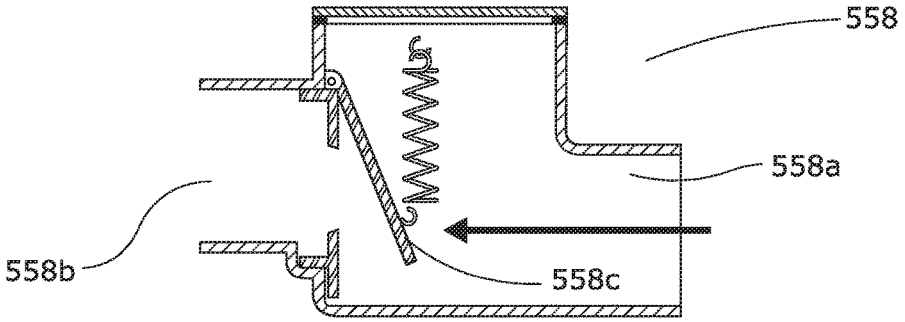
Figures 5, 6, 7, 8, 9, 10, 11, 12, 13:
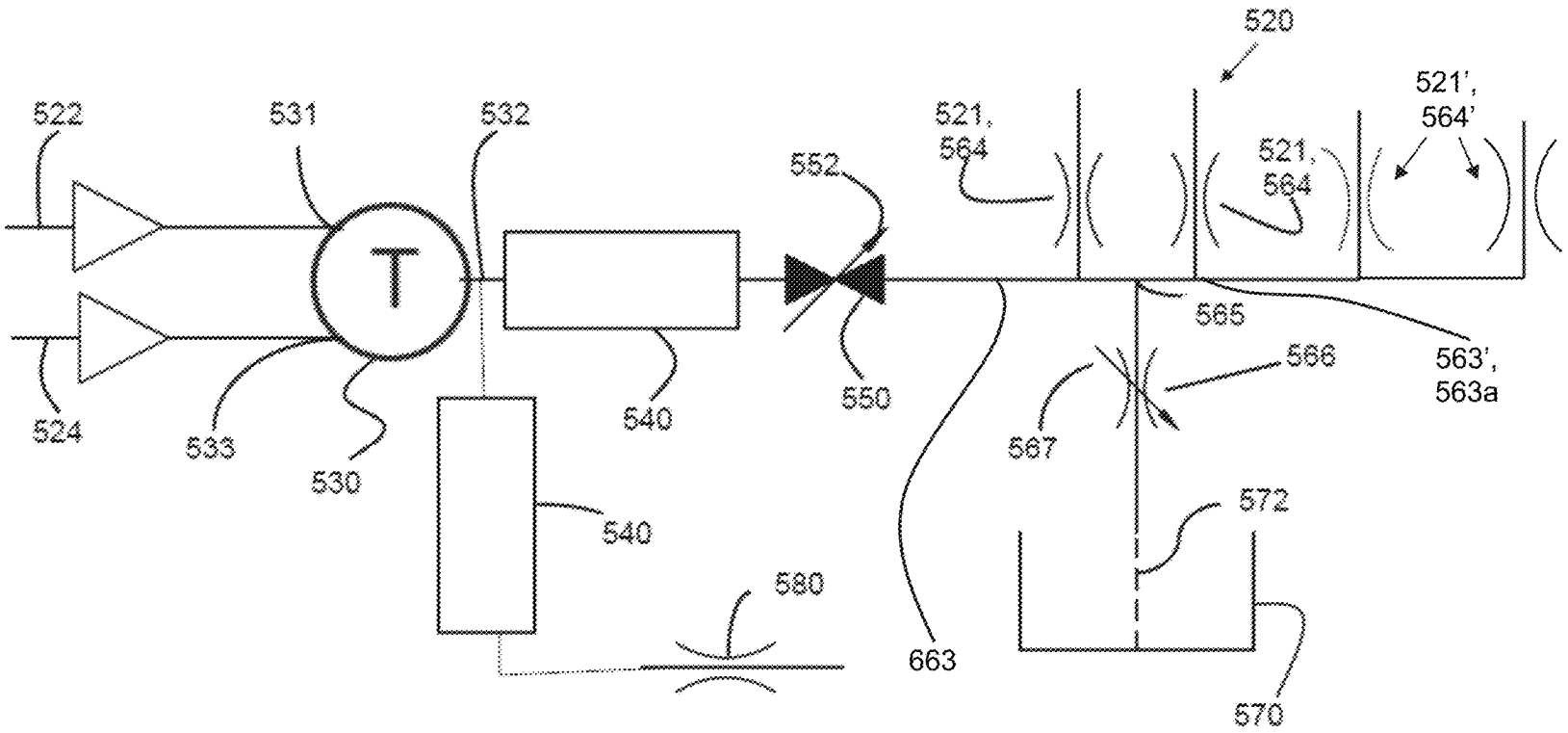
Figures 5, 6, 7, 8, 9, 10, 11, 12, 13, 14:
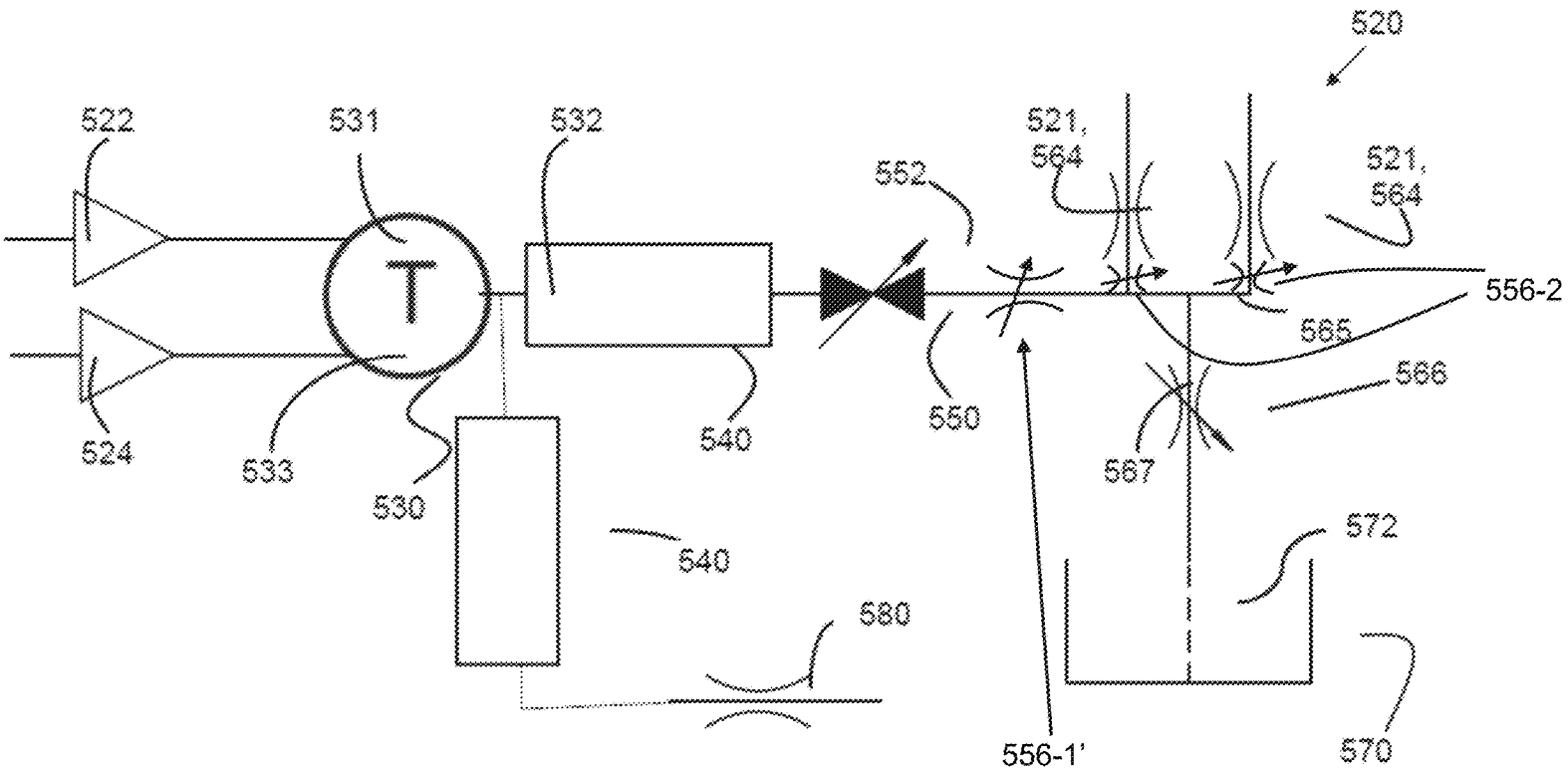
Figures 1, 6:
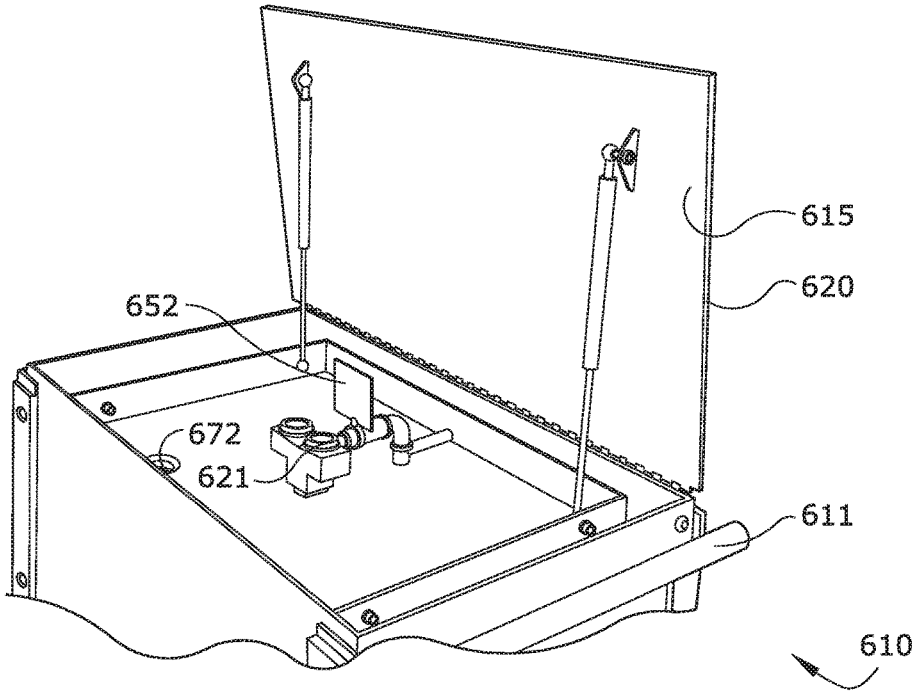
Figures 2, 6:
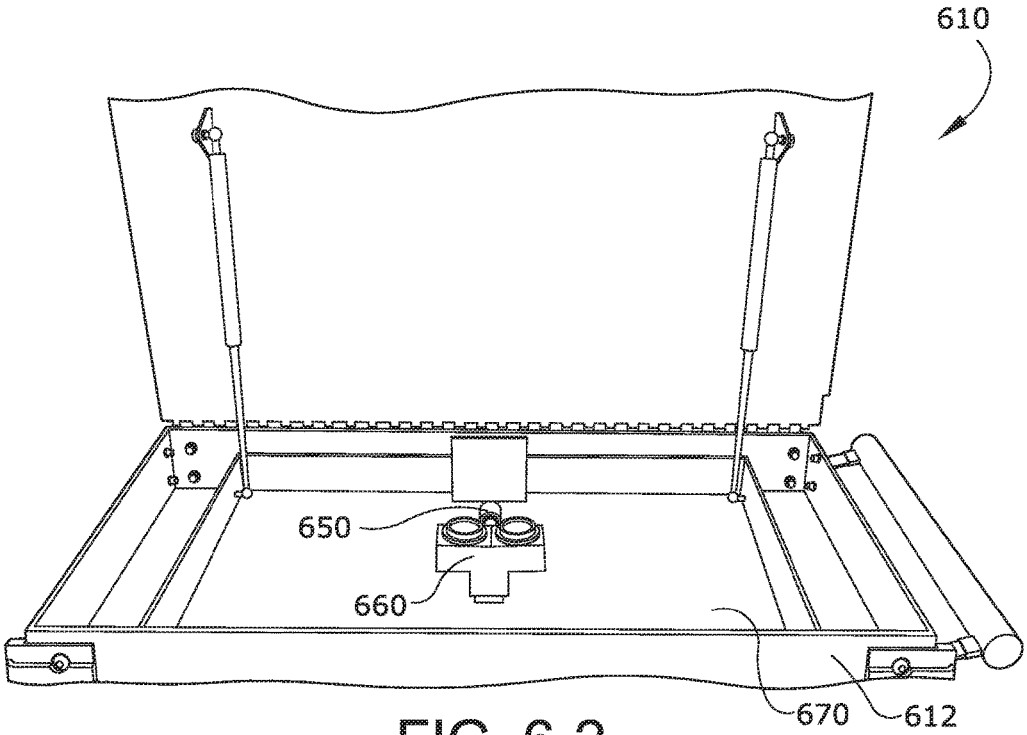
Figures 3, 6:
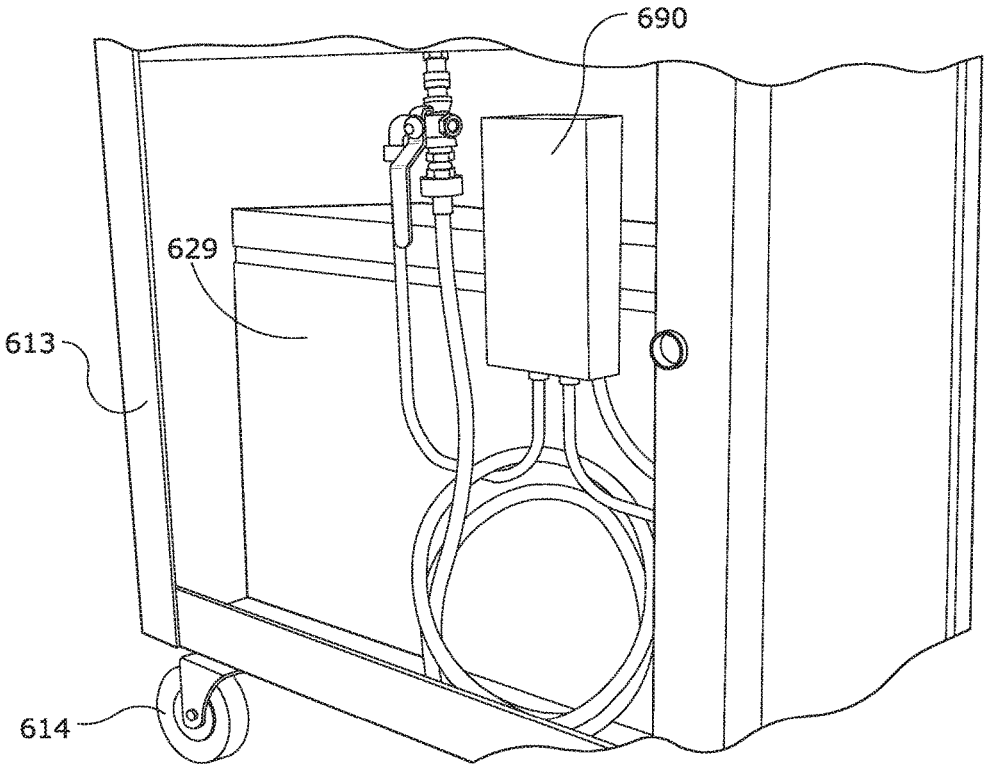
Figures 4, 6:
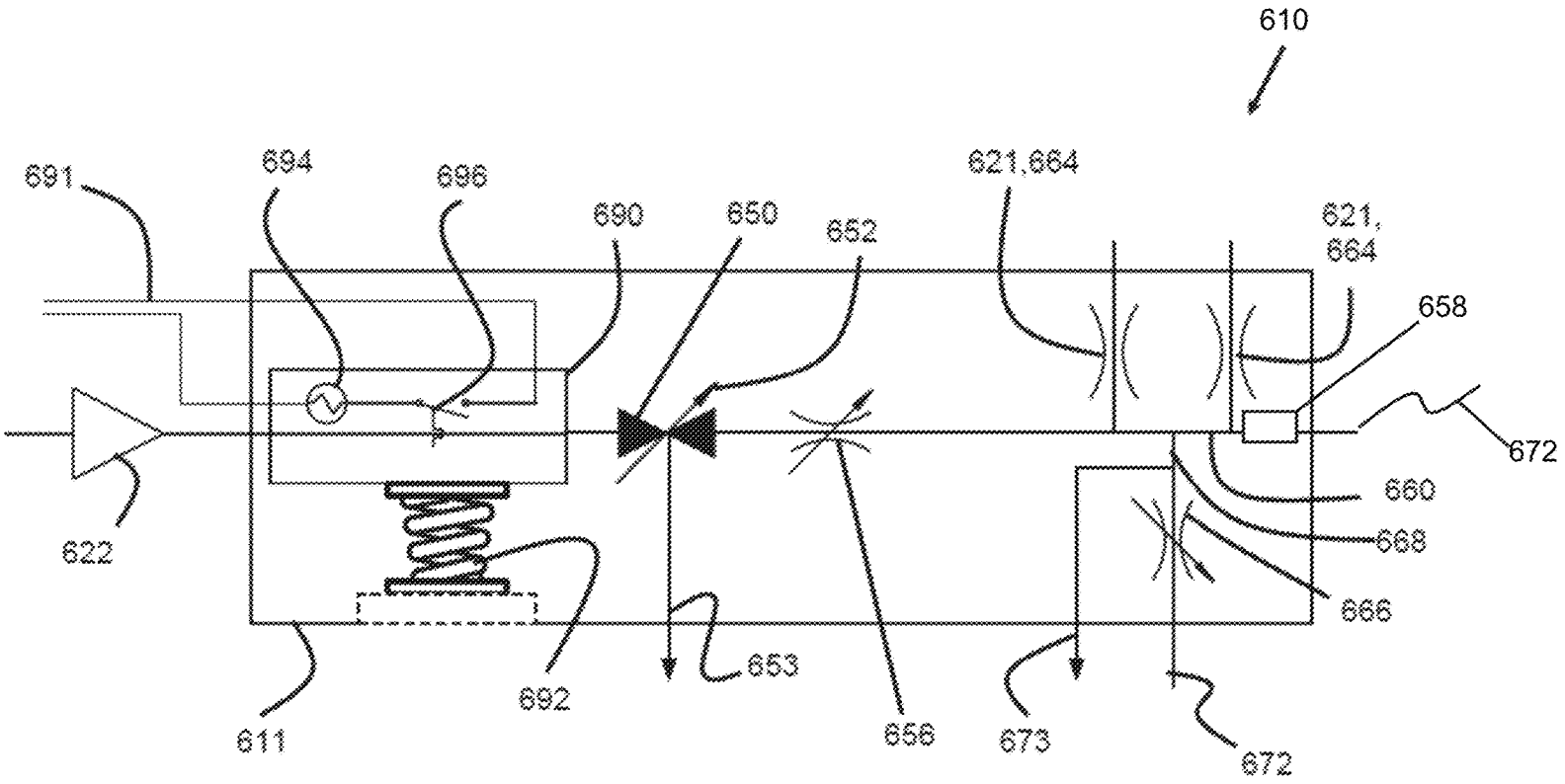
Figures 5, 6:
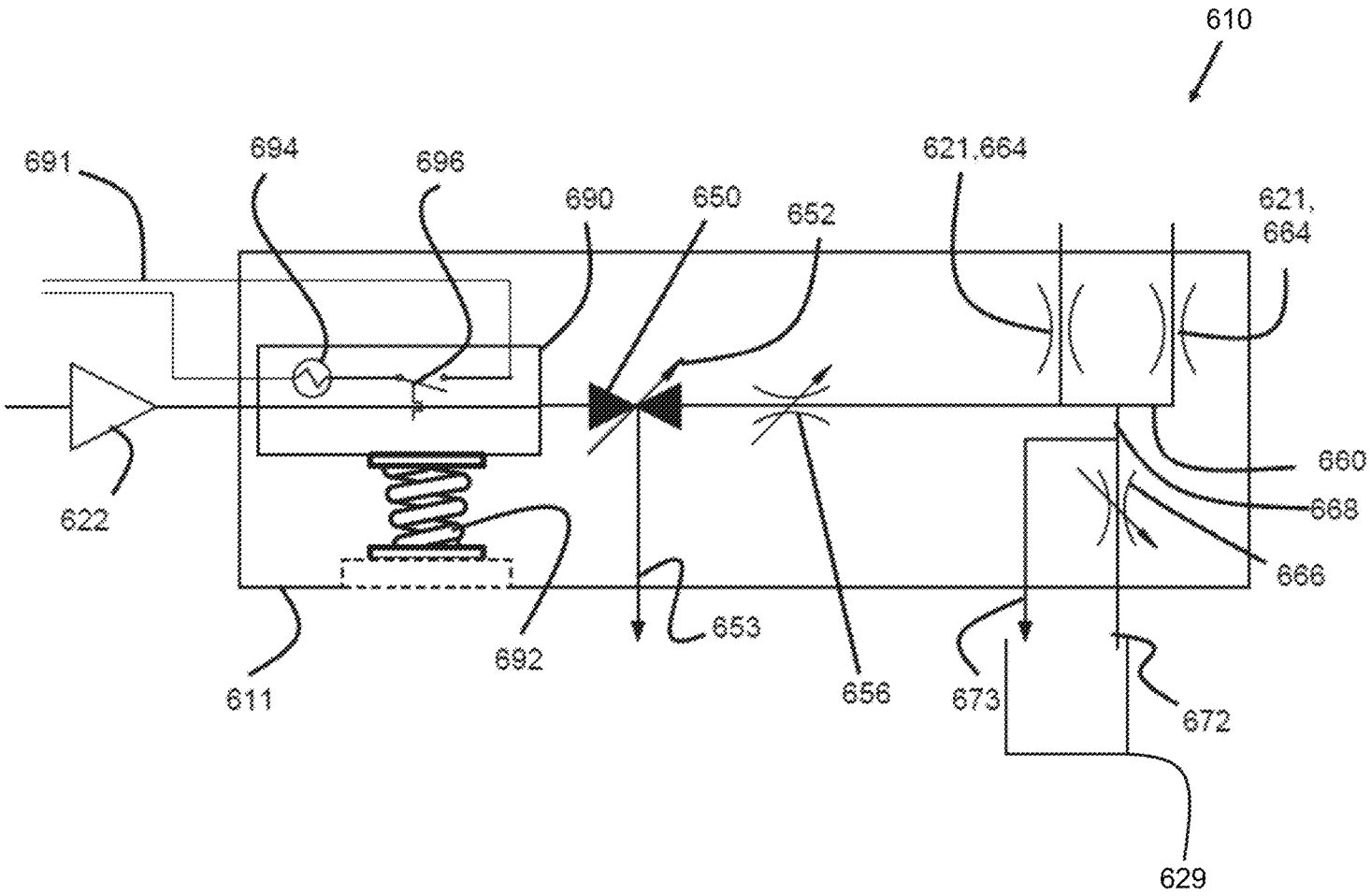
Figures 1, 7:
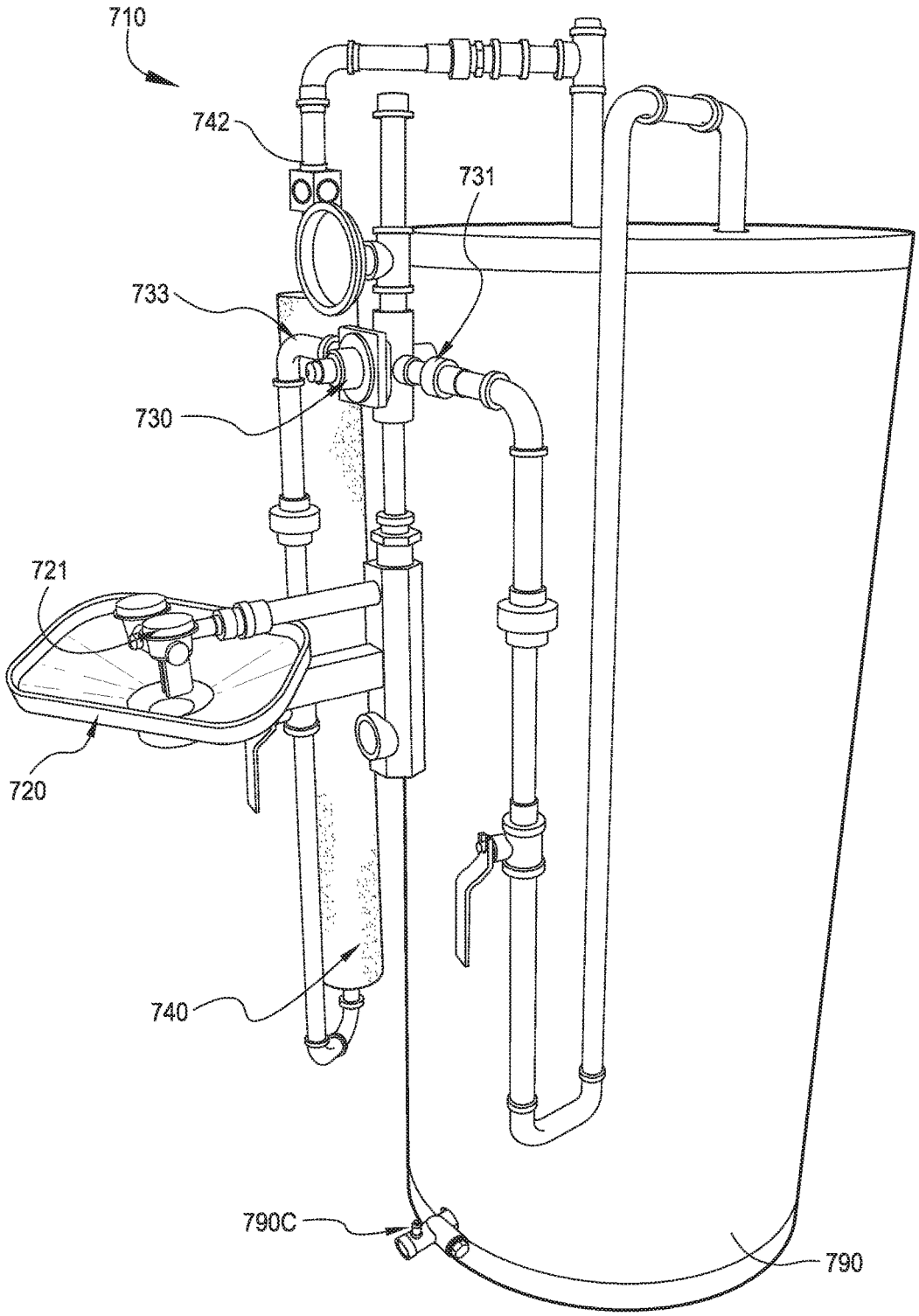
Figures 2, 7:
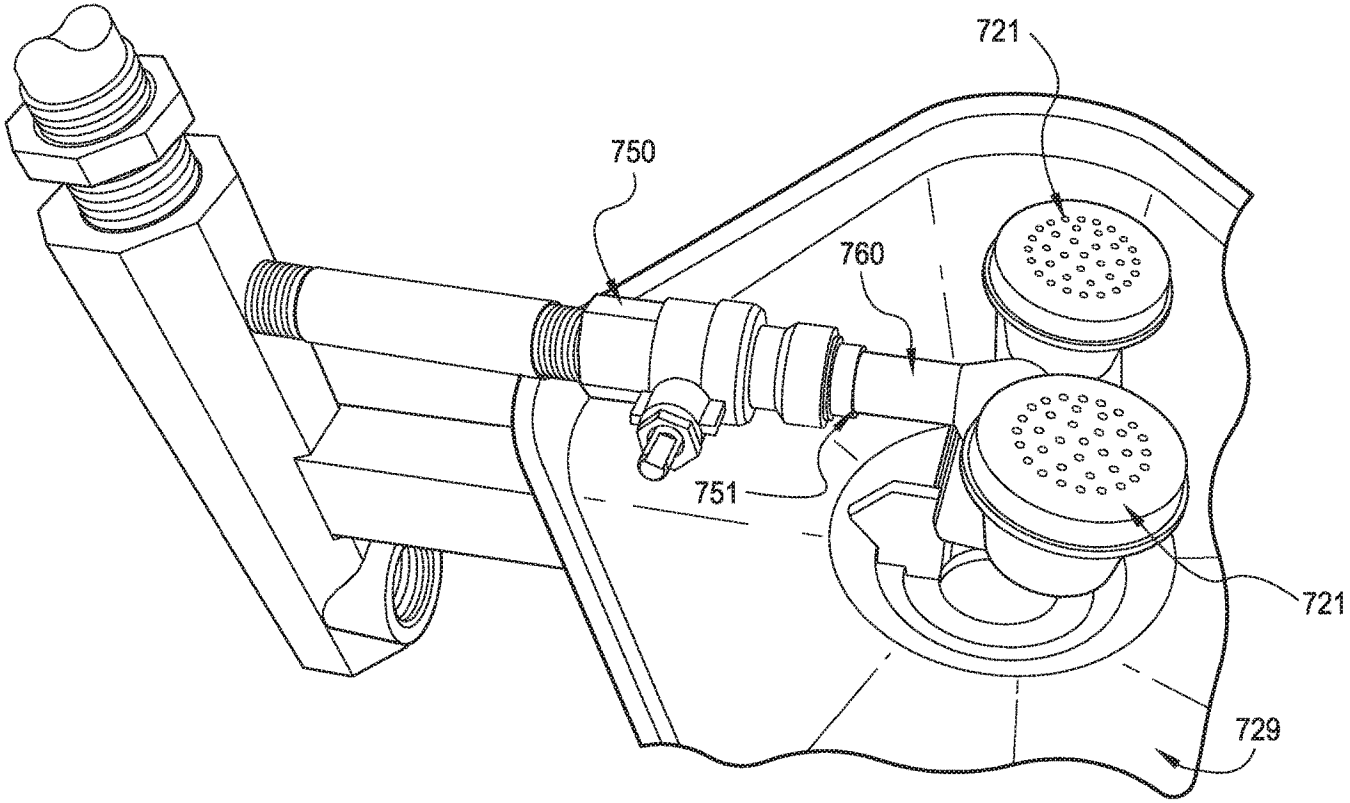
Figures 3, 7:
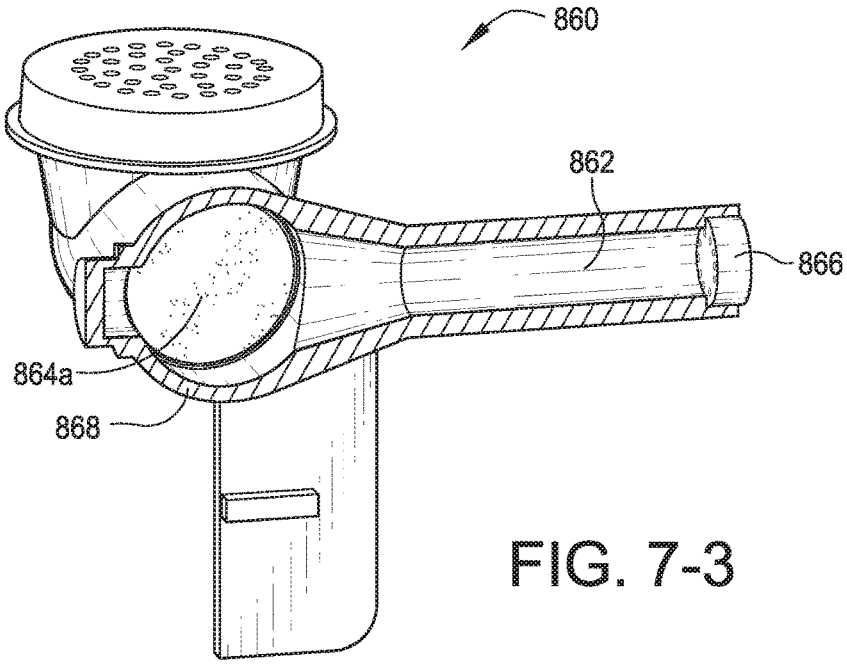
Figures 4, 7:
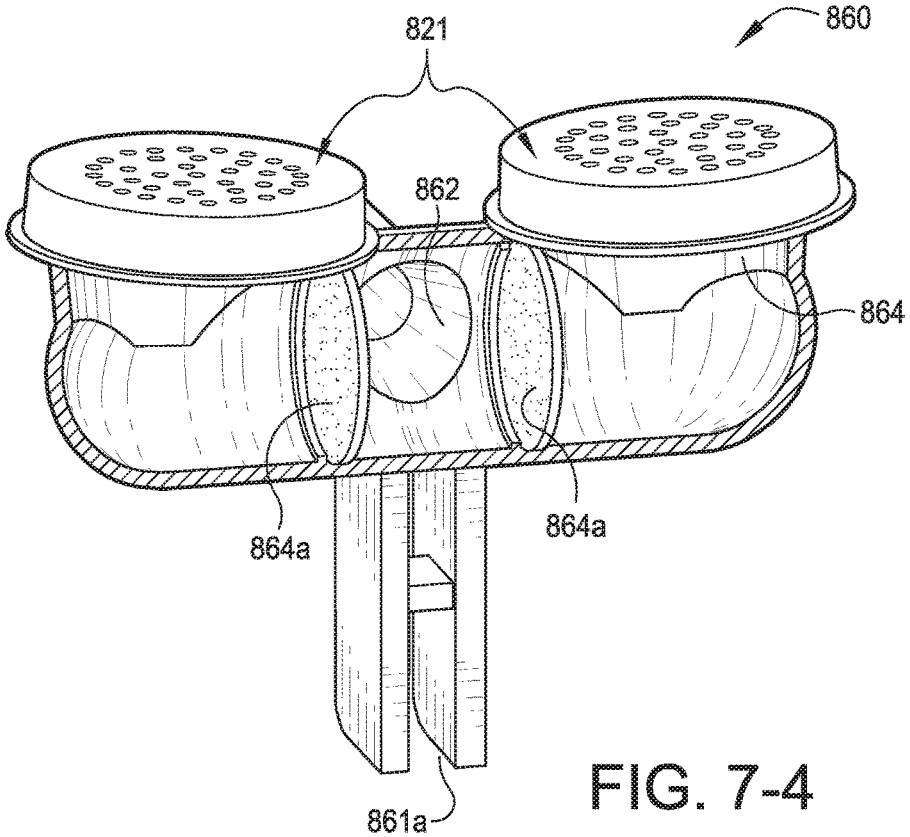
Figures 5, 7:
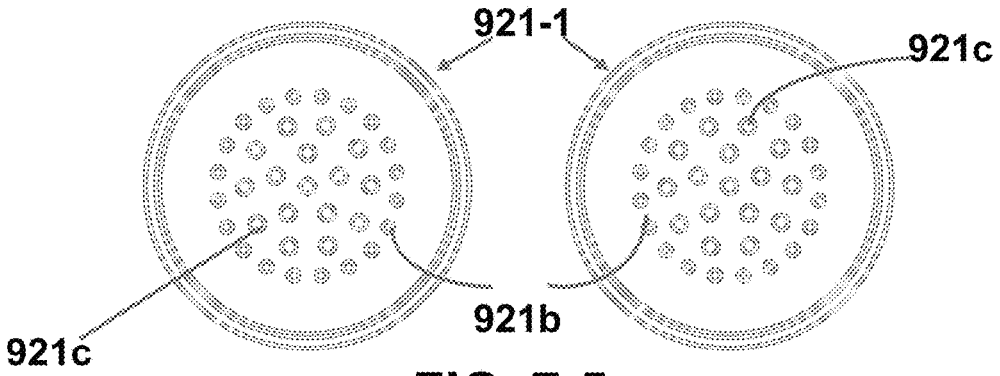
Figures 6, 7:
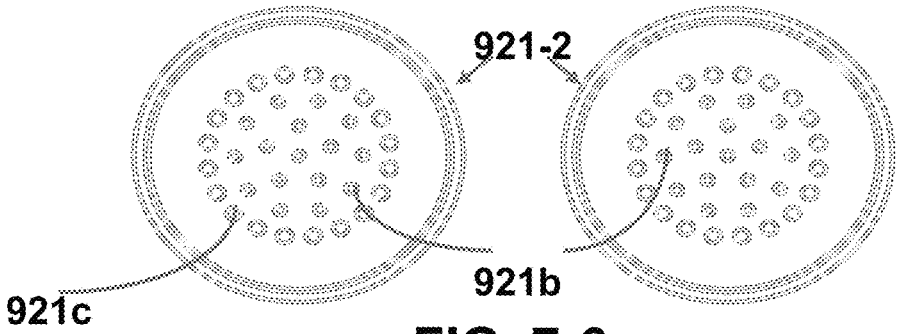
Figure 7:
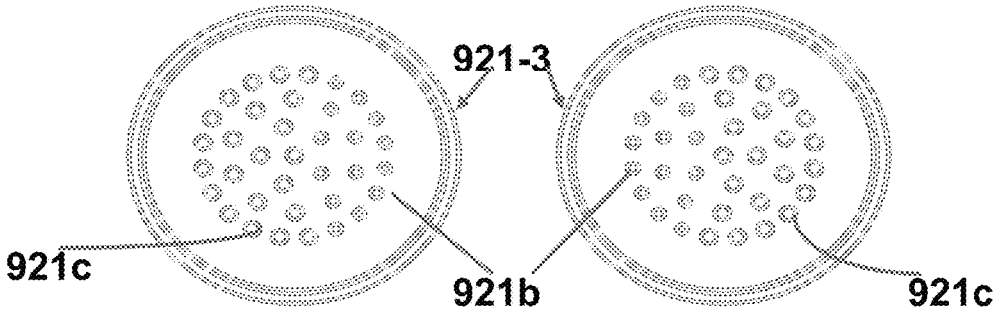
Figures 7, 8:
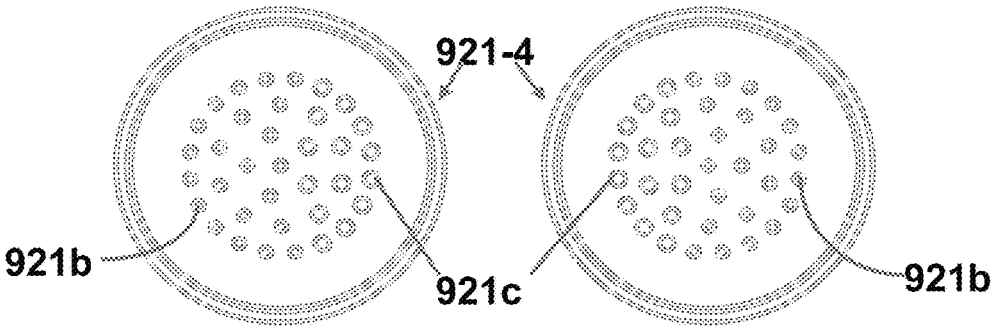
Figures 7, 8, 9:
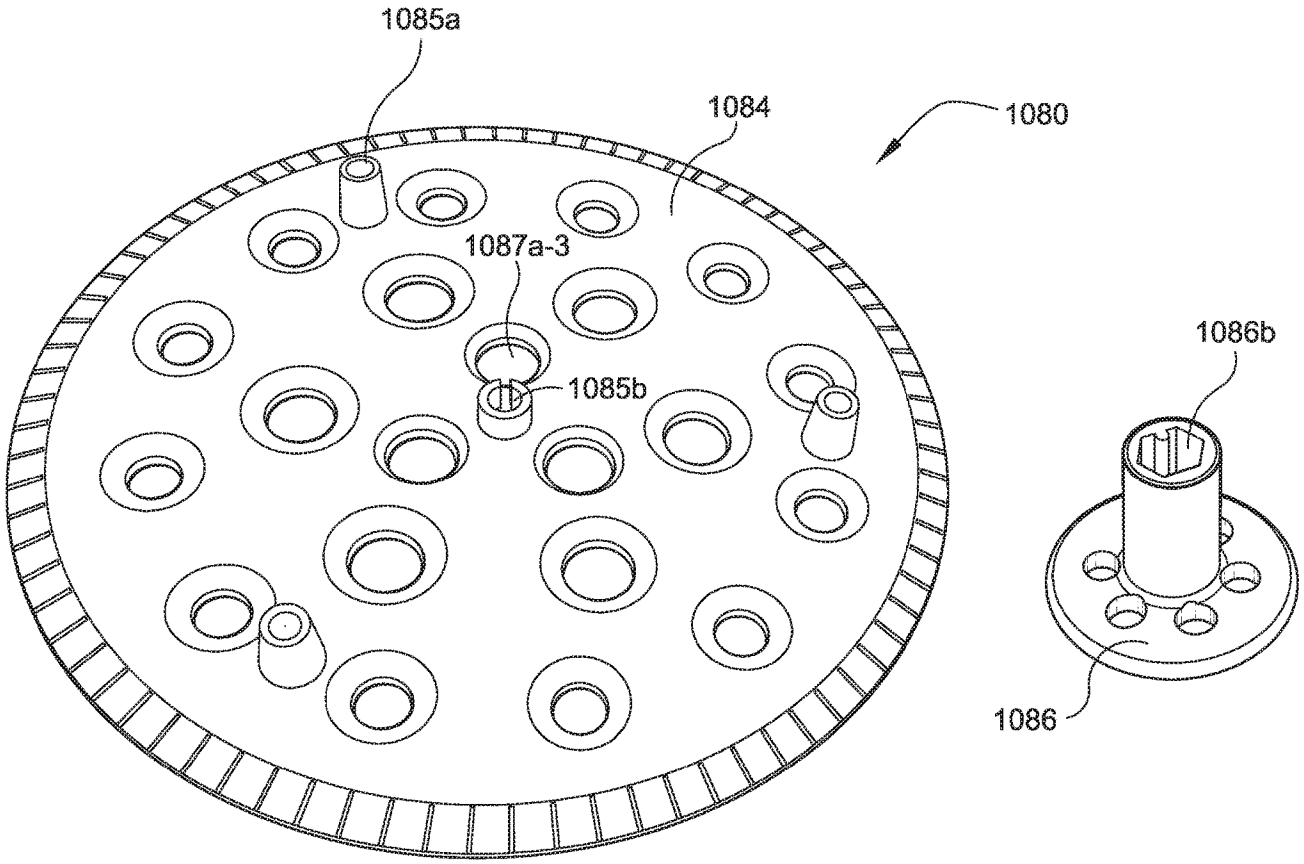
Figures 7, 8, 9, 10:
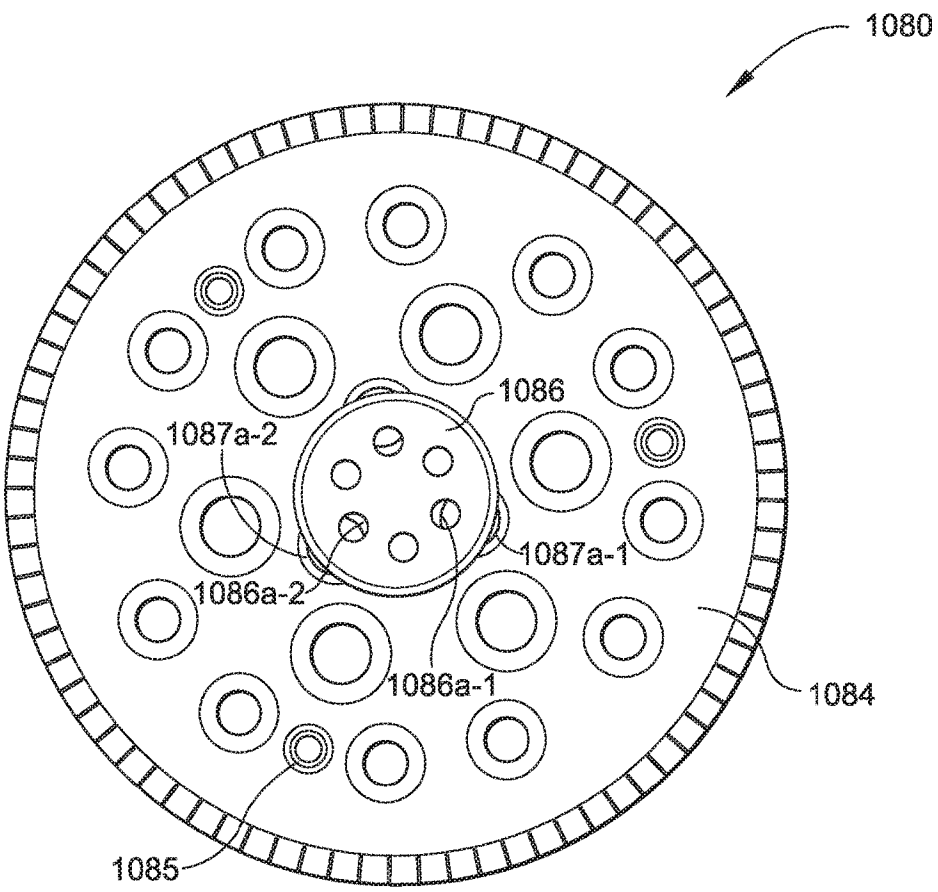
Figures 7, 8, 9, 10, 11, 11A:
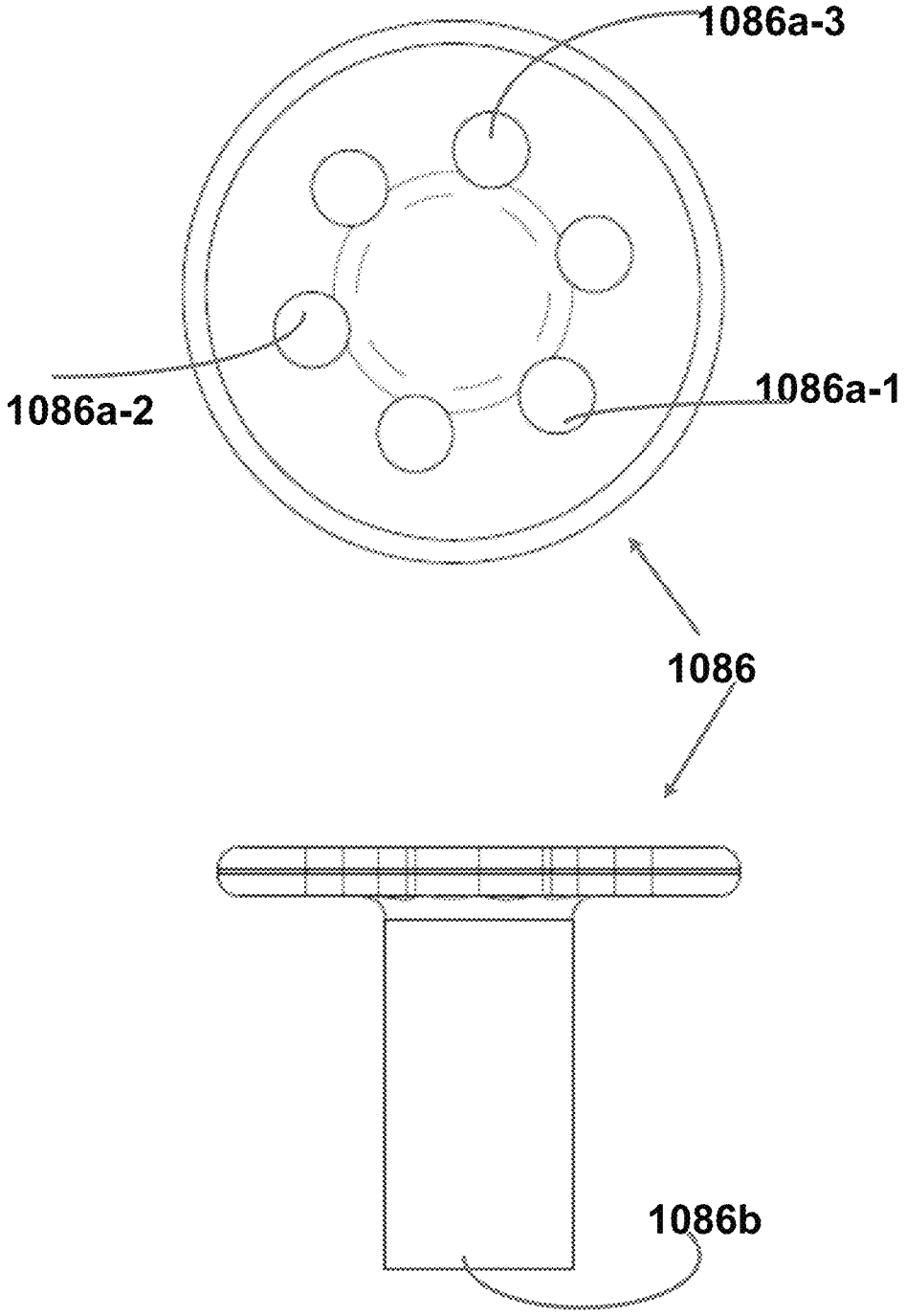
Figures 7, 8, 9, 10, 11, 11B:
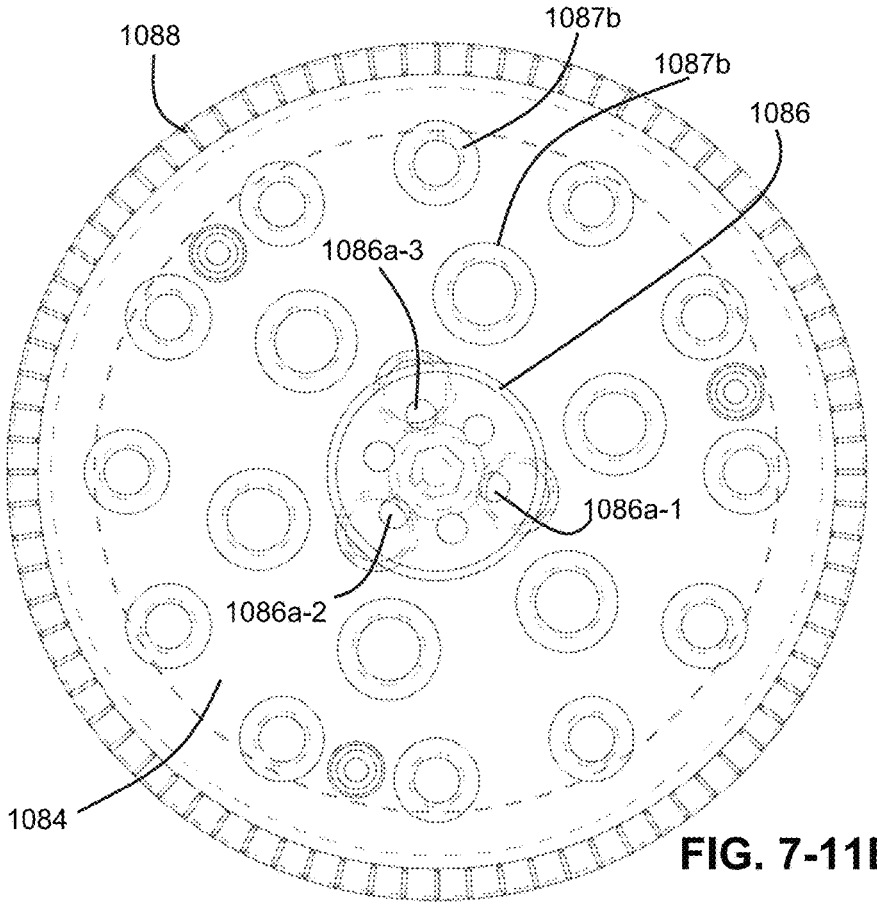
Figures 7, 8, 9, 10, 11, 11C:
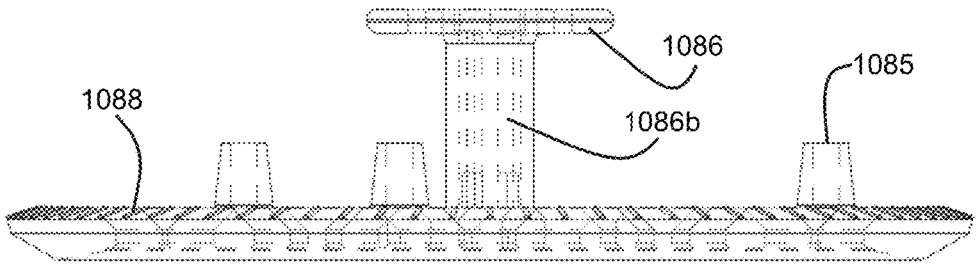
Figures 7, 8, 9, 10, 11, 11D:
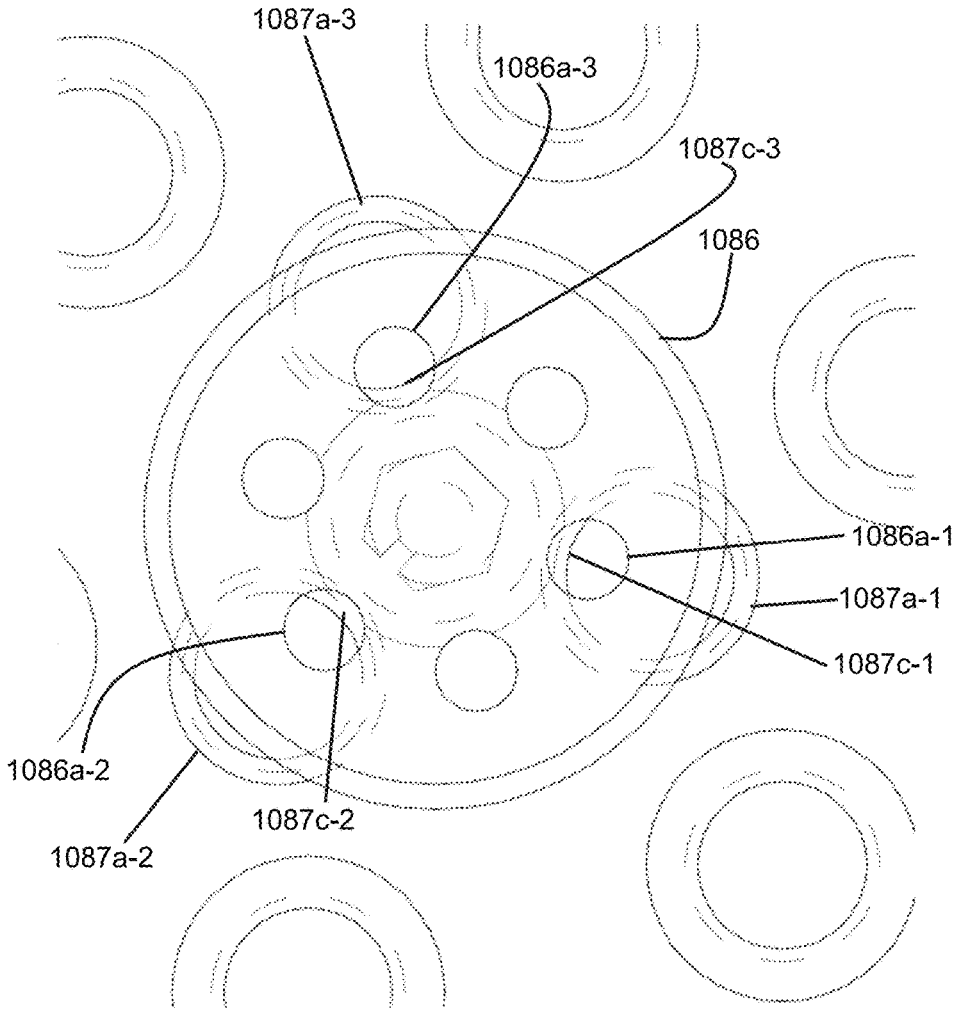
Figures 7, 8, 9, 10, 11, 12:
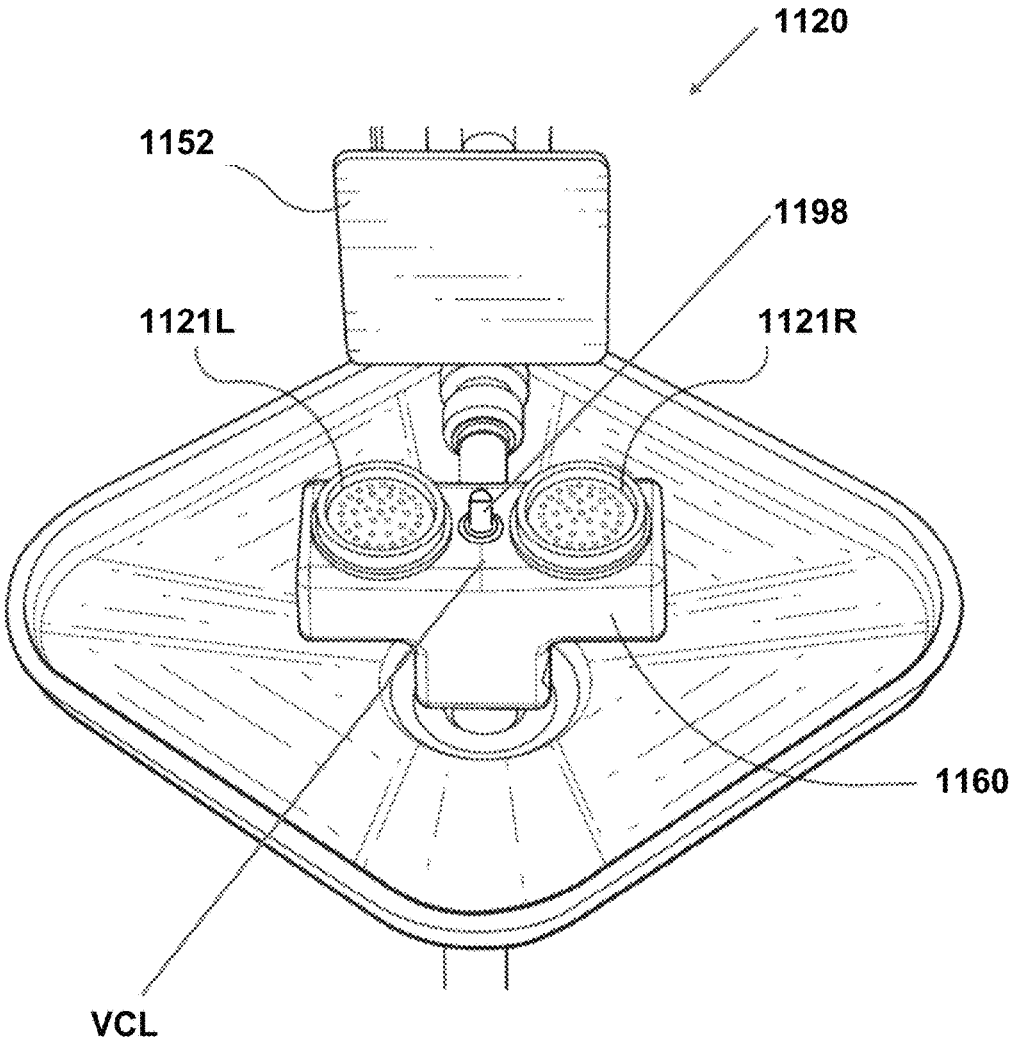
Figures 7, 8, 9, 10, 11, 12, 13:
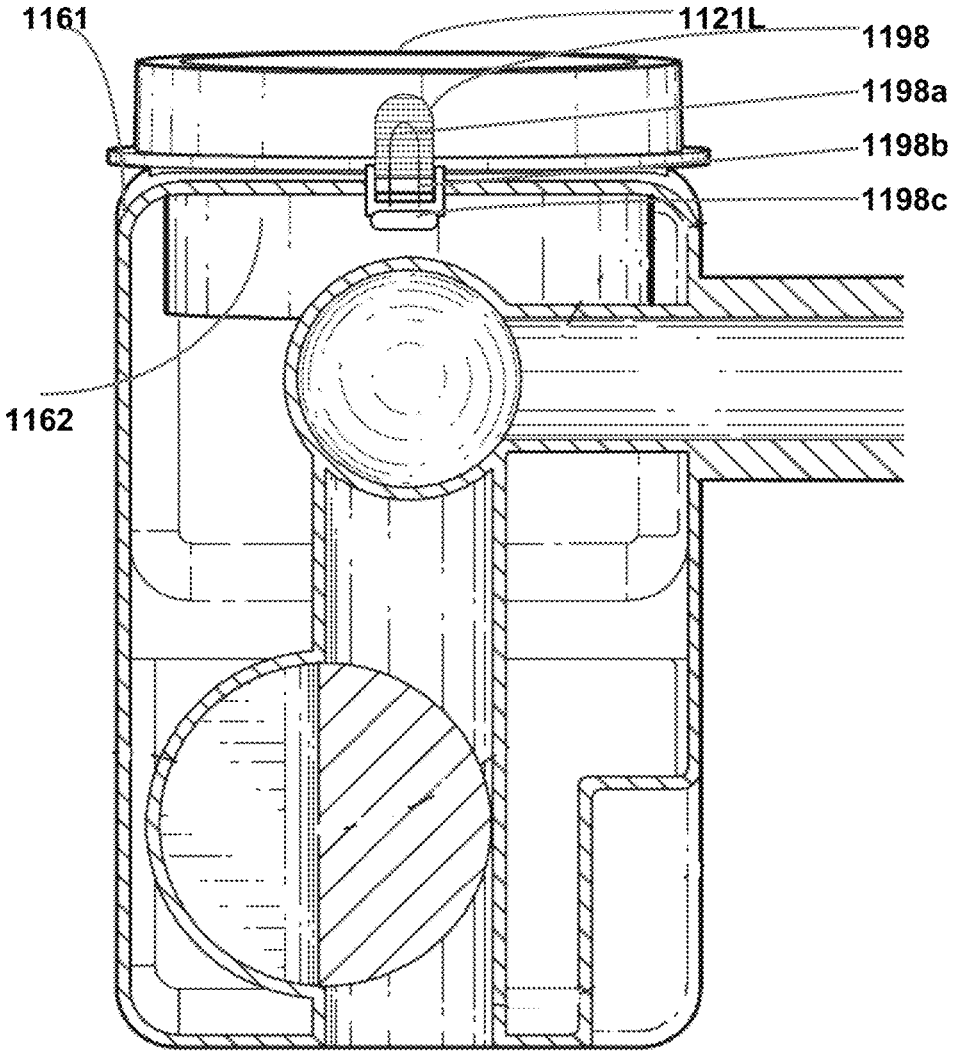
Figures 7, 8, 9, 10, 11, 12, 13, 14:
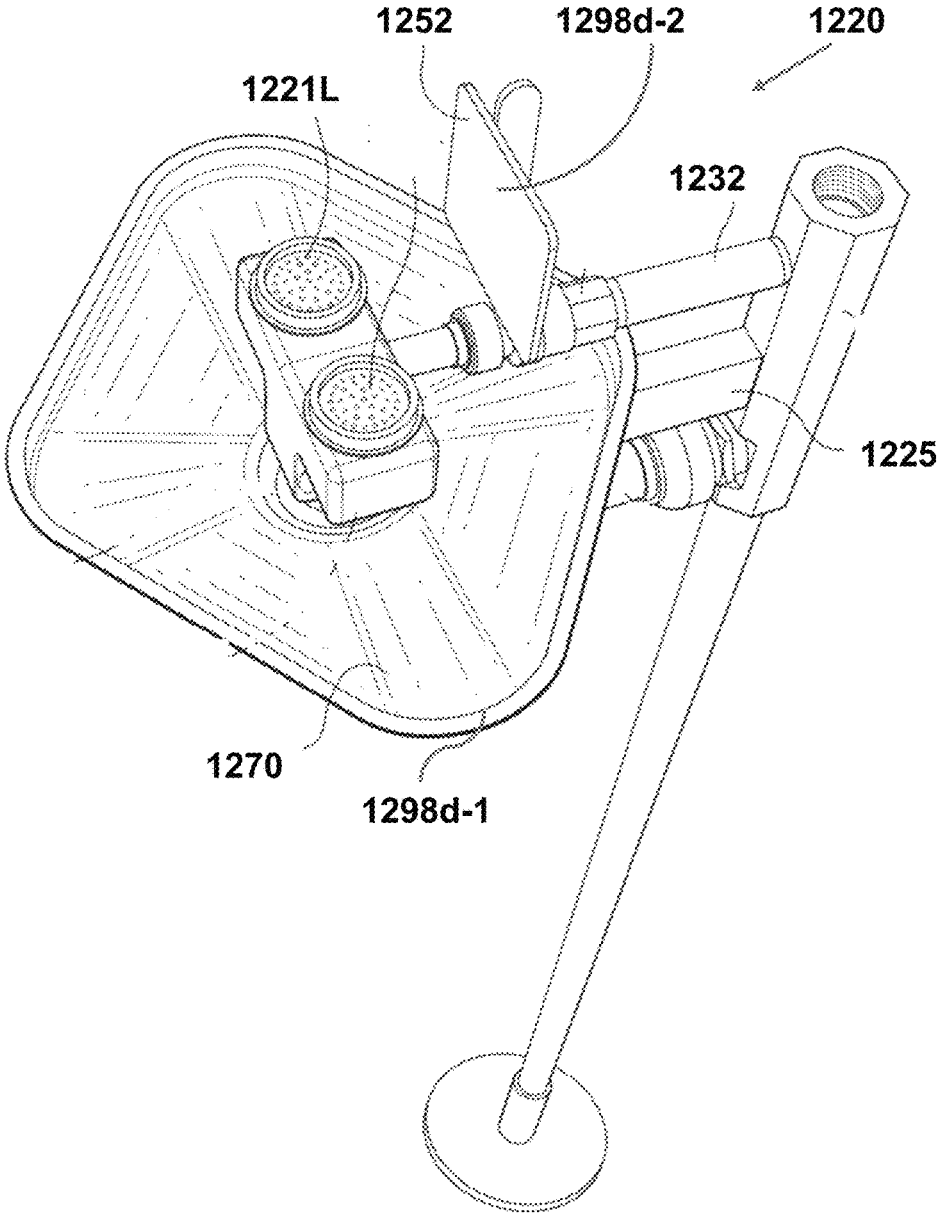
Figures 7, 8, 9, 10, 11, 12, 13, 14, 15:
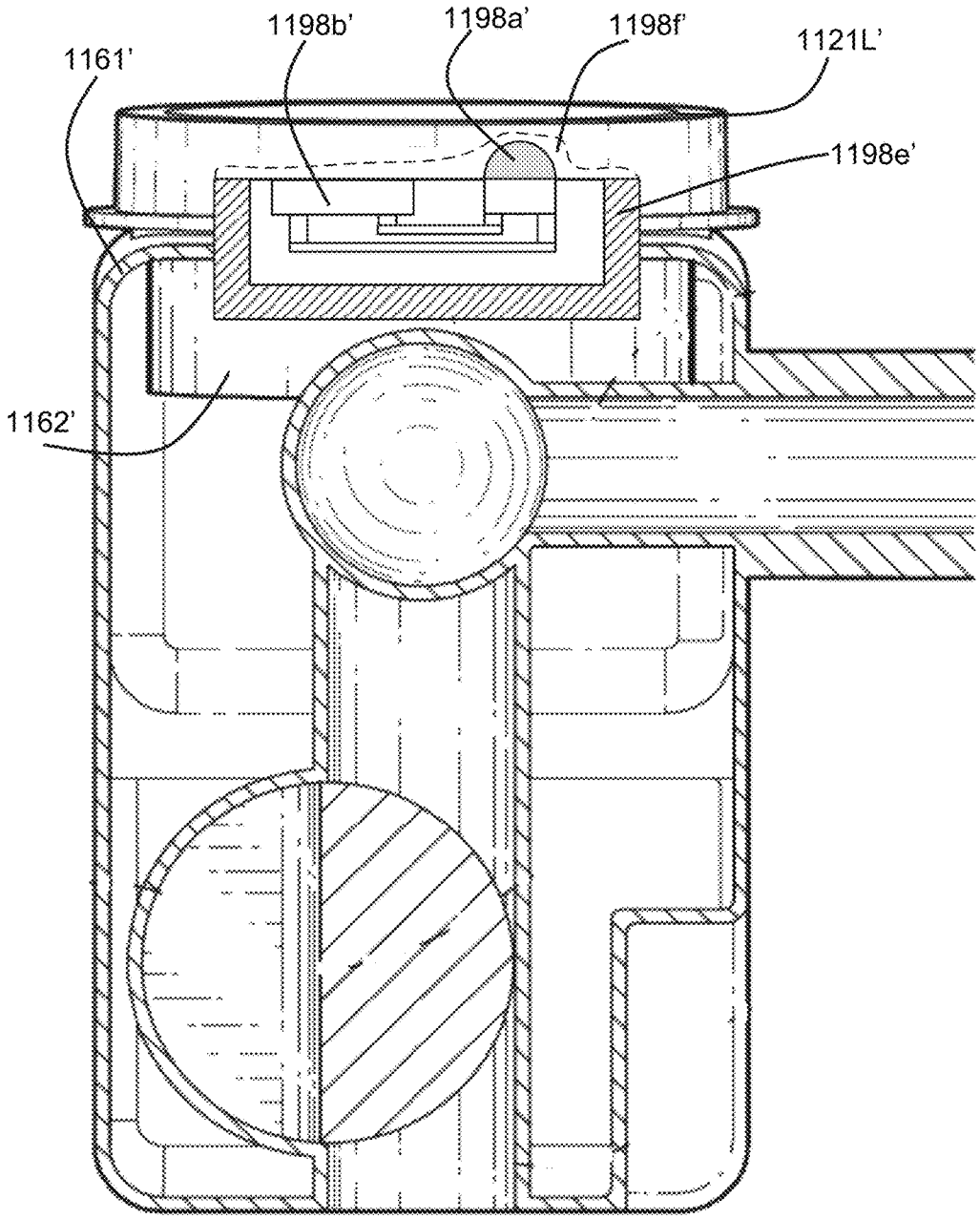
Figures 7, 8, 9, 10, 11, 12, 13, 14, 15, 16:
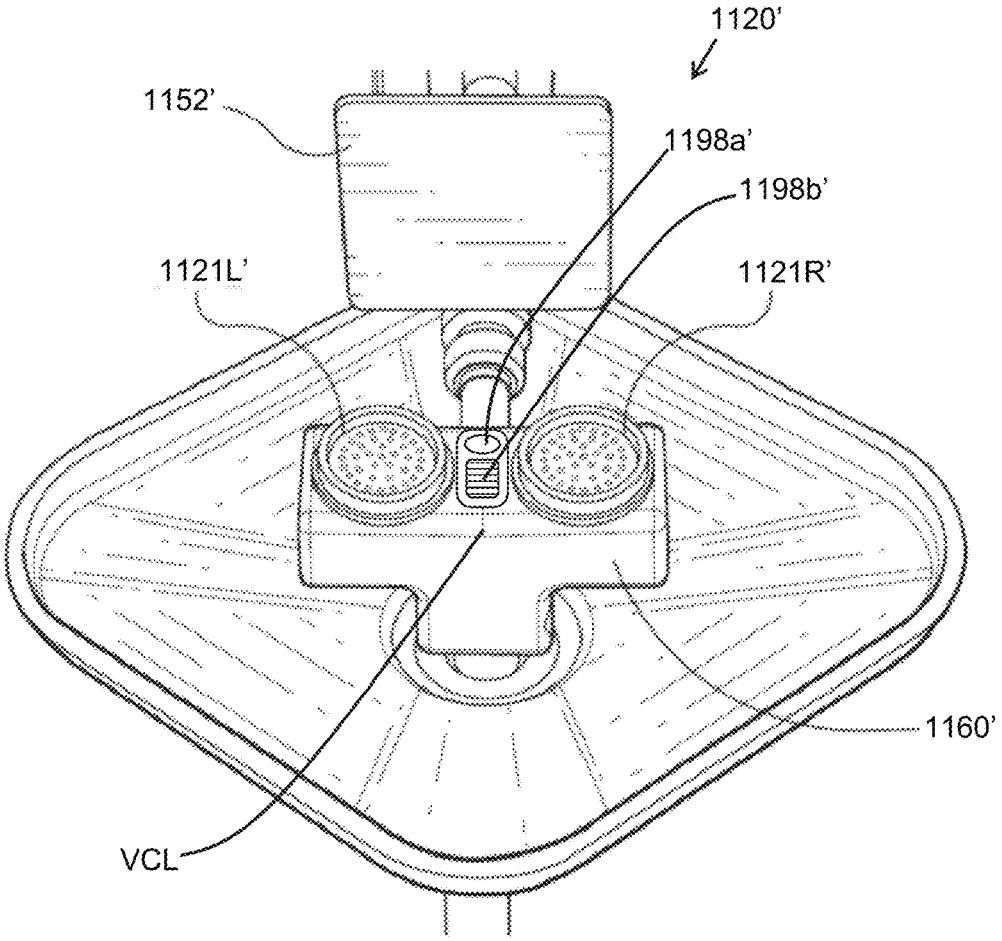

FIG. 2-1B shows that the valve has the ability to tap V50 at the top or bottom for flexible outlet configurations. The valve in FIG. 2-1C shows a reversible stop and check design which allows for either top inlets or bottom inlets, providing for a more flexible installation. The valve of FIG. 2-1E shows stop and check bushings which allow for reverse stop and check installation as well as alternate inlet sizes. The valve of FIGS. 2-2A, B, and C include a baffle tube used to provide a superior mix. FIG. 2-2A is a view as taken along section B-B of FIGS. 2-1C, and shows a bottom outlet. FIG. 2-2B shows a cross sectional view as taken along line B-B of FIG. 2-1C showing a top outlet. FIG. 2-2C shows a sectional view as taken along line B-B of FIG. 2-1C showing top and bottom outlets. The valve of FIGS. 2-3 and 2-4 are cutaway views and show checkvalve components in both positions, piped up to the left, and piped down to the right.

FIG. 2-2 shows various cross sectional views of V20 as taken along section B-B of the central drawings within FIG. 2-1. It can be seen that valve V20 includes a thermostat assembly V24 housed within an internal cavity V45 of casing V22. Thermostat assembly V24 operates a metering section V32 housed within casing V30. As is well known, thermostat V24 and metering section V32 coact to mix hot and cold water and produce a flow of water at a predetermined temperature.

FIG. 2-3 is a cross sectional view of the apparatus of FIG. 2-1 as taken through section A-A of the top image of FIG. 2-1. Casing V30 includes right and left supports V34 that are adapted and configured to provide fluid communication between their corresponding water flows and the centrally located metering assembly V32.

Figures 1, 2, 3, 4:
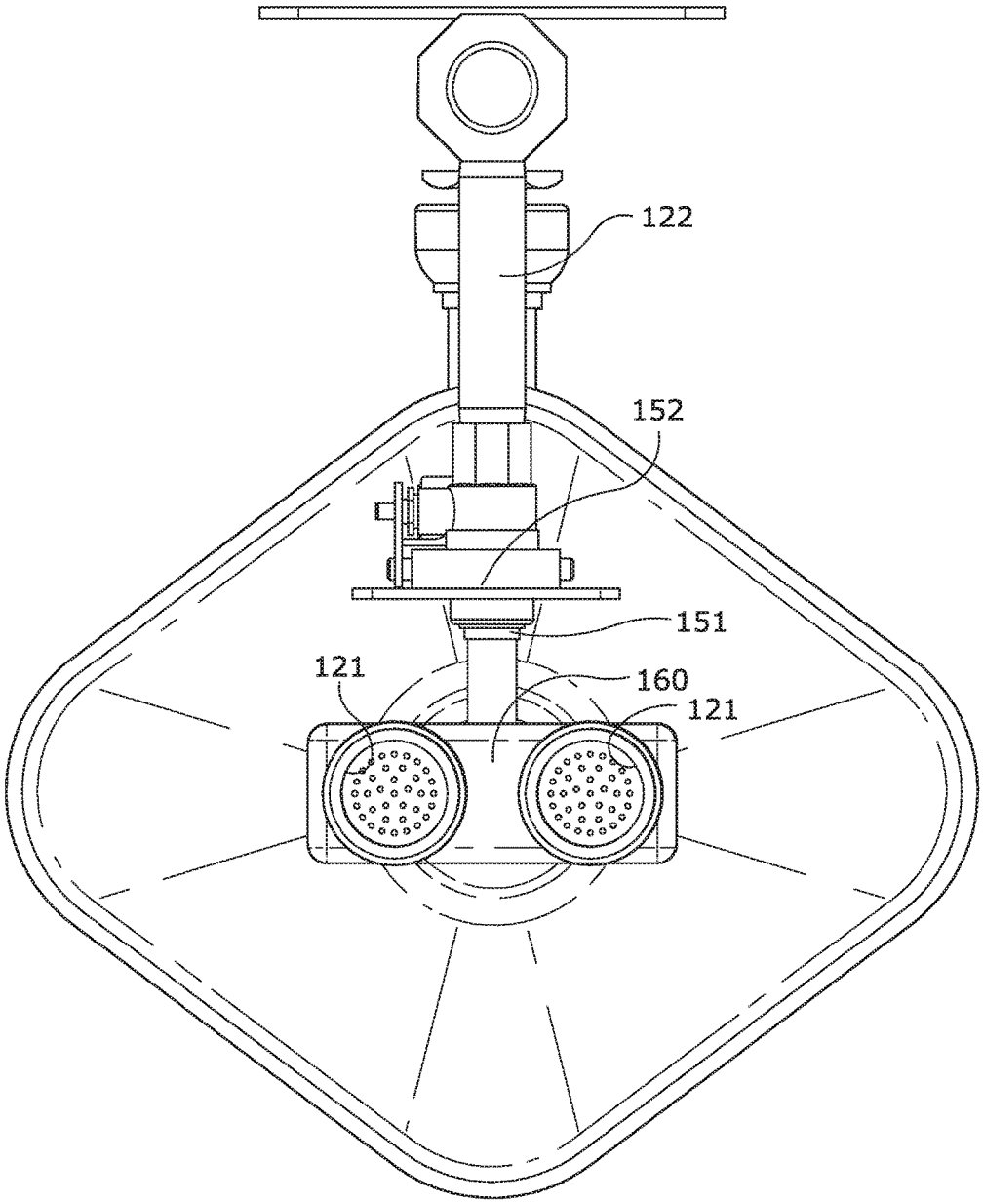

FIG. 2-4 is a close-up of the base housing V30. It can be seen that each casing inlet V34 includes within it identical check valve assemblies V40. Each valve V40 includes a bonnet or cap that closes one end of an inlet V34. Bonnet V42 is threadably received within a threaded interface V36 of inlet V34. An inlet seat V44 has an identical set of threads, and is threadably received within an identical threaded interface V36 at the other end of the inlet V34. The check valve assembly V40 on the left side of FIG. 2-4 is shown oriented with inlet seat V44 at the top, and therefore able to accept water from the top. The right side inlet V34 shows a check valve V40 in the opposite orientation, with bonnet V42 located at the top, and the inlet seat V44 screwed into the bottom female threaded interface V36.

Each check valve includes a spring V48 that is captured between a spring support V44 of bonnet V42 and a disk V47*a*. Disk V47*a* is captured by a screw to an acorn nut V49, with a gasket V47*b* sandwiched inbetween. The right side check valve V40 of FIG. 2-4 is shown in the closed position, with adjusting screw V41 tightened down so as to force a shutoff between gasket V47*b* and a sealing lip of seat V44. It is appreciated that adjustment screw V41 can be placed in an operational condition, such as that shown on the left side check valve V40, where screw V41 has been adjusted to a position providing nominal spring force to compress left side gasket V47*b* against the sealing lip of left side seat V44.

Referring to the topmost figure of FIG. 2-2, there is shown a cross sectional view through section B-B of the central image of FIG. 2-1. It can be seen that valve V20 preferably includes an outlet extension V50 that includes top and bottom apertures for the outward flow of tempered water. It is understood that housing extension V50 is preferably machined with pipe threads on both top and bottom of the common bore, and therefore able to accept an outlet connection on either the top or bottom. A pipe cap is threaded into the unused aperture.

FIGS. 3-1A and 3-2 show various views of an emergency wash 320 according to one embodiment of the present invention. Emergency wash system 320 includes a thermostatically controlled valve 330 that provides tempered water to a pair of eyewash dispensing caps 321, and in some embodiments, further provides tempered water through a top outlet 332 to a showerhead assembly 380.

Control valve 330 (and other portions of wash assembly 320) are supported from the floor by a stand 326. Preferably stand 326 and system 320 are adapted and configured such that dispensing caps 321 are located at a height that is wheelchair accessible. Further, as best seen in FIGS. 3-2 and 3-3, the return line 328 from basin 370 extends rearward so as to provide a clear volume underneath return line 328 to accommodate the front of the wheelchair.

Water is provided to control valve 330 from a source 322 of cold fluid and a source 324 of hot fluid. In some embodiments, hot source 324 receives water from the outlet of a water heater (not shown). In some embodiments, water from one or both of the sources 322 and 324 flows through a flow restrictor that provides generally constant flow, such as the variable restrictors sold by Neoperl.

FIG. 3-1B shows a simplified schematic representation of symbols representing the flow path of a system 320 according to one embodiment of the present invention. Cold water source 322 and hot water source 324 provide water to hot and cold inlets 331 and 333, respectively, of thermostatically controlled valve 330. Referring briefly to FIG. 3-4, valve 330 includes a cartridge valve 336 received within a body 334. Cartridge 336 includes a metering section 338 that controls the flow of hot water to a thermostat (not shown) within cartridge 336. The mixture of hot and cold water exiting metering section 338 is turbulently mixed by one or more mixing outlets 337, and then provided to an outlet 332 as tempered water. Mixing outlets 337 are adapted and configured to provide turbulent mixing of hot and cold flows within valves 330. Further examples of such means for creating turbulence or mixing can be found in U.S. patent application Ser. No. 13/657,218, filed 22 Oct. 2012, and titled METHODS AND APPARATUS FOR CREATING TURBULENCE IN A THERMOSTATIC MIXING VALVE, incorporated herein by reference.

As shown in FIG. 3-4, body 334 includes a single tempered outlet 332 that provides tempered water to the eyewash dispensing caps 321. However, yet other embodiments include an additional tempered fluid outlet 332 that provides tempered water to the showerhead assembly 380, such as by the top mounted outlet 332 best seen in FIG. 3-1A.

Referring again to FIG. 3-1B, the tempered fluid exiting valve 330 from outlet 332 passes through an accumulator (diffuser) 340 in some embodiments. A cross-sectional view of accumulator (diffuser) 340 in one embodiment is shown in FIG. 3-1C. Diffuser 340 includes an inlet 341 and outlet 342 that are in fluid communication by way of a serpentine passage 343. Passage 343 includes a plurality of apertures in the sidewalls of the passageway that encourage fluid mixing along the length of the passageway. Further discussion of diffuser 340 can be found in U.S. patent application Ser. No. 13/213,811, filed Aug. 19, 2011, SYSTEM AND METHOD FOR PROVIDING TEMPERED FLUID, incorporated herein by reference, such discussion of the diffuser being incorporated herein by reference. Diffuser 340 reduces any sharp temperature rise that would otherwise be seen when tempered water first flows out of the outlet 332 valve 330. It is further understood that a second diffuser 340 can further be installed in the fluid pathway from the outlet of control valve 332 showerhead assembly 380.

Tempered fluid exiting accumulator (diffuser) 340 flows to a manually operated, normally closed shutoff valve 350. In one embodiment, valve 350 is a ball valve. A paddle and handle 352 control the state of shutoff valve 350. Referring to FIGS. 3-1A and 3-2, it can be seen that handle 352 is located generally in the center of return basin 370, and behind the eyewash dispensing caps 321. With this central design, paddle 352 is readily accessed by either left-handed or right-handed persons needing an eyewash. To open valve 350, paddle 352 (and its handle) are pushed backwards, away from dispensing caps 321. Preferably, the outlet of valve 350 includes a quick disconnect type of fitting, so as to facilitate removal of outlet valve 360.

Water exiting shell 350 is provided to dispensing valve 360. Valve 360 includes three separate flow channels: two eyewash outlets 364 that provide tempered water to dispensing caps 321, and a variable orifice 366 that provides fluid to drain 372. In some embodiments valve 360 includes an internal chamber for receiving a filter, such as a charcoal filter. Preferably, valve 360 is coupled to valve 350 by a quick connect coupling that permits easy removal and replacement (or refurbishment) of valve 360. Preferably valve 360 is adapted and configured such that there are no internal volumes in which water is permitted to sit when system 320 is not in use. Instead, after a user has opened shutoff valve 350 for emergency wash, any water within valve 360 flows out of outlet 368 and into drain 372.

Figures 1, 2, 3, 4, 5:
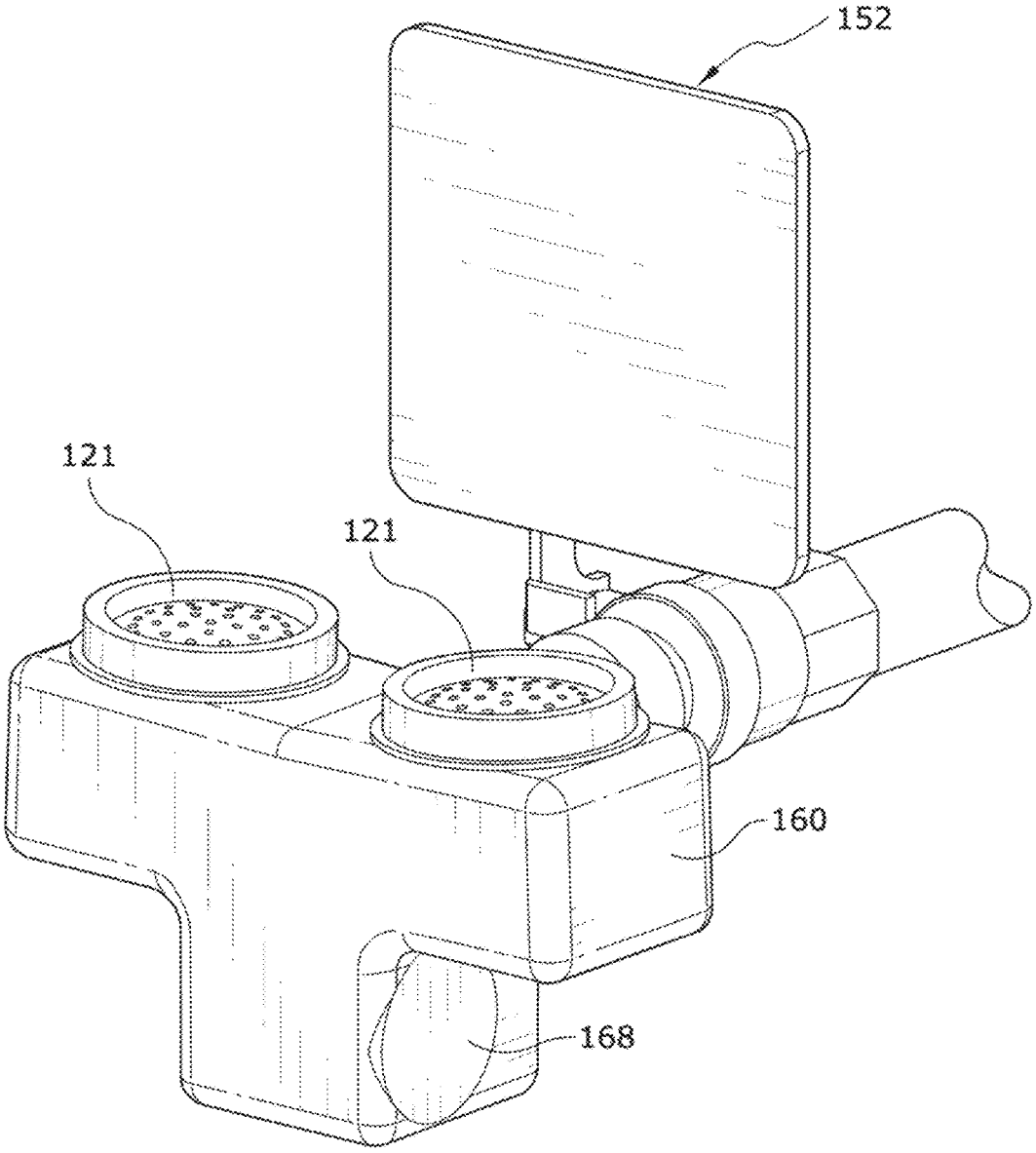

Variable orifice 366 includes an internal valve the position of which can be manually adjusted by the user at an interface 367 on one side of valve 360. FIG. 3-5 shows front and back halves 361F and 361B, respectively, which comprise the body of outlet valve 360. Tempered water flows into the inlet 363 of valve 360 and flows into internal chambers 362T and 362B. The amount of water that flows from the right and left outlets 364R and 364L, respectively, can be adjusted by varying the flow resistance of valve 366. In some embodiments, there is an internal stop that prevents full closure of valve 366, so that water within valve 360 can always drain out.

By way of interface 367, valve 366 can be rotated to a substantially closed position, in which most of the fluid received through inlet 363 flows out of outlets 364R and 364R. If the user rotates valve 366 to the fully open position, then some of the water entering through inlet 361B flows out of outlet 368 into drain 372. Dispensing valve 360 therefore permits accurate adjustment of the amount of water dispensed through outlets 364R and 364L by adjustment of variable orifice valve 366.

Water exiting through dispensing caps 321 or valve outlet 368 flows into a return basin 370. As best seen in FIG. 3-3, outlet valve 360 is generally suspended above the drain surface of the basin 370 by shutoff valve 350. Therefore, wash system 320 is substantially self-draining for all water that exits shutoff valve 350.

FIGS. 3-6 thru 3-8 present various views of a showerhead apparatus 380 according to one embodiment of the present invention. Showerhead assembly 380 includes a bowl 382 that includes on its rear side an inlet 381 through which tempered water is received. Water flowing through inlet 381 strikes a dispensing member 384 that disperses the flow of water into a plurality of separate streams.

FIG. 3-7 shows dispensing member 384 removed from its attachment to bowl 382 by a plurality of standoffs 385 each received within a corresponding depression 383 of bowl 382. In some embodiments, these standoffs are adhered to bowl 382 within the corresponding depressions, although the connection of dispensing member 384 to bowl 382 can be by any method.

Referring to FIG. 3-8, water received from inlet 381 impinges directly upon central deflector 386, and is thereby directed radially outwardly. The volume trapped between the inner surface of dispensing member 84 and the inner surface of bowl 382 is sized so that water fills this volume under pressure. Water thereafter flows through any of a plurality of apertures 387 located in member 384. It can be seen that in one embodiment there is a first set of apertures located closest to central deflector 386. In some embodiments, each of these holes includes a semi-conical, smooth flow channel directed radially inward. Dispensing member 84 in some embodiments further includes an outermost ring of apertures 387 located near the edge of member 384. In yet other embodiments, there is also an intermediate range of apertures 387 located between the outermost ring and the apertures closest to central deflector 386. Preferably, these outermost and intermediate rings have apertures with a conical inlet. It can also be seen in FIG. 3-8 that the outer circumference of deflecting member 384 tapers to a reduced width for the radially outward dispensing of water between member 384 and the inner surface of bowl 382. In some embodiments this outer circumference includes a plurality of ridges 388 for channeling this circumferential flow of water.

FIGS. 4-9, 4-10, and 4-11 depict a transportable eyewash system 410 according to another embodiment of the present invention. System 410 includes an eyewash system 420 located on an easily transportable cart 411. In one embodiment, cart 411 includes a deck 412 supported by a plurality of legs 413, and movable over a floor by way of wheels 414. In some embodiments, cart 410 further includes a lid 415 that can be used to enclose eyewash system 420 when not in use. It is understood that FIG. 4-9 is a photographic representation of portions of the eyewash system 410, and not the entire system, which will be now be described.

FIG. 4-10 is a schematic representation of the various elements of eyewash system 420. In one embodiment, eyewash system 420 receives water from an external tank 412. As one example, water tank 422 is kept locally to eyewash system 420, and is substantially at ambient temperature. As another example, tank 422 is a water tank that is attached to a trailer, such as a transporter for automobiles, or in another embodiment a truck that carries emergency equipment, such as fire truck.

Tank 422 is coupled to system 420 preferably by quick connect fittings (not shown). Water from tank 422 is provided to the inlet of a water heater 490. Water heater 490 preferably heats fluid by way of a heat exchanger 494, such as an electrical resistance heater. FIG. 4-10 shows heater exchanger 494 receiving electrical power from a source 491 of electricity. In some embodiments, heat exchanger 494 is provided with electricity by way of a thermal switch 496. Switch 496 permits the flow of current through heat exchanger 494 when water temperature is below a predetermined limit. However, if water temperature exceeds the predetermined limit thermal switch 496 opens the circuit and prevents further heating by heater 490.

In some embodiments, heater 490 is mounted to cart 411 by way of one or more vibration isolators or shock mounts 492. These mounts provide isolation of heater 490 from shock or vibratory inputs that are higher in frequency. Preferably, shock mounts 492 are selected to provide isolation from the types of handling acceleration inputs that are typically encountered when moving system 410 on or off a vehicle, or during collisions with system 410 and other objects, or related dynamic inputs. In some embodiments, the water and electrical hook-ups to heater 490 are selected to be relatively flexible, so that shock or displacement inputs from electrical cabling or water plumbing are attenuated before being received by heater 490.

Water exiting heater 490 is elevated in temperature relative to the temperature of water entering heater 490. This hotter water is provided to a shutoff valve 450. Valve 450 is preferably a three-way valve, including one inlet and two outlets. Water flows out of valve 450 toward either flow regulator 456 or out of drain 453 based on the position of a handle 452. Over one range of positions, handle 452 permits the flow of water from heater 490 toward flow regulator 456. However, in a different range of positions, handle 452 also allows water from heater 490 to exit from purging drain 453. When purge drain 453 is open, any air that is trapped within heater 490 can be purged out, to help ensure that heat exchanger 494 contains only water and no trapped gas. Handle 452 can be positioned such that both outlets are closed, thereby maintaining the purged conditions of heater 490. Handle 452 can also be opened to allow flow toward flow regulator 456, but still maintain drain 450 in a closed position. It is further noted that in some embodiments heater 490 is oriented on cart 411 such that water from tank 422 is provided at a location horizontally below the outlet of heater, so that trapped air tends to rise upward within heater 490 from the heater inlet to the heater outlet, thus encouraging a gas-purged state.

Water exiting shutoff valve 450 is received by a pressure compensated flow regulator 456, such as those made by Neoperl. Compensator 456 acts to maintain relatively constant flow conditions over a range of input pressures. As water pressure received at the inlet of compensator 456 increases, a resilient member within compensator 456 (such as O-ring) changes shape or configuration to increase the overall flow resistance (such as by decreasing the valve's flow number and/or decreasing the cross sectional flow area) of regulator 456, and thereby reduce the amount of flow that would have occurred as a result of the higher pressure, had there been no flow compensation.

Flow exiting regulator 456 is received at an outlet valve 460 located on a wash basin 470. In a manner similar to that described earlier, flow received at the inlet of valve 460 is provided to a pair of eyewash outlets 464, each of which is preferably covered by a dispensing cap 421. Outlets 164 and caps 421 are adapted and configured to provide an eyewash to a person bending over and facing toward valve 460.

Further, as previously discussed, valve 460 includes a manual flow adjuster 466 that can be used to set up a desired spray pattern from outlets 464. Preferably, valve 160 further includes a non-closable drain 473 that operates in parallel around drain 472. Referring to FIGS. 4-11A and 4-11B, the adjustable valve 466 is shown removed from the body 461 of valve 460. In FIG. 4-11A, valve 466 is shown in the fully opened position, and it can be seen that the flow area of outlet 468 can be maintained substantially opened and unrestricted by valve 466 when valve 466 is in the A, or fully opened position. FIG. 4-11B depicts the position of valve 466 when fully closed, showing that even under full closure there is a flow area B of valve 466 that still aligns with a portion of the outlet area of outlet 468. Therefore, even when fully closed, water can still flow out of outlet 468. In those embodiments in which valve 460 is not fully closable, the draining of any remaining water within portions of eyewash system 420 is encouraged, thus preventing the accumulation of stagnant water. It is further envisioned some embodiments that outlet 468 will be located lower than the outlet of shutoff valve 450.

FIGS. 5-1 through 5-14 depict and explain various features pertaining to an eyewash system 520 according to one embodiment of the present invention.

FIGS. 5-1 through 5-4 depict various external views of an eyewash nozzle assembly or outlet valve 560 according to one embodiment of the present invention. It will be appreciated that valve 560 is related and similar to the previously defined outlet valves 160, 360, and 460, even though there are external differences in shape. It is further understood that the various functions that will now be described for valve 560 apply equally to these other outlet valves disclosed herein.

Valve assembly 560 includes an inlet 563 for water and a pair of outlets 568 which can be capped with dispensing caps 521. Preferably, the housing of outlet valve 560 includes a groove 556*a* that is adapted and configured to hold within it a filter disk 556. In some embodiments, these features are arranged symmetrically about a vertical centerline (VCL) that extends forward toward the user when valve 560 is installed in an eyewash system.

The inlet 563 includes within it a flow regulator or variable orifice valve 566, such as those made by Neoperl. These flow regulators provide a substantially constant flow of water therethrough, especially after a threshold pressure has been obtained. As one example, with a flow regulator from Neoperl of the type MR03 US Type, flows can be selected to flow from about one gallon per minute to about two and two-tenths gallons per minute within a tolerance band. Preferably, the flow regulators are press fit into the housing at the inlet 563.

Valve assembly 560 includes a central passage 562 that interconnects inlet 563 to an internal connection 565 and outlets 564. By transitioning from central passage 562 with a relatively small cross section to the larger eyewash outlets 564 (which are capped with dispensing caps 521), the velocity of water within valve 560 is reduced greatly and thereby emerges from the apertures 521*a* of cap 521 more gently, yet extends upwardly the required distance of eight inches as noted in ANSI standard Z358-1-2009. Further, it has been found that the velocity of water is not so great as to extend greatly beyond this eight inch limit, thus making the eyewash system more user-friendly, and therefore more likely to be used. In some embodiments, the area ratio (the combined cross sectional area of outlets 564 to the cross sectional area of central passage 562) is from about 8 to about 11, with a preferred range being greater than about 9. With this sizing, it has been determined that a wash flow less than about two gallons per minute can be provided. In this manner, the flow valve 560 is less wasteful of water during usage.

In some embodiments, central passage 562 terminates at a distal-most end 563*a*, as best seen in FIG. 5-3. Some versions of valve assembly 560 include an aperture at the termination 563*a* of internal chamber 562. This aperture can be provided with a male or female feature that can be coupled to the inlet 563 of a second valve assembly 560. This coupling of two valve assemblies provides four eyewash nozzles, and this modular construction thus makes valve 560 suitable for emergency eyewash applications and emergency face wash applications. A corresponding flow schematic can be seen in FIG. 5-13, where the additional valve 560 is represented by outlets 564' and dispensing caps 261'. Further, the modified, inlet is identified as element 563', and the secondary outlet of the first valve is identified as 563*a*.

Valve 560 further includes an indexing feature 561*a* located centrally on the bottom of the housing 561. As best seen in FIGS. 5-2 and 5-3, indexing feature 561*a* includes a pair of downwardly extending arms that define a gap therebetween. Referring briefly to FIGS. 5-7 and 5-9, it can be seen that this gap is sized to accept therebetween the indexing feature 571 of wash basin 570. This indexing feature combined with the quick connect fittings on outlet of the shut-off valve 550 and the inlet to the outlet valve 560 combine to make valve 560 modular and easily replaceable by an unskilled person. The quick connect fittings of the shut-off valve and the outlet valve combine to align valve 560 along the length of the vertical axis VCL. The indexing features 561*a* and 771 do not interfere with this fore and aft alignment, since indexing feature 571 can fit easily between the parallel arms of indexing feature 561*a*. However, the indexing features 561*a* and 571 combine to laterally locate valve 560 in a lateral direction (i.e., as along the lateral centerline LCL, best seen in FIG. 5-7). Valve 560 is preferably not attached to basin 570. Therefore, the person replacing valve 560 has only a single quick connection to achieve, and does not have to further connect body 561*a* to basin 570. It can be further seen that the shape of feature 561 is generally complementary in shape to indexing feature 571.

Figures 1, 2, 3, 4, 5, 6:
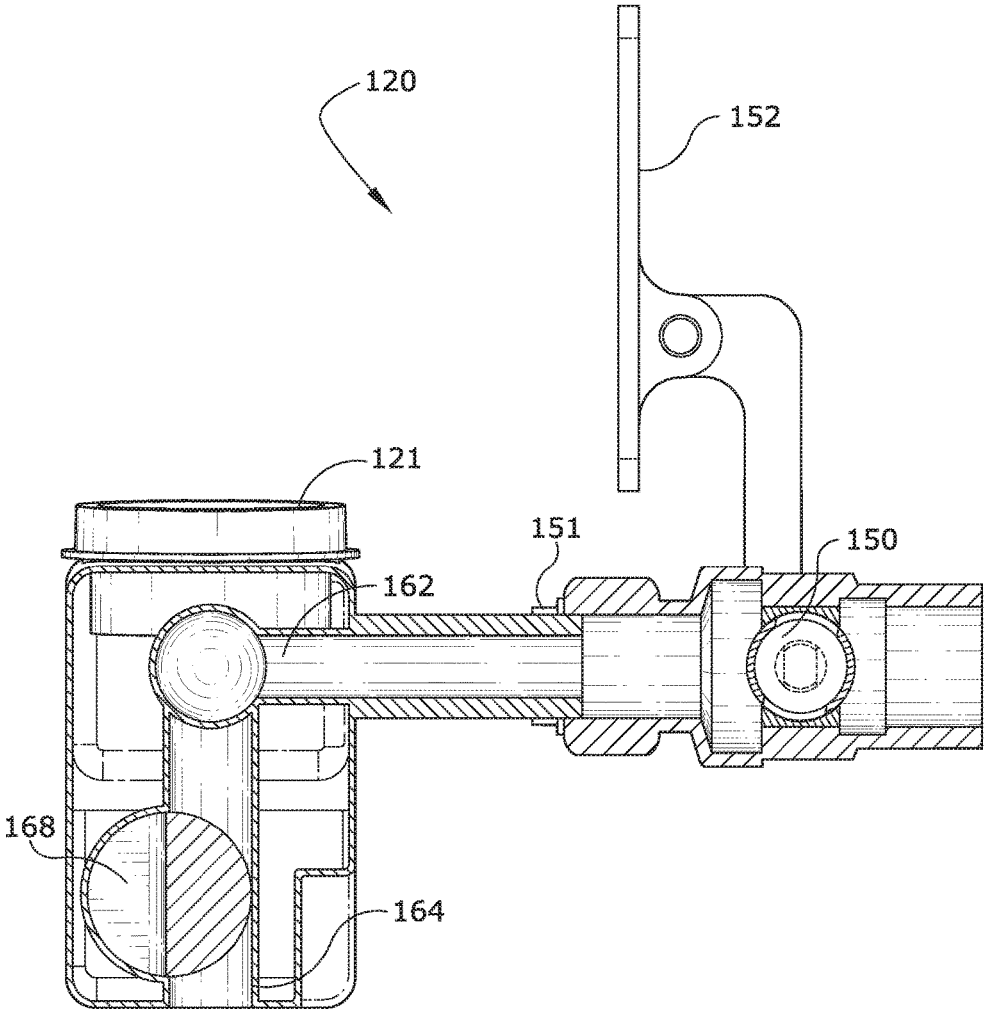

FIGS. 5-5 and 5-6 show various components located internally in some embodiments of valve 560. Filters 556 in one embodiment are preferably porous, sintered metal wafers. In one example, housing 561 is a two-piece, molded plastic housing having a groove within wash outlet 564. During manufacturing, a filter 556 is inserted in the groove of one-half of the housing 561, and the other half is then mated with the first half, trapping filter 556 in place. A Neoperl regulator 566 is shown in FIGS. 5-5 (from one side) and FIG. 5-6 (from the other side). Each regulator includes a static, generally rigid structure 556*b* that cooperates with the rigid members 556*a* that cooperates with a resilient member 566*b*, such as an O-ring to produce a variable orifice effect.

FIGS. 5-5 and 5-6 show end and side views, respectively, of an expulsion valve 558. In some embodiments, valve 558 is press fit into an orifice created at secondary outlet 563*a* of body 561.

FIG. 5-12 schematically describes operation of expulsion valve 558. Flow is received within the valve from inlet 563 as shown in the direction of the arrow. After this flow has reached a sufficient value, its impingement on flapper 558*c* causes the flapper to shut drainage outlet 558*b*. The flow is thereby directed upward (with reference to FIGS. 5-12) and onto the eyewash chambers 564. When the inlet flow stops, flapper 558*c* is biased to the open position (as shown schematically by the spring), and thereby releases any trapped water within valve assembly 560 by way of the open flowpath to drainage outlet 558*b* (which releases the water into basin 570). It is appreciated that flapper 558*c* can be biased open by spring, by weight, or by any other means.

FIGS. 5-7 through 5-10 depict various features of basin 570. In one embodiment, basin 570 is of a rounded diamond shape, and symmetrical about a vertical centerline VCL, and further symmetrical about a lateral centerline LCL. A drainage aperture 562 is located at a low point within basin 570 so as to achieve a gravity drain. A lip 575 extends upwardly from the bottom of the basin, and around the edges of the basin. Basin 570 includes an indexing feature such as the rib 571 extending upward from the bottom of the basin, and located proximate to the drainage aperture 572. As previously discussed, this indexing feature 571 cooperates with an indexing feature of the valve body assembly so as to assist a user in replacing the valve assembly 560. Preferably, the indexing features provide an indexing and location function in a single direction, and do not limit indexing or location in directions orthogonal to that direction. As seen herein, indexing features 571 and 561*a* provide a locating function along the length of centerline LCL but do not provide any location along the length of vertical centerline VCL, and further does not provide any limitation on the upwards location of the valve assembly.

Basin 570 further includes an attachment feature 573 located on the bottom of basin 570, and best seen in FIGS. 5-10 and 5-11. Locating feature 573 in one embodiment includes a pair of spaced apart members that receive between them a support arm 525. The members further include an attachment hole that aligns with an attachment hole in the arm 525. Referring to FIG. 5-11, a person installing a basin 570 makes the appropriate plumbing connection from drain 572 to drain 528 and then to the draining feature of stand 526. Arm 525 is pinned to basin 570 at one end, and further pinned or otherwise fastened to stand 526. Preferably, support arm 525 is provided in at least one embodiment at a length suitable for spacing basin 570 away from stand 526 such that person in a wheelchair can approach the basin, get their legs under the basin, and use the eyewash. Arm 525 is preferably a tight fit within a machine slot of stand 526.

Some embodiments of the present invention use a basin 570 that is adapted and configured to provide a tactile indication to the user of their location relative to the eyewash outlets 564. It has been observed that some existing emergency eyewash basins have a circular shape, or other shape, that does not give a tactile indication to a person without vision of their relative location, such as for existing eyewash basins that are circular. In such a case, the person with impaired vision would have difficulty aligning their eyes with the spaced apart eyewash outlets.

Figures 1, 2, 3, 4, 5, 6, 7:
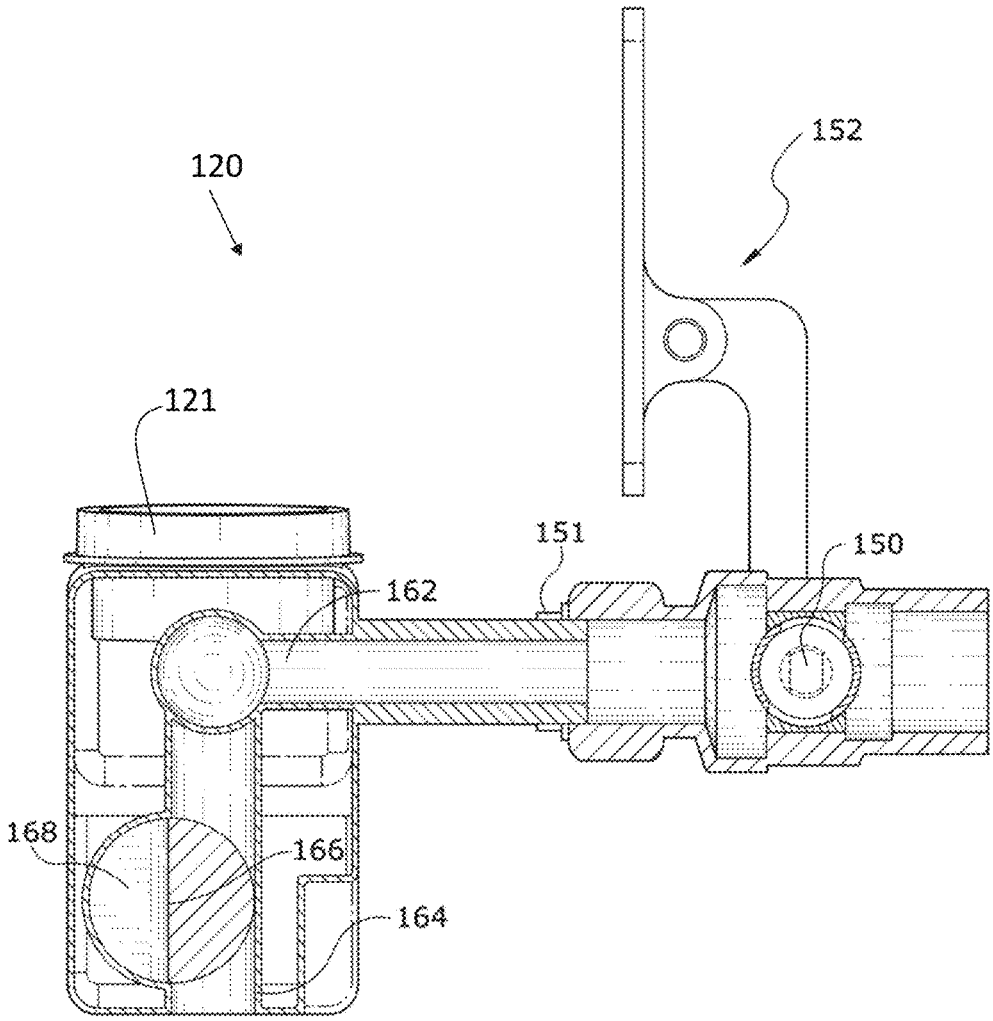

Referring to FIG. 5-7, it can be seen that basin 570 includes rounded corners at opposing lateral extremes along centerline LCL, and these comprise tactile features 574 that can be gripped or touched by the person using the eyewash basin. The person would be able to feel the rounded corners of the diamond shape in the lateral directions, and therefore intuitively know where to place their head and eyes. In some embodiments, the tactile features are corners (whether rounded or not) of the basin, but further can be handles, finger or thumb grooves located in the lip 575, inwardly-extending pockets adapted to receive the person's fingers in the lip, or similar features. It is preferred that the tactile features 574 be located the greatest lateral distance from the centerline between the eyewash outlets.

Flow schematic 5-14 depicts yet another embodiment of the present invention. Various embodiments contemplate one, two, or there flow regulators 566 within valve assembly 560. As has been previously discussed, a first flow regulator 566-1 is selected to provide a total eyewash flow to both eyewash outlets 564. However, in yet other embodiments this first, central flow regulator is not needed, and the valve assembly can otherwise include a pair of flow regulators 566-2 each selected for regulation of flow to a single eyewash outlet 564.

FIGS. 6-1 to 6-5 depict various embodiments of a transportable eyewash according to one embodiment of the present invention. An eyewash system 620 is located on a cart 611 and combines to create a transportable eyewash system 610. Cart 610 preferably includes a deck 612 that supports within it a basin 670 for capturing was that flows out of outlet valve assembly 660, and draining out of a drain 672 into a catch basin 629. Catch basin 629 is adapted and configured to contact not just the flowing out of the valve assembly 660, but also any contaminant that was washed off of the person using transportable system 610. Therefore, this contaminant, which may still be dangerous even if diluted, is not released to the ambient, but rather is stored at the bottom cart 611.

Cart 611 further supports eyewash system 620 from a plurality of legs 613 that contact the ground or floor by corresponding wheels 614. When not in use, a lid 615 can be closed around deck 612, since actuating on-off paddle 652 and valve assembly 560 are sized to fit within the recessed deck portion of cart 611. Cart 611 further includes underneath it an electrical water heater 690 that is shock mounted to the structure of cart 610.

Shock mounts 692 are selected such that they are relatively loose, and permit a static deflection of heater 690 of more than about one-fourth of an inch. The spring constant of the resilient member 692 are selected to reduce the transmission of vibration above a predetermined frequency. Preferably, this predetermined frequency is selected to isolate heater 692 from many of the routine shocks and vibration that occur during handling and operation of system 620.

FIG. 6-4 schematically shows a system 610 that includes a flow regulator 656 that establishes a generally constant flow of water when shut-off valve 650 is opened. FIG. 6-5 schematically depicts the catch basin 529 that is located to collect any drainage from eyewash system 620.

FIGS. 7-1 and 7-2 are photographic representations of an emergency eye wash system 710 according to one embodiment of the present invention. Eye wash system 710 includes a heater 790, such as a gas or electric heater that receives cold water from an inlet 790C. System 710 is adapted and configured such that cold water from inlet 790C is provided both to an internal heating unit for the subsequent production of heated water, and also to a cold water inlet 731 of thermostatically controlled valve 730. The hot water inlet 733 of valve 730 is provided with heated fluid from a diffuser 740. During typical operation, diffuser 740 contains a supply of water that is more or less at room temperature. During operation, the inlet 742 of diffuser 740 receives heated water from an outlet of heater 790. Diffuser 740 provides mixing of the stored internal volume with new heated fluid, and thereby provides water to the hot inlet 733 of valve 730 that has a relatively slow increase in temperature. Therefore, diffuser 740 helps prevent spikes in temperature when eye wash 720 is first turned on.

Further during operation, FIG. 7-2 shows that water is provided to right and left dispensing caps that provide an upward flow of tempered water. This water is received for drainage within basin 729, and subsequently drained out (the drainage attachment not being shown). Dispensing caps 721 are provided to an outlet valve 760 that is coupled by a quick connect fitting 751 to a shut off valve 750.

FIGS. 7-3 and 7-4 show cut away views of an outlet valve 860 according to another embodiment of the present invention. Outlet valve 860 can be used in an eye was system X20, as described elsewhere herein. Valve 860 includes a variable orifice 866 that provides a predetermined range of flows of tempered water from the outlet of the shut off valve (not shown) to an internal flow chamber 862.

Water from central chamber 862 is then provided to right and left eye wash outlets 864 through respective filter elements 864*a*. Each of the filter elements 864*a* provide some resistance to flow, and therefore, each assists in pressure balancing the central flow of water as it is provided to the right and left outlets. In some embodiments, the filters 864*a* have a nominal filter rating in the range of forty to sixty microns. In yet other embodiments, the filters are equivalent to about two hundred mesh or about seventy to eighty microns.

In some embodiments, valve 860 further includes a drainage outlet 868 that is located between the inlets to the right and left filters 864*a*, and preferably located lower that the centerline of internal chamber 862. During operation, water exiting the shut off valve fills chamber 862 under sufficient pressure to force the water through respective right and left filter elements 864*a*. Filtered water is then provided to right and left chambers 864, and subsequently through right and left dispenser caps 821 to the user. Location of the drainage outlet 868 as described can provide, in some embodiments, several features. One such feature is to drain the internal chamber 862 and 864 under the influence of gravity. Yet another feature is to assist in a backwashing through filters 864*a*. During backwashing, as the shut off valve is closed, any water collected in right and left chambers 864 will flow in reverse direction (i.e., from outlet to inlet though filters 864A), and subsequently out of drain 868. This backwashing feature can increase the usable life of filters 864*a*.

Figures 1, 2, 3, 4, 5, 6, 7, 8:
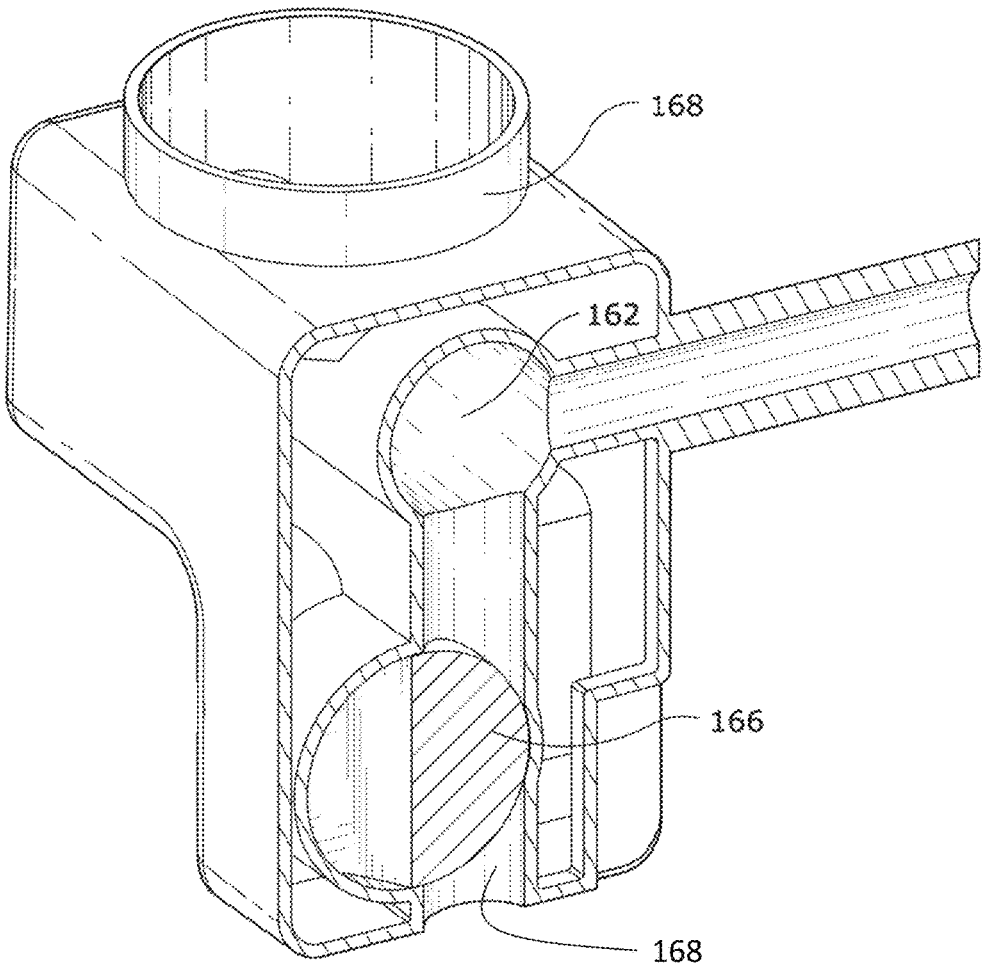

FIGS. 7-5 to 7-8 show pairs of dispensing caps 921 according to various embodiments of the present invention. These caps provide various flow distributions to the water exiting the caps, and in some embodiments are tailored to varying requirements for an individual eye, and in other embodiments for varying requirements to the pair of eyes presented on the user face.

FIG. 7-5 shows right and left dispensing caps 921-1. Each of these dispensing caps includes a plurality of flow apertures adapted and configured to provide increased flow rates of filtered water toward the center of a user's eye. It can be seen that the plurality include an outermost portion 921*b* of relatively smaller apertures. That plurality of smaller apertures in some embodiments is oriented in a ring around a plurality of apertures 921*c* that are generally larger (i.e. either increased area, increased flow number, or a combination of the two). Therefore, dispensing caps 921-1 provide a flow pattern that is tailored for individual eyes with the flow in the center of each pattern being higher than the flow toward the periphery of the pattern. FIG. 7-6 shows right and left dispensing caps 921-2 of the generally opposite configuration, such that the innermost flow apertures 921*b* are smaller than the flow apertures 921*c*.

FIGS. 7-7 and 7-8 show arrangements of flow apertures adapted and configured to consider the user's face as a whole. Right and left dispensing caps 921-3 each include a plurality of smaller size (or lower flow) apertures arranged centrally toward the centerline of the supporting outlet valve 960 (not shown). The outermost flow apertures are of a larger size (or high flow), and shown as flow apertures 921*c*. The right and left dispensing caps 921-4 of FIG. 7-8 show a generally opposite orientation. The higher flow apertures 921*c* are oriented toward the centerline of the output valve, and the lower flow apertures are located away from that center line.

FIGS. 7-9, 7-10 and 7-11 depict various aspect of a shower head assembly 1080 according to another embodiment of the present invention. FIGS. 7-9 and 7-10 show the dispersing member 1084 and central deflector 1086. FIG. 7011 shows the central deflector 1086.

FIGS. 7-9 and 7-10 show a dispersing member 1084 including a plurality of flow apertures 1087. Some of these flow apertures are aligned to receive flow more directly from certain flow apertures 1086*a* of a central deflector 1086. Referring to FIG. 7-10, it can be seen that when central deflector 1086 is aligned within standoff 1085*b*, that flow apertures 1086*a*-1 is angularly aligned with a corresponding aperture 1087*a*-1 of member 1084. It can also be seen that there is a second pair of similarly, angularly aligned flow passages 1086*a*-2 and 1087*a*-2. Central standoff 1086 and member 1084 likewise share a third pair of angularly aligned flow apertures 1086*a*-3 (as best seen in the top of FIGS. 7-11A) and a corresponding flow aperture 1087*a*-3. Preferably, the three pairs of aligned apertures (-1, -2, and -3) are spaced apart equally, at 120° increments to provide an unexpectedly superior balance of the total flow exiting from member 1084. It has been found that dispersing members that are not aligned with the outlet member have insufficient flow toward the center part of the flow member, thus depriving the user of sufficient emergency wash in the center of the shower area (which is often pointed at the area of the user most in need of the emergency shower). This alignment between flow apertures 1086*a* and 1087*a* is achieved by a pair of indexing features 1085*b* and 1086*b*. In one embodiment, the central standoff post of deflector 1086 includes a male alignment feature 1086*b* that is received within a female alignment feature 1085*b* of the central standoff 1085. Member 1084 includes a plurality of other standoffs 1085 for alignment of member 1084 with a bowl 1082 (not shown).

FIGS. 7-11B, C, D, and E show line drawings of the apparatus of FIGS. 7-9 and 7-10. It can be seen that the shower head assembly in one embodiment of the present invention includes three passageways (-1, -2, and -3) that have a line of sight from the inlet through deflecting member 1086 and through dispersing member 1084. Therefore, some of the water entering the shower head assembly from the inlet impinges directly upon the flattened mushroom-head of deflector 1086, but passes through apertures 1086*a*-1, -2, and -3. Referring to FIG. 7-11D, it can be seen that a portion of the flow areas of apertures 1086 area aligned with the larger flow areas of the three corresponding flow passages 1087. It is through these overlapping flow areas that water can flow directly in a line of sight from the inlet to the user. However, it can also be seen that the apertures 1086 describe an area having a different portion that results in water from the inlet impinging on the boundaries 1087*c* of the corresponding aperture 1087*a*. Thus, some of the water that enters through the inlets passes through the apertures of the mushroom-head, but are then deflected by the circumferentially inner-most boundary of the underlying aperture of the dispersing member 1084.

FIGS. 7-12 and 7-13 depict various views of portions of an eye wash system 1120 according to another embodiment of the present invention. Eye wash 1120 is generally similar to eye wash systems X20 shown herein, including a shut off paddle 1152 that actuates a shut off valve for the supply of water to an outlet valve 1160. Outlet valve 1160 includes a pair of dispensing caps 1121L and 1121R that provide a flow of water to left and right eyes of a user.

Valve 1160 includes a visual indicator 1198 that assists the user in aligning his eyes for proper orientation with the dispensing caps 1121. As best seen in FIG. 7-13, visual indicator 1198 in one embodiment includes a light source 1198*a*, such as an LED. LED 1198*a* is operatively connected to a sensor 1198*c* that receives electrical power from a battery 1198*b*. Sensor 1198*c* in some embodiments is a sensor and switch that is normally open between leads, but closes the connection in the presence of water. For example, when the shut off valve 1150 is opened and water fills up internal chamber 1162, sensor 1198 closes its circuit in response to being wet and thereby provides a voltage to LED 1198*a*. Light from LED 1198*a* is visible to the user and identifies to the user the vertical center line (VCL) of valve 1160. The user recognizes that this light should be generally centered, and is thereby given a visual cue as to proper alignment of the user's head. In yet other embodiments, sensor 1198*c* is of the positional type and senses a change in the position of the shut off valve from the closed to the open state.

FIG. 7-14 shows an eyewash system 1220 according to another embodiment of the present invention. Eyewash 1220 is similar to the eyewash systems X20 discussed herein except for including visual indicators 1298. Eyewash 1220 includes a return wash basin 1270 and a paddle shut off 1252 that also function as visual indicators 1298*d*-1 and 1298*d*-2, respectively. In one embodiment, basin 1270 is molded from a plastic material that incorporates a phosphorescent pigment, such as strontium alum inate, zinc sulfide, or similar materials that act as photoluminescent phosphors. In some embodiments the phosphorescent material is incorporated into the plastic during the molding procedure.

Paddle shut off 1252 also uses a phosphorescent material 1298*d*-2 to emit light. In some embodiments, the phosphorescent material is mixed into the plastic base material, whereas in other applications the phosphorescent material is applied as a paint (either to a plastic base material or a metallic base material).

The use of photo luminescent materials in eyewash basin can be helpful during any emergency situation, and especially those emergencies in which the need for the user to wash off is accompanied by a loss of power and subsequent darkness. In such cases, eyewash system 1220 is visible from a distance, with the phosphorescent glow of the basin 1270 and paddle 1252 persisting long enough to aid a user in determining the location of the emergency washbasin. It is further understood that any of the various components of the washbasin can be constructed with a phosphorescent material or coated with a phosphorescent material.

FIGS. 7-15 and 7-16 depict various views of portions of an eye wash system 1120' according to another embodiment of the present invention. Eye wash 1120' is generally similar to eye wash systems X20' shown herein, including a shut off paddle 1152' that actuates a shut off valve for the supply of water to an outlet valve 1160'. Outlet valve 1160' includes a pair of dispensing caps 1121L' and 1121R' that provide a flow of water to left and right eyes of a user.

Valve 1160' includes a visual indicator 1198' that assists the user in aligning his eyes for proper orientation with the dispensing caps 1121'. As best seen in FIG. 7-16, visual indicator 1198' in one embodiment includes a light source 1198*a*', such as an LED. LED 1198*a*' is operatively connected and receives electrical power from a photocell 1198*b*'. Photocell 1198*b*' converts incident radiation to electrical power, and provides that electrical power to LED 1198*a*'. In one embodiment, photocell 1198*b*' can be a component similar to a silicone photodiode, such as a BPW34 photodiode made by Vishay Semiconductors. Photocell 1198*b*' converts incident radiation (such as visible radiation) within the environment of apparatus 1120', and converts it to power sufficient to drive LED 1198*a*'. In still further embodiments, the light source is provided by a source of electrical power from a junction of dissimilar materials that is heated (a thermoelectric effect). Still further embodiments of the present invention contemplate any manner of providing electricity to drive the visual indicator.

FIG. 7-15 shows the photocell and LED packaged within a housing 1198*e*', and covered with a coating 1198*f*'. In this particular embodiment, the light source is self-contained with a power source in a water-resistant package. In one embodiment, the encapsulation material 1198*f*' is a material such as one of the parylenes, which provides both a water-resistant seal and also high transmissibility of visible radiation. In some embodiments, the light source sits within a cavity of the body 1161', and can be replaced without removing the outlet valve 1160' from the eyewash system 1120'.

Light from LED 1198*a*' is visible to the user and identifies to the user the vertical center line (VCL) of valve 1160'. The user recognizes that this light should be generally centered, and is thereby given a visual cue as to proper alignment of the user's head. In yet other embodiments, sensor 1198*c*' is of the positional type and senses a change in the position of the shut off valve from the closed to the open state.

It will be further understood to persons of ordinary skill in the art that the position of visual indicator 1198*f* is not limited to the space between adjacent groupings of right and left flow orifices, as shown in FIGS. 7-12 and 7-16, but further could be centrally located (preferably along center line (VCL) relative to a contiguous area of flow apertures (such as apertures 1521*a* of FIG. 8-5). It can be seen that the apertures 1521*a* span an area, and a visual indicator is preferably aligned along the center of that area. It is further understood that the visual indicator can be located within that area, but further could be located slightly outside that area, and still providing a visual indication to the user as to how to locate his eyes for emergency washing. Further, those of ordinary skill in the art will understand that although various embodiments shown herein include upwardly oriented flow apertures that are generally arranged symmetrically about centerline VCL, it is further possible to orient the right and left eyewash groupings (or a contiguous area) with a lateral offset from centerline VCL.

FIGS. 8-1 through 8-8 depict still further embodiments of the present invention directed toward emergency eyewash apparatus and methods. Those of ordinary skill in the art will recognize that the embodiments described and shown herein are further applicable to residential washing apparatus and methods, including for the face and hands in a bathroom or kitchen setting. It will be seen that various features and aspects of these eyewash systems (1320, 1420, and 1520) share various features and aspects common with other eyewash systems disclosed herein (including, as examples, a source of water, shut-off valve, and catch basin), while including different apertures, outlets, and functions that provide water for the use of the user. Those of ordinary skill in the art will readily recognize equivalents to these components that are typically used in a residential system, such as the type of shutoff valves (both mechanical and electronic) used in bathroom and kitchen applications, and further the sinks used in such residential applications.

FIGS. 8-1 and 8-2 show various aspects of an eyewash system 1320 according to one embodiment of the present invention. System 1320 includes a valve assembly 1360 that comprises an inner member 1363 that is coaxially received within an outer member 1361. Outer member 1361 includes a plurality of flow orifices 1321*a*L directed generally toward the left eye of the user, and a second, axially and circumferentially spaced apart second set of flow apertures 1321*a*R directed generally at the user's right eye. Outer member 1361 further includes a flow outlet 1321*d* directed to provide flow in a direction generally orthogonal to the direction of flow from apertures 1321*a*. However, as will be described, valve assembly 1360 is adapted and configured such that water is provided either to apertures 1321*a*, or to flow outlet 1321*d*, but not to both at the same time.

Valve assembly 1360 preferably includes at least two water-handling components. An inner member 1363 is located at least partly within an outer member 1361. In some embodiments inner member 1363 includes a portion that is exterior to outer member 1361. This exterior portion is inserted into a fitting of system 1320, this fitting receiving water from the shut-off valve. The exterior portion of inner member 1363 includes one or more features that register valve 1360 relative to the fitting. A complementary-shaped set of registration features are located within the attachment fitting, and this complementary-shaped set is held fixed relative to the shut-off valve attachment fitting. Therefore, once the exterior portion of the inner member is inserted into the fitting, the registration features prevent rotation of the inner member.

The inner member receives water from the shut-off valve, and provides that water to one or more circumferential locations and on the inner member. The outer member can be rotated relative to these locations provided with water, such that some of the flow apertures and orifices of the outer member are receiving water, while other apertures or orifices are not receiving water. Preferably, the inner member is held in a static position by eyewash system 1320 so that the user can use a single hand to rotate the outer member, without needing to hold onto the inner member. Preferably, the inner member is held in a fixed position relative to the basin 1370 or relative to the stand holding the basin. Therefore, as the user uses his hand to rotate the outer member of valve 1360, the basin or stand hold the inner member static.

Valve assembly 1360 further includes an inner member 1363 having a flow passage 1362 that provides water from a fitting 1323 that in turn is provided with water from shut-off valve 1350. It is understood that passageway 1362 can receive water from any of various components or fittings, and including in some embodiments from the quick connect "shark fin" hydraulic coupling described elsewhere herein. However, it is also understood that the water provided to passageway 1362 could come from a thermostatically controlled valve, a flow regulating valve, and the like. Further, although passageway 1362 is shown as a single passageway extending through the center of inner member 1363, it is further understood that the provision of water from the shut-off valve could be provided to flow passages of other shapes, and further to flow channels formed between the outer periphery of inner member 1363 and the inner surface of outer member 1361.

As best seen in the top of FIG. 8-2, outer member 1361 is oriented such that flow is provided to the plurality of apertures 1321*a* identified schematically in FIGS. 8-2. The apertures 1321*a* are generally aligned and therefore in fluid communication with inner passage 1362. However, one or more sealing surfaces are located between the outer surface of inner member 1363 and the inner surface of outer member 1361, such that flow exiting inner passage 1362 is not communicated to flow passage 1321*d* in the first eyewash and face wash position shown at the top of FIG. 8-2.

The bottom schematic of FIG. 8-2 shows a cross section of valve 1360 after outer member 1361 has been rotated counterclockwise by about ninety degrees. Since the inner member 1363 is held statically in a generally fixed position by the structure of eyewash system 1320, the counterclockwise rotation of outer member 1361 results in a movement of flow orifice 1321*d* to a bottommost position in which it achieves fluid communication with inner flow passage 1362. Flow from the shut-off valve is free to pass through inner passage 1362, and flow out of the preferably aerated flow nozzle receiving water from flow orifice 1321*d*. As shown in position 2, water from the shut-off valve flows directly toward basin 1370. In this location, the water could be used to wash the user's hands, to flow into a cup for drinking, or for other purposes. However, the sealing surfaces between inner member 1363 and outer member 1361 shut off the flow of water to the washing apertures 1321*a*, now located on the side of valve assembly 1360.

FIGS. 8-3 and 8-4 depict a washing system 1420 similar to system 1320 discussed above. As best seen in FIG. 8-3, outlet valve 1460 includes a plurality of flow apertures 1421*a* aimed generally upward, and in flow orifice 1421*d* oriented in a lateral direction.

Figures 1, 8:
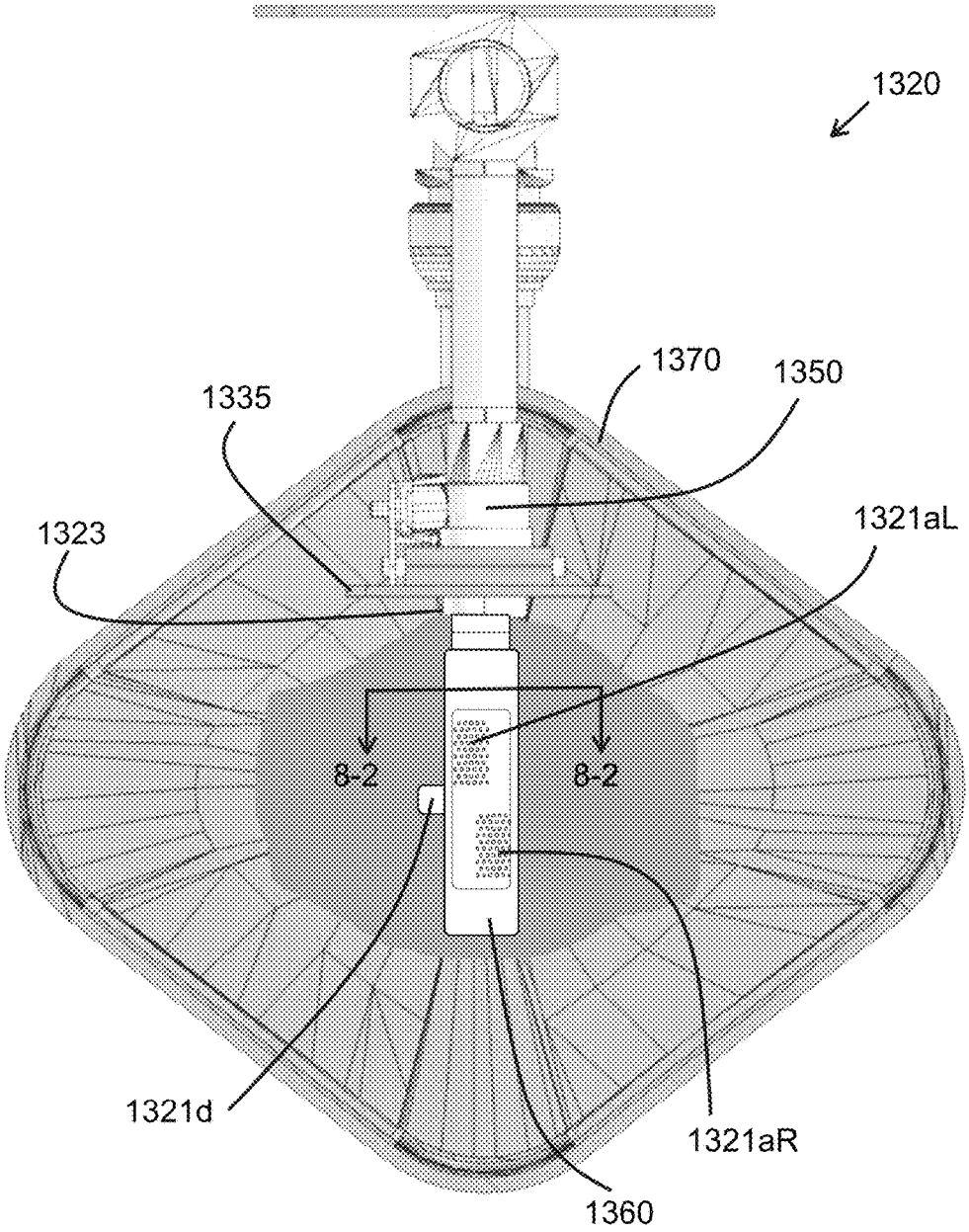
Figures 2, 8:
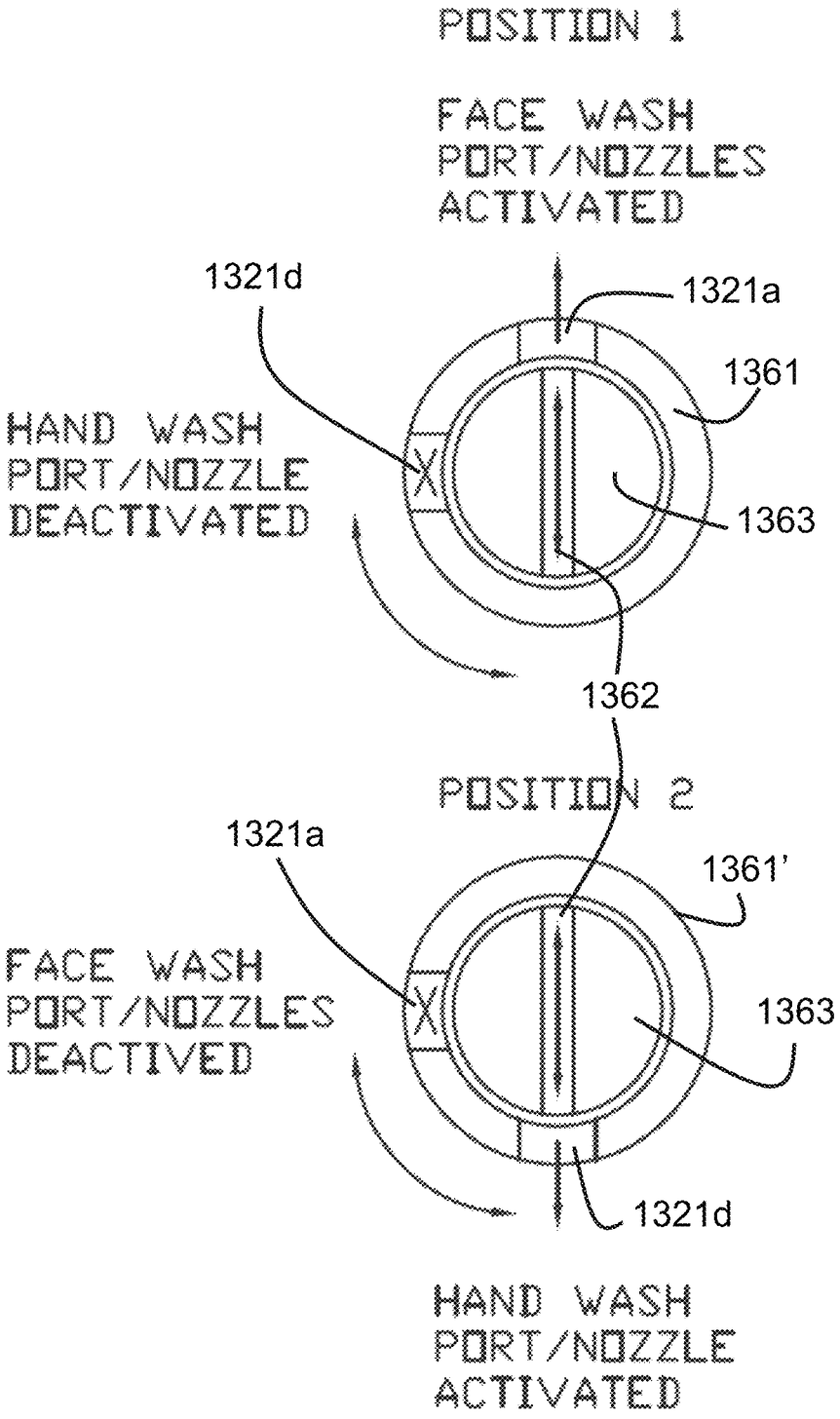
Figures 3, 8:
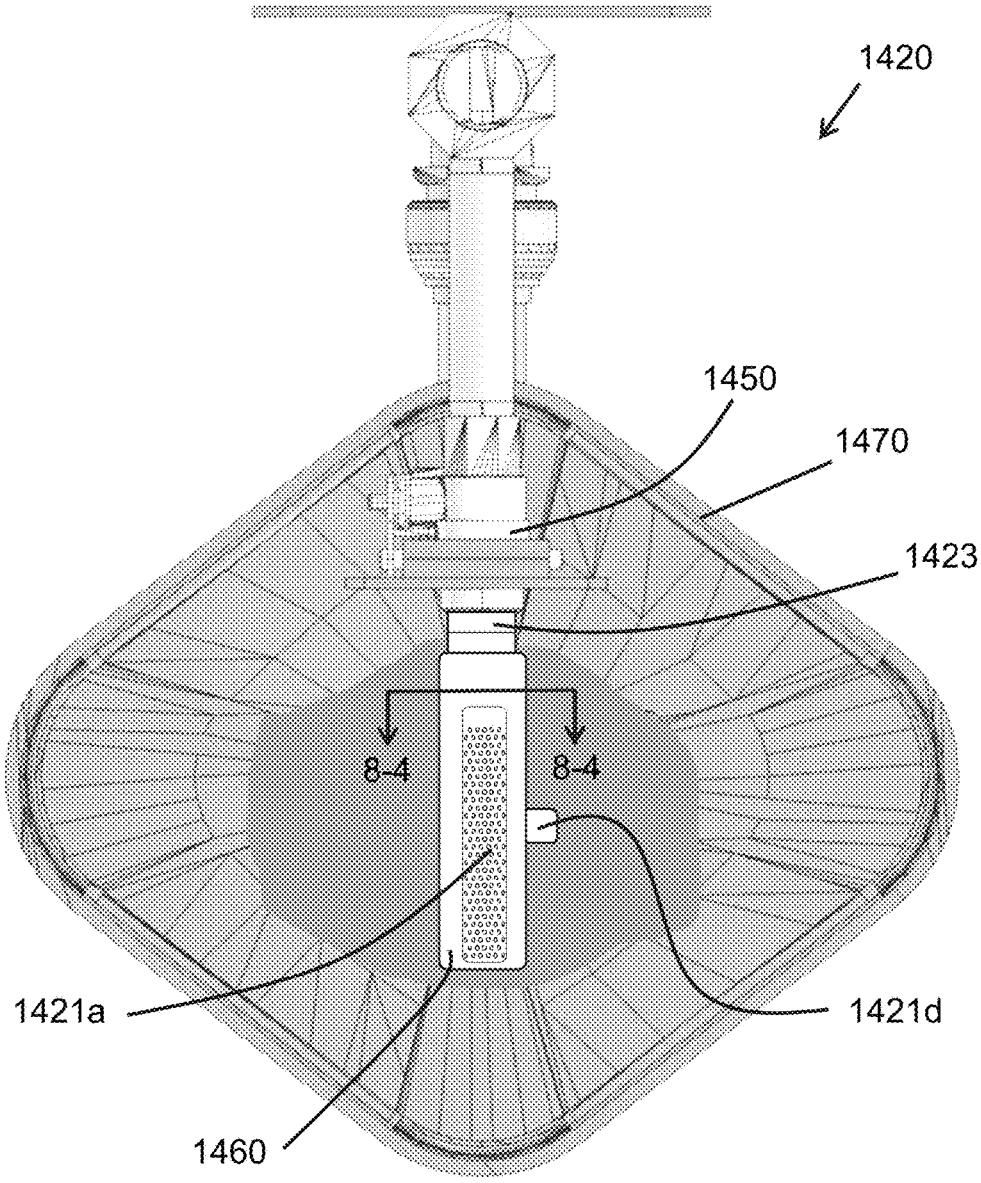
Figures 4A, 8:
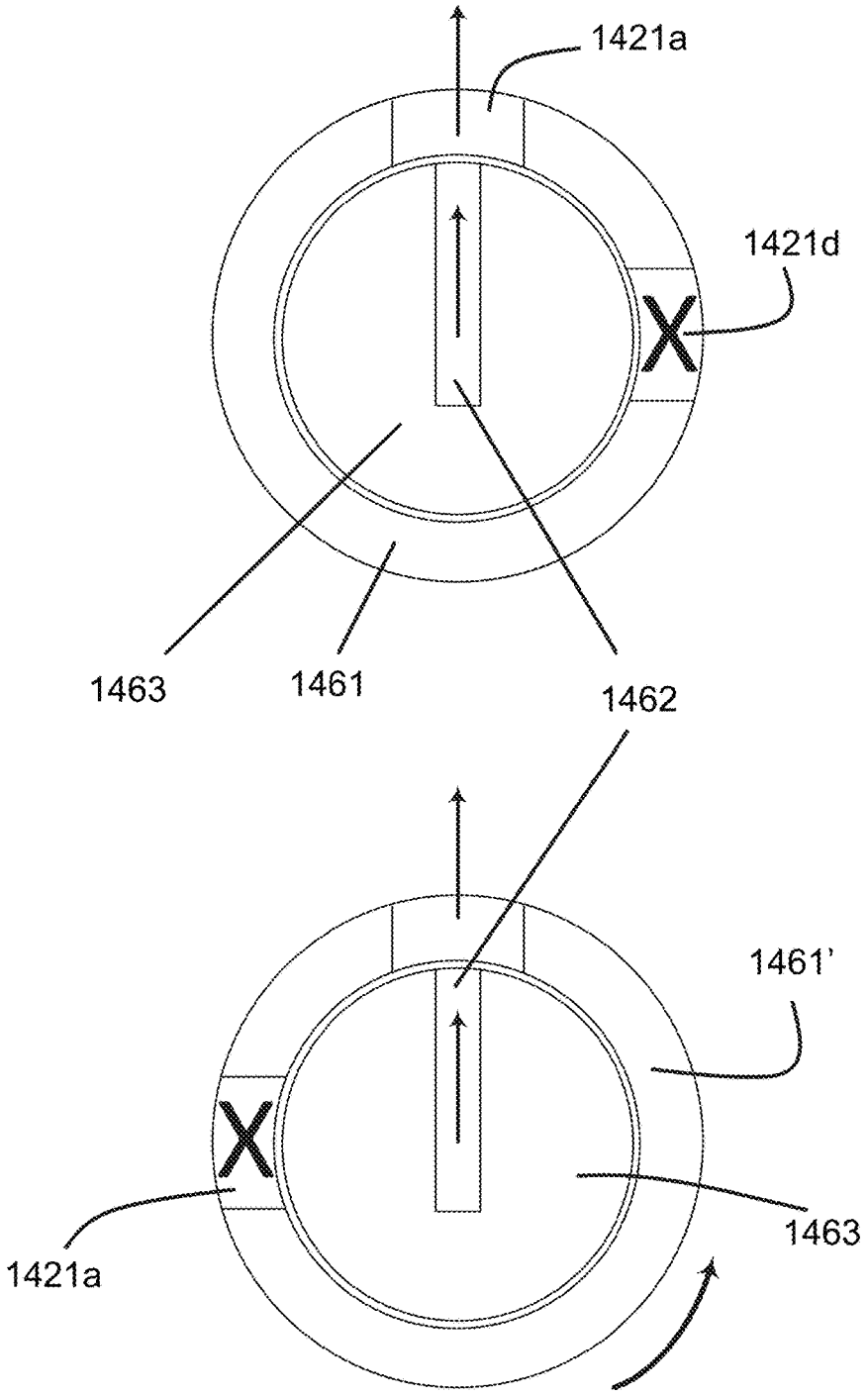

Referring to FIG. 8-4A, it can be seen that fixed inner member 1463 includes an inner flow passage 1462 that extends generally toward one surface of inner member 1463. As seen in the top figure, in first position the apertures 1421*a* are in fluid communication with and receiving water from inner passage 1462. Referring to the bottom figure of FIG. 8-4, it can be seen that outer member 1461 has been rotated about 90 degrees counterclockwise, such that a flow orifice 1421*d* now receives water from inner passage 1462. Still further, the flow of water has been cut off from apertures 1421*a*, which are now oriented laterally on valve 1460.

Figures 4B, 8:
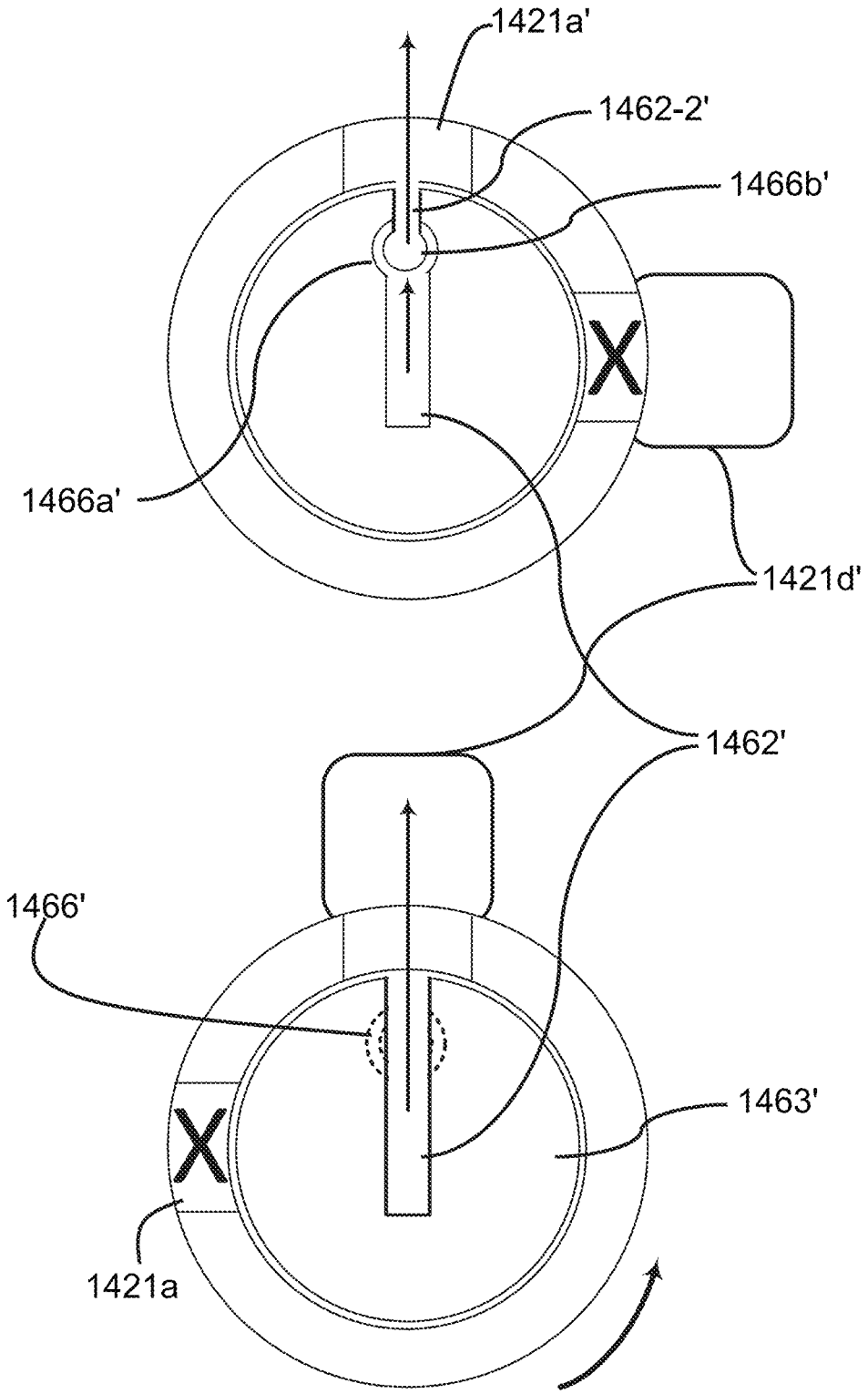
Figures 5, 8:
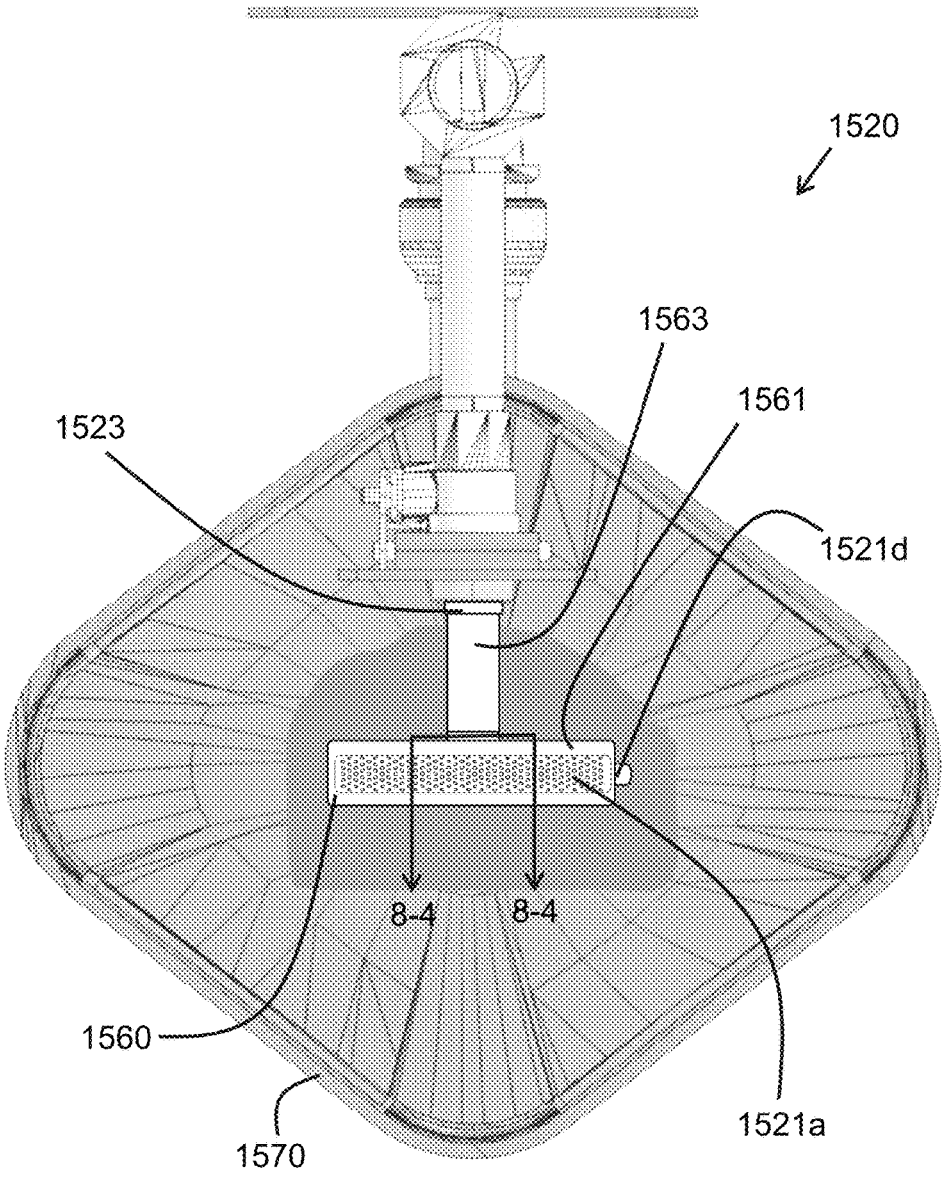
Figures 6, 8:
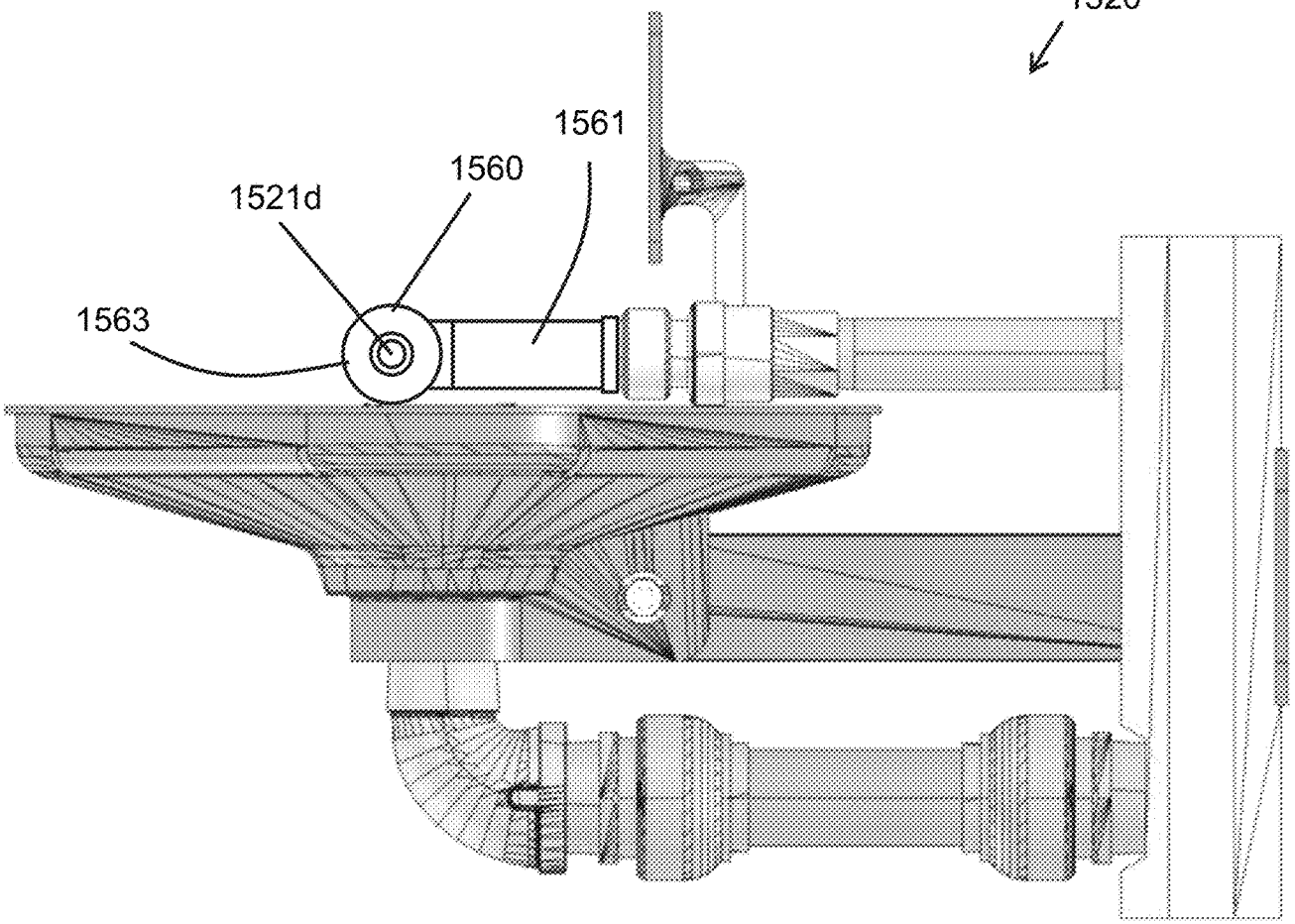
Figures 7, 8:
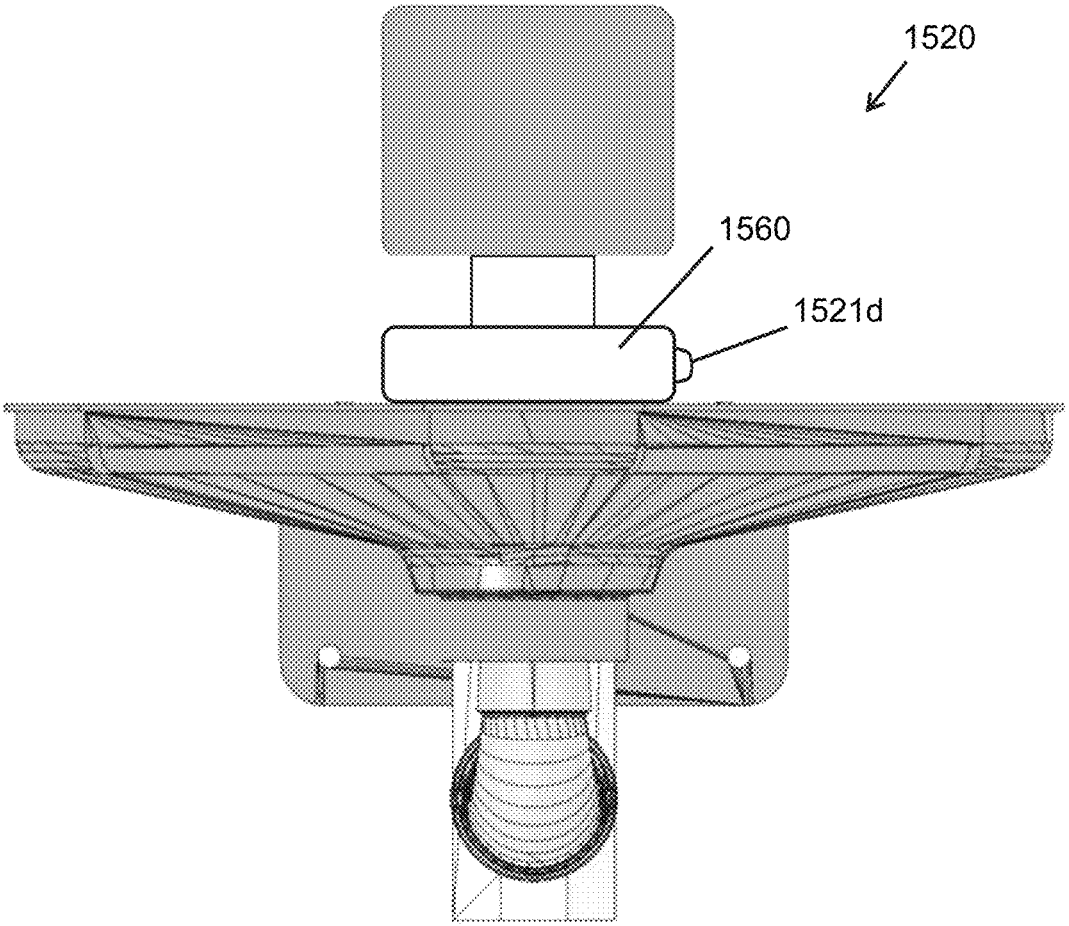
Figure 8:
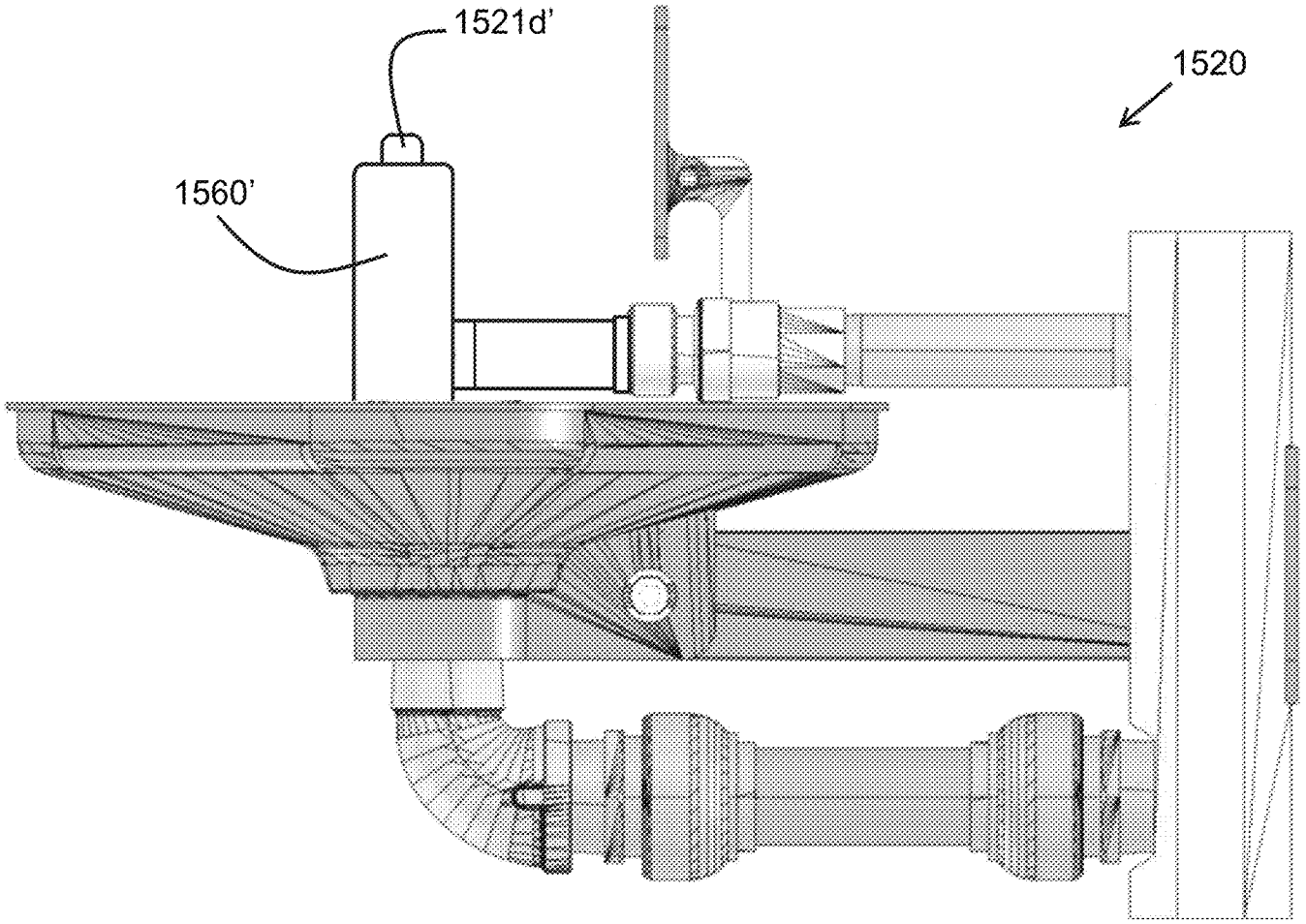
Figures 8, 9:
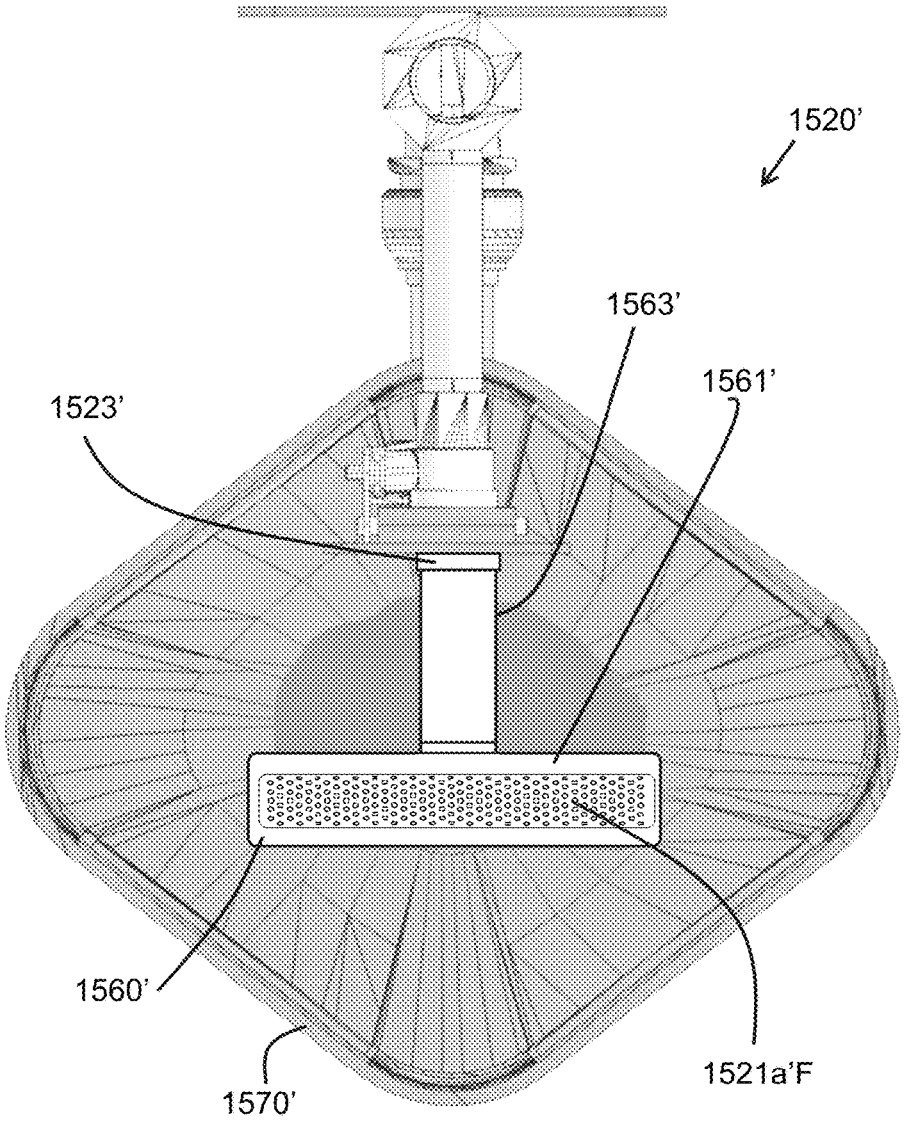
Figures 8, 9, 10:
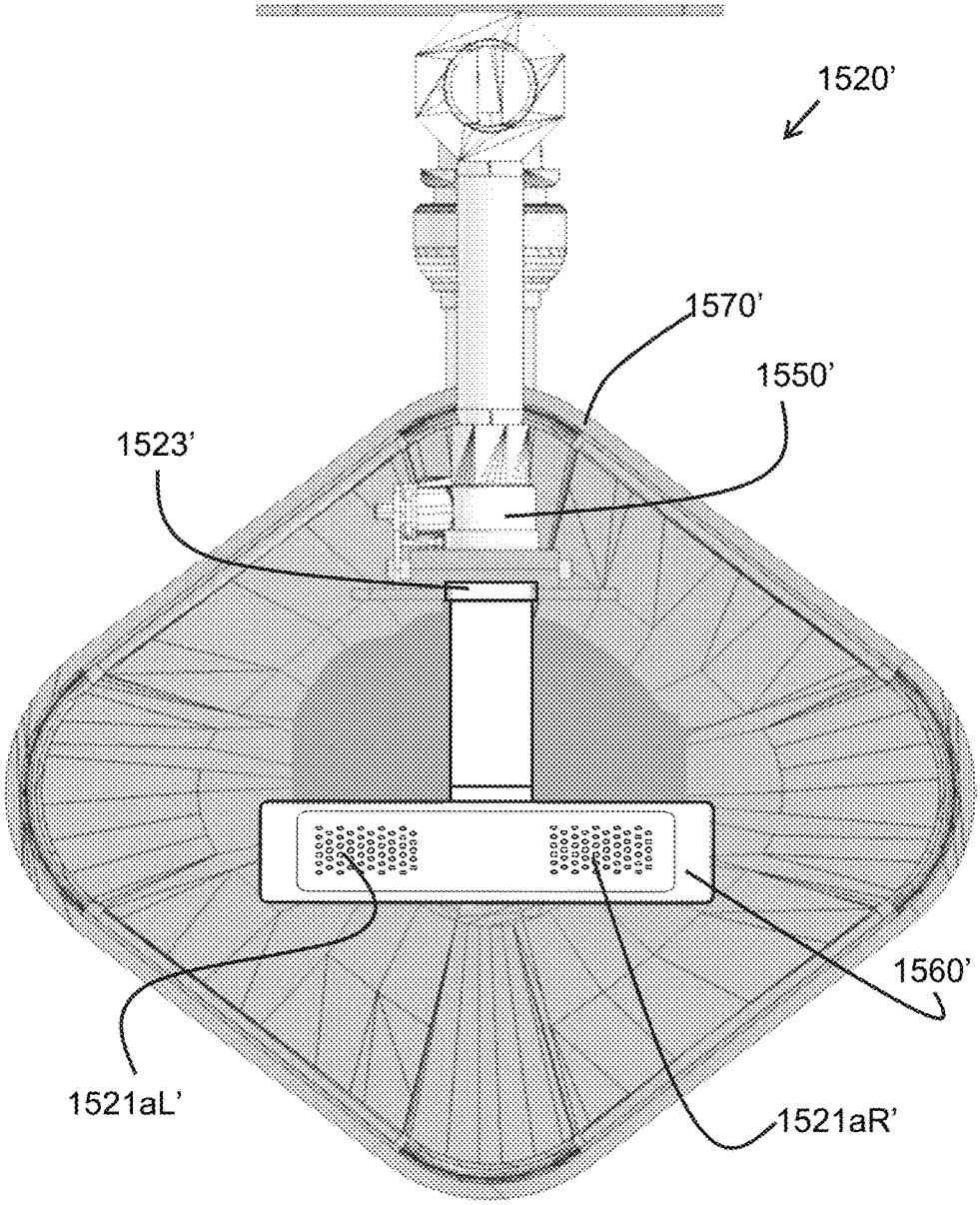
Figures 8, 9, 10, 11:
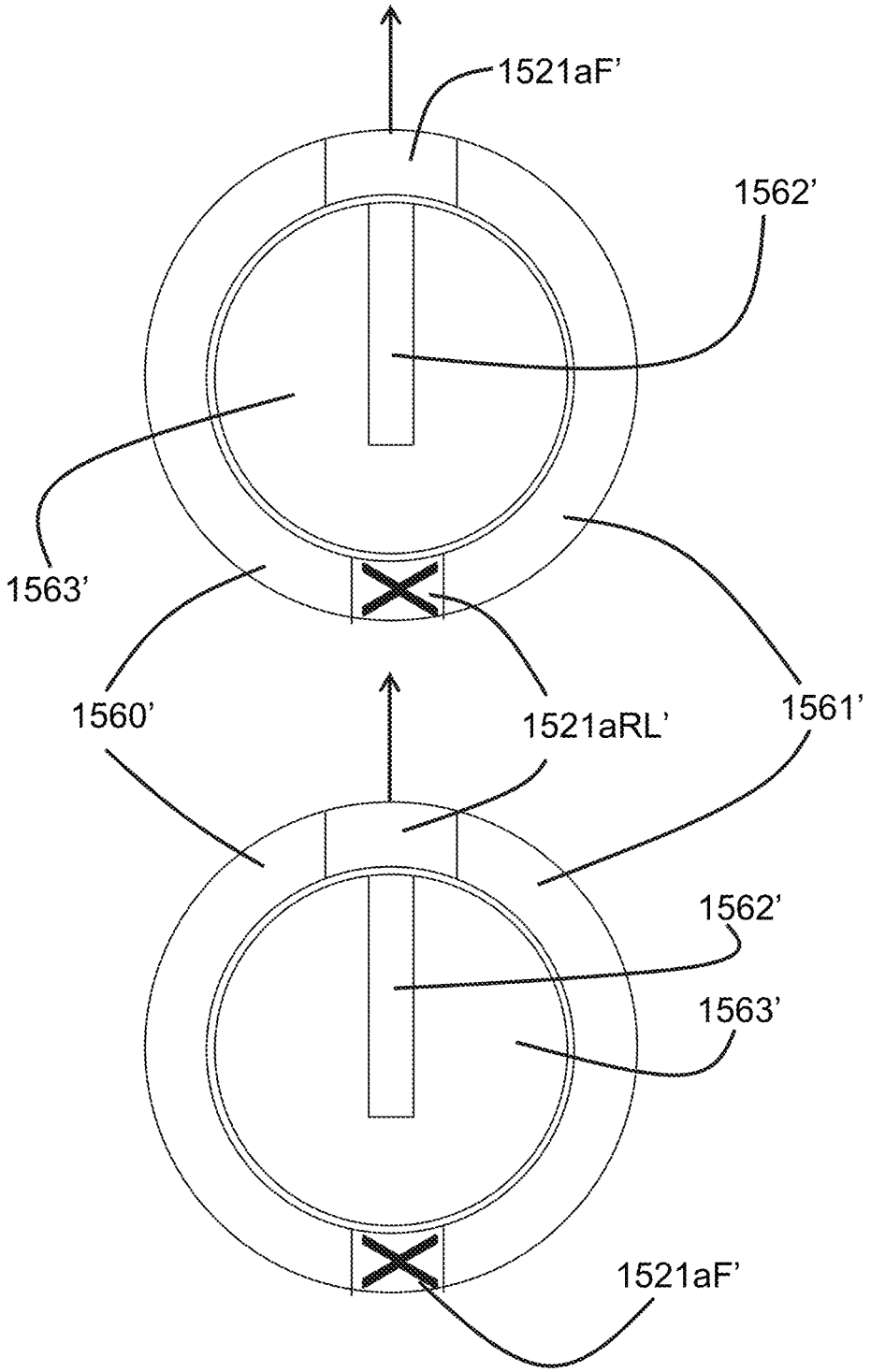
Figures 1, 9:
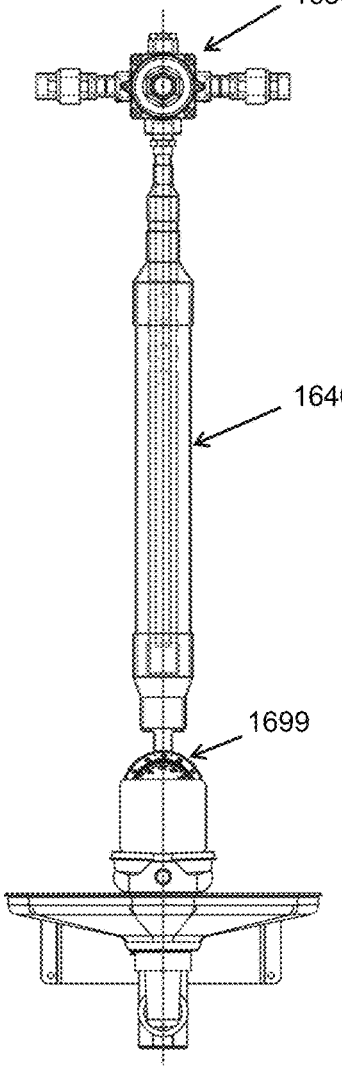
Figures 2, 9:
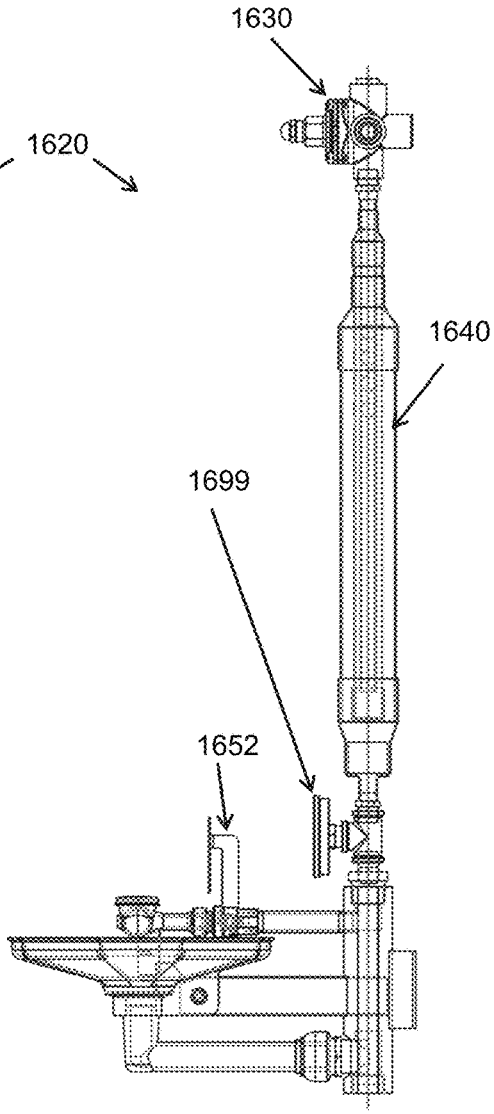

An alternative flow circuit can be seen in FIG. 8-4B. Various embodiments of the present invention include an alternative configuration in which there is a flow control valve 1466' that limits the amount of water flowing from the face wash or eyewash apertures to a predetermined range. In some of these embodiments, the internal chamber 1462' (that extends within water inlet 1463') extends a first length, at the end of which it provides fluid communication to aerator 1421*d'*, as shown in the bottom view. However, this internal chamber extends a second length (past the port providing fluid communication to the aerator) to an internal flow control valve 1466'. Water is provided through this extension of inlet 1462' to, in some embodiments, the fixed member 1466*a'* of the flow control device 1466'. The variable member 1466*b'* is in fluid communication with a flow passage extension 1462-2' that provides the limited range of flows to the eyewash apertures 1421*a'*, as shown in the top view. In some embodiments, the flow controlling device 1466 can further be a simpler fixed orifice or other means for reducing flow.

In these embodiments, the flow provided to the eyewash nozzles (which is primarily directed vertically upward) has an upper limit of water flow that is less than the water flow provided to the aerated nozzle. In this manner, the full flow of aerated water typically expected by a user is provided through the aerated nozzle, but a lesser flow is provided for face washing, so as to keep the upward flow from extending too high and causing spillage. It is understood that the embodiment shown in FIGS. 8-4*a* and 8-4*b* shows the aerated nozzle pointed vertically upward. Yet other embodiments are contemplated herein in which the flow of the aerated nozzle is provided vertically downward for washing of the user's hands.

FIGS. 8-5 to 8-8 show a washing system 1520 according to another embodiment of the present invention. System 1520 includes an inner member 1563 and outer member 1561 that are generally T-shaped. A plurality of apertures 1521*a* extend generally along the outer surface of valve 1560, in a pattern that extends across a portion of the cross sectional circumference, and generally along the length of the cylindrical shape parallel to the centerline of the outer member 1561. The inner member 1563 of system 1520 includes an interior portion that extends at least partly within the outer member 1561, so as to provide water to either of the flow outlets 1521*a* or 1521*b*. However, a portion of the inner member 1563 can have, in some embodiments, an exterior surface that is attachable by way of a shark fin or similar quick connect coupling 1523 to a complementary quick connect fitting, such that the exterior portion of inner member 1563 held in a fixed orientation relative to the basin 1570 or the stand of system 1520 as sealed and connected to a fitting of system 1520.

FIGS. 8-6 and 8-7 show orthogonal representations of the apparatus 1520 shown in FIG. 8-5. FIG. 8-8 shows the valve 1560 rotated 90 degrees to a location in which water is provided to a flow outlet 1521*d*, and not to the flow apertures 1521*a*. Referring to FIG. 8-5, a cross sectional view of the apparatus of FIG. 8-5 is similar to the cross sectional view shown in FIG. 8-4 or 8-2 (except as modified for the particular orientations of flow outlets in system 1520).

FIGS. 8-9, 8-10, and 8-11 show a washing system 1520' according to another embodiment of the present invention. In some embodiments, washing system 1520' is adapted and configured to provide either an emergency facewash or an emergency eyewash, depending upon how the user has oriented the outer member 1561' of valve 1560' relative to an inner member 1563'. System 1520' includes an inner member 1563' and outer member 1561' that are generally T-shaped, but those of ordinary skill in the art will recognize combinations of inner members and outer members that may be in substantial alignment, Y-shaped, U-shaped, and other arrangements.

A plurality of facewash apertures 1521*a*F' extend generally along one side of the outer surface of valve 1560', in a pattern that extends across a portion of the cross sectional circumference, and generally along the length of the cylindrical shape perpendicular to the centerline of the outer member 1561'. A second plurality of apertures 1521*a*R' and 1521*a*L' extend generally along the opposite side of the outer surface of valve 1560', in a pattern that extends across a portion of the cross sectional circumference, generally along the length of the cylindrical shape parallel to the centerline of outer member 1561', and in left and right groupings that provide eyewashing to the corresponding left and right eyes.

The inner member 1563' of system 1520' includes an interior portion that can extend at least partly within the outer member 1561', so as to provide water to flow outlets 1521*a*F'. However, a portion of the inner member 1563' can have, in some embodiments, an exterior surface that is attachable by way of a shark fin or similar quick connect coupling 1523' to a complementary quick connect fitting, such that the exterior portion of inner member 1563' held in a fixed orientation relative to the basin 1570' or the stand of system 1520' as sealed and connected to a fitting of system 1520'.

Those of ordinary skill in the art will recognize that the description provided herein is further applicable to those washing systems 1520' that include a set of flow apertures 1521*a*F' that can be used (as shown in FIG. 8-5) for a first, relatively larger upward spray pattern adapted and configured to provide an upward flow of water suitable for washing the users face. The apparatus 1520' further includes a second set of flow nozzles 1521*a*R' and 1521*a*L' (similar to those best seen in FIG. 8-1), but located on the opposite side of body 1561', such that rotation of body 1561' about the axis defined by water inlet 1563' results in an upward spray in two discrete sprays, and suitable for washing of the user's eyes.

FIG. 8-11 schematically depicts an interface between the water inlet and the apertures of the outlet valve 1560' according to one embodiment of the present invention. It can be seen in the top view that the outer member of valve 1560' has been rotated such that the face washing orifices 1521*a*F' are pointed generally upward, and are in fluid communication with an internal chamber 1562' that receives water from the outlet of the shutoff valve 1550'. In the configuration shown in the top of FIG. 8-11, water is not able to flow into the downward-directed fittings 1521*a*RL'. However, as best seen in the bottom view of FIG. 8-11, the body 1561' can be rotated about the axis of its interface with the water inlet 1563', such that the right and left flow apertures 1521*a*R' and 1521*a*L' are in fluid communication with the internal passageway 1562'. However, as shown in the bottom of FIG. 8-11, water is not able to flow downward through the face wash orifices 1521*a*F'.

Referring to FIG. 8-11, it can be seen that fixed inner member 1563' includes an inner flow passage 1562' that extends generally toward one surface of inner member 1563'. As seen in the top figure, in first position the apertures 1521*a'* are in fluid communication with and receiving water from inner passage 1562'. Referring to the bottom figure of FIG. 8-11, it can be seen that outer member 1561 has been rotated about one hundred eighty degrees counterclockwise, such that a flow orifice 1521*d'* now receives water from inner passage 1562'. Still further, the flow of water has been cut off from apertures 1521*a'*, which are now oriented laterally on valve 1560'.

Figures 1, 2, 3, 4, 5, 6, 7, 8, 9:
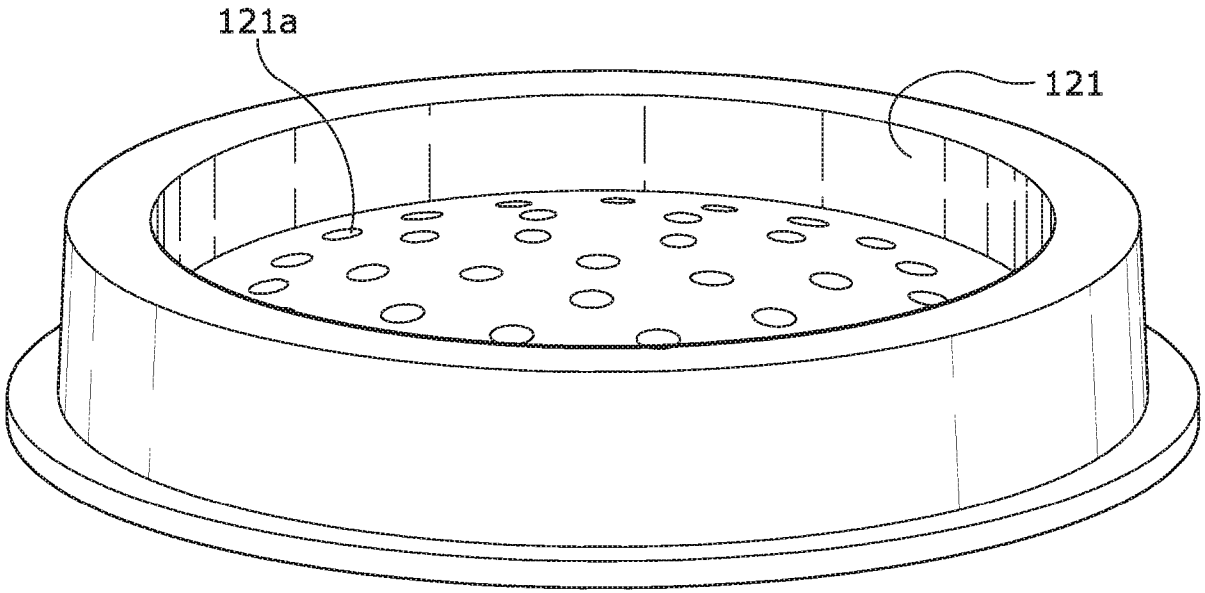
Figures 1, 2:
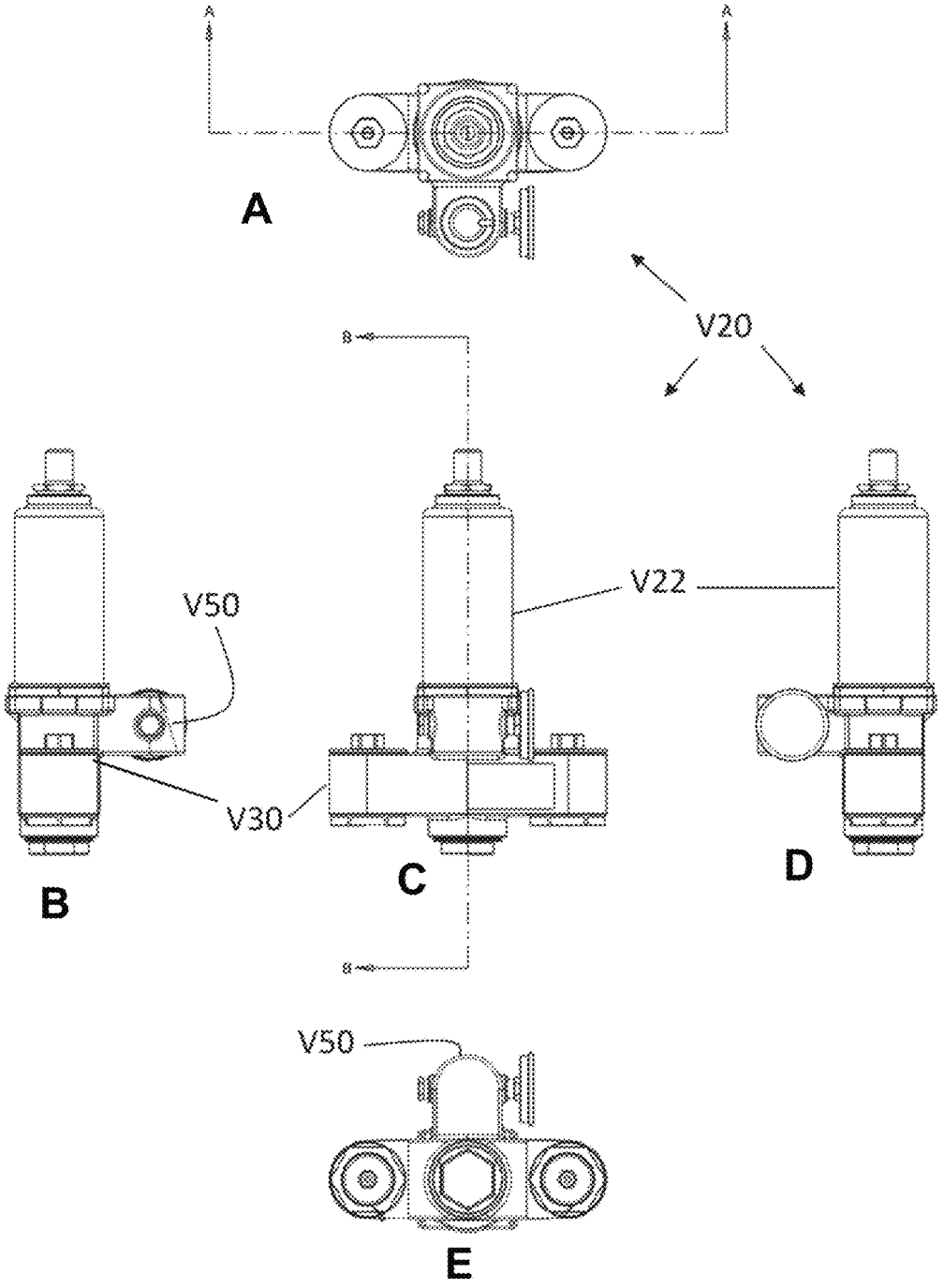
Figure 2:
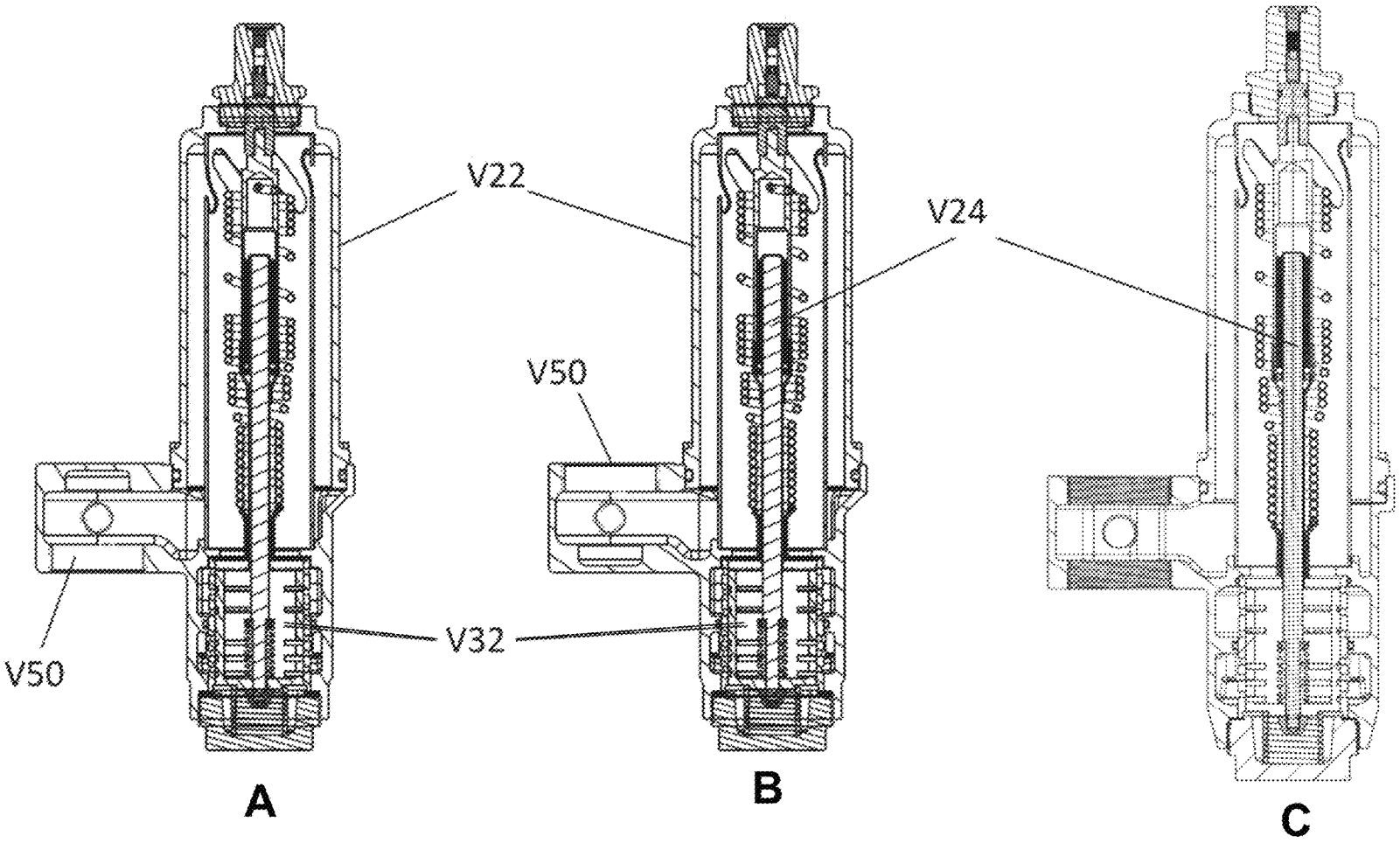
Figures 2, 3:
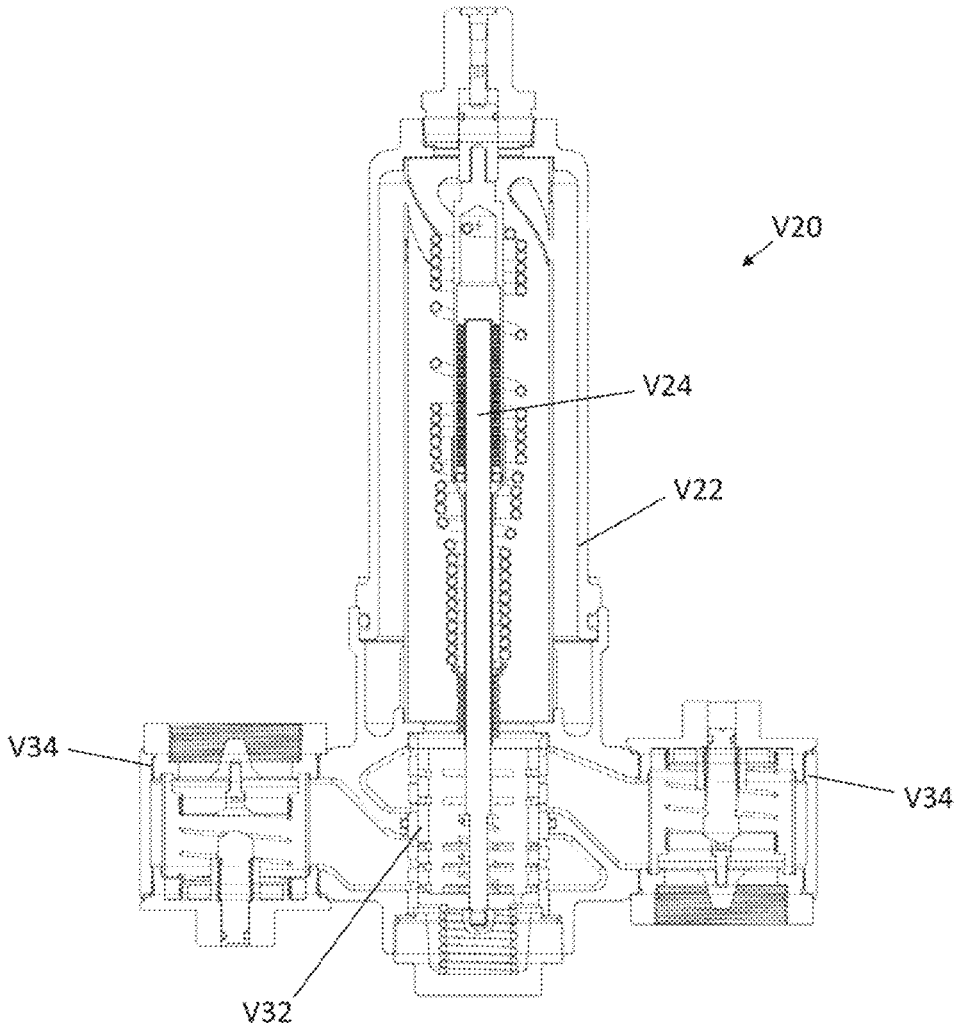
Figures 2, 3, 4:
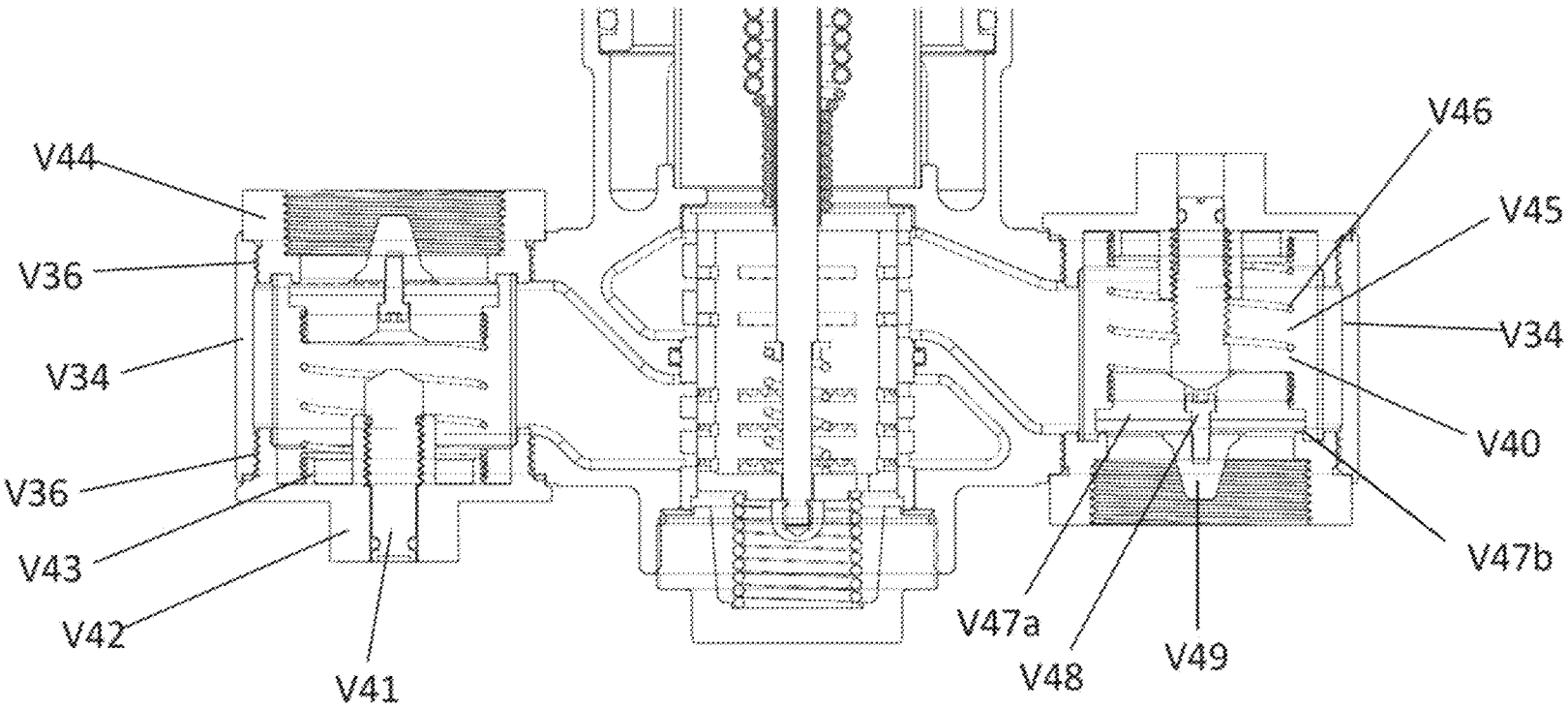

FIGS. 9-1 and 9-2 depict yet a further embodiment of the present invention directed toward emergency eyewash apparatuses and methods. It will be seen that various features and aspects of the depicted eyewash system (1620) share various features and aspects common with other eyewash systems disclosed herein (including, as examples, a source of water, shut-off valve, and catch basin), while including different features and functions that provide water for the use of the user.

FIGS. 9-1 and 9-2 show various aspects of eyewash system 1620 according to one embodiment of the present invention. System 1620 includes a thermostatically controlled valve 1630, a diffusing heat exchanger 1640, and a thermometer 1699. After a user presses paddle shut-off 1652 to initiate water flow to the eyewash during use, the water departing thermostatic control valve 1630 can initially be hotter than desired as the thermostatic control valve 1630 adjusts to regulate the water temperature. Diffusing heat exchanger 1640, which may include a tube-within-a-tube arrangement with optional horizontal passageways (e.g., apertures in the tubes) to enhance mixing, retains a reservoir of water downstream of thermostatic control valve 1630. Since the water in diffusing heat exchanger 1640 has typically been held within diffusing heat exchanger 1640 for a period of time, the water has typically adjusted to ambient/room temperature. The water in diffusing heat exchanger 1640 mixes with water leaving thermostatic control valve 1630, which tempers potential temperature spikes that may otherwise occur and assists in avoiding burning or scalding of the user.

Thermometer 1699 may optionally be included, and may be located downstream of the diffusing heat exchanger 1640 (i.e., between diffusing heat exchanger 1640 and the eyewash dispensing caps). When included, thermometer 1699 provides a convenient means by which a user (or a person assisting the user) can monitor the temperature of the water flowing to the dispensing caps.

Various aspects of different embodiments of the present invention are expressed in paragraphs X1, X2, X3, X4, X5, X6, X7, and X8 as follows:

X1. Once aspect of the present invention pertains to an apparatus for a washing system, comprising a housing including a water spray nozzle having a plurality of flow orifices oriented to provide substantially vertical flow of water, an inlet for receiving water, an internal chamber receiving water from the inlet and providing the water toward said flow orifices, a drain aperture located within the chamber adapted and configured for gravity-assisted draining from the bottom of the chamber, and a filter having an inlet side receiving water from the inlet and an outlet side providing filtered water, and said drain aperture is located to drain water that collects between said inlet of said housing and the inlet side of said filter.

X2. Another aspect of the present invention pertains to an apparatus for a washing system, comprising a housing including an inlet for receiving water, a water spray nozzle having a plurality of flow orifices adapted and configured to provide upward flow of water, the plurality of flow orifices extending across an area, a drainage basin having a water drainage outlet, said flow orifices being located above said basin, and a source of light located centrally relative to the area of the flow, said source being oriented to provide light toward the user.

X3. Yet another aspect of the present invention pertains to a method of water washing comprising providing a basin for collecting water, a water supply fitting having a fixed orientation relative to the basin, and a water nozzle housing adapted and configured to be grasped by the hand of a user and including a plurality of flow orifices and including an aerated nozzle, the flow orifices being spatially separated from the aerated nozzle, said housing being rotatably coupled to said supply fitting, flowing water from the plurality of flow orifices, rotating the nozzle about the fitting, turning off the flow of water by said rotating, and flowing water from the aerated nozzle after said turning off.

X4. Still another aspect of the present invention pertains to a water washing system, comprising a nozzle assembly having a generally cylindrical outer member, said assembly including an inner member defining a flow passage, the outer member being rotatable relative to the inner member, the outer member including a first plurality of spray apertures adapted and configured to spray water in a pattern suitable for washing the face of a human user and a second plurality of spray apertures adapted and configured to spray water in right and left fountains toward the corresponding right and left eyes of the user (or alternatively, an aerated nozzle in place of the right and left fountains), a basin for collecting water expelled from said nozzle assembly, a water shutoff valve for control of water from a source of water to a fitting, and wherein the fitting and inner member are fixedly coupled together such that rotation of the outer member relative to the inner member to a first position provides a flow of water from the first plurality of apertures and not from the second plurality (or alternatively, not from the aerated nozzle), and rotation of the outer member relative to the inner member to a second position provides a flow of water from the second plurality of apertures (or alternatively, from the aerated nozzle) and not from the first plurality of apertures.

X5. Yet another aspect of the present invention pertains to an emergency eyewash system, comprising a shutoff valve having an inlet for receiving a flow of water and an outlet providing the flow to an eyewash nozzle that directs the flow generally upwards, a thermostatically controlled valve having a first port receiving hot water, a second port receiving cold water, and a third port providing tempered water, and a mixing apparatus including a shell having an inner volume and an internal fluid flowpath defined by a wall within the inner volume, the wall including at least one flow-through apertures, said mixing apparatus storing water within the inner volume, water from the third port being received into the inner volume on one side of the wall and being provided from the inner volume to the inlet of said shutoff valve from the other side of the wall.

X6. Another aspect of the present invention pertains to a method for providing an emergency wash, comprising providing a mixing chamber defining a porous internal flowpath between inlet and outlet, a shutoff valve, and a thermostatically controlled mixing valve having two inlets and one mixed fluid outlet, storing water in the mixing chamber, providing thermostatically mixed water from the outlet of the mixing valve to the inlet of the porous flowpath, progressively mixing the stored water with the mixed water through the porosity of the internal flowpath within the mixing chamber, and providing water from the outlet of the porous flowpath to the shutoff valve.

X7. Yet another aspect of the present invention pertains to a showerhead for an emergency wash system, comprising a bowl-shaped housing having a water inlet, a dispensing plate attached to the interior of the bowl shape of said housing, said dispensing plate including a plurality of holes arranged in a predetermined angular pattern, and a deflecting member supported by said plate and spaced apart from said plate in a direction toward the interior of the bowl shape, said deflecting member including a plurality of apertures arranged in the predetermined angular pattern, the pattern of the apertures being in alignment with the pattern of the holes, wherein a portion of the water entering the interior from the inlet passes substantially unobstructed from the apertures through the holes.

X8. Yet another aspect of the present invention pertains to an emergency eyewash system, comprising an eyewash nozzle assembly having a generally cylindrical outer member, said assembly including an inner member defining a flow passage, the outer member being rotatable relative to the inner member, the outer member including a first plurality of spray apertures adapted and configured to spray water in a pattern suitable for simultaneous flushing of each eye of a human user and a second flow outlet providing aerated water, the first plurality of apertures being spaced apart from the second flow outlet, a basin for collecting water expelled from said nozzle assembly, a water shutoff valve for manual control of water from a source of water to a fitting having a fixed orientation relative to said basin, and wherein the fitting and inner member are fixedly coupled together such that rotation of the outer member relative to the inner member to a first position provides water from the flow passage to the plurality of apertures and not to the flow outlet, and rotation of the outer member relative to the inner member to a second position provides water from the flow passage to the flow outlet and not to the plurality of apertures.

Yet other embodiments include the features described in any of the previous statements X1, X2, X3, X4, X5, X6, X7, and X8, as combined with (i) one or more of the previous statements X1, X2, X3, X4, X5, X6, X7, and X8, (ii) one or more of the following aspects, or (iii) one or more of the previous statements X1, X2, X3, X4, X5, X6, X7, and X8 and one or more of the following aspects:

Wherein the drain aperture is located between the inlet of the housing and the inlet side of the filter, or the drain aperture is located to drain water that collects between the water spray nozzle and the outlet side of the filter.

Wherein the filter defines a flow area through which water flows toward the spray nozzle, and the flow area is substantially perpendicular to the vertical direction of the flow of water from the spray nozzle.

Wherein the filter is shaped as a flat disk, and the centerline of the disk is horizontally oriented.

Wherein the water spray nozzle includes right and left separated groupings of flow orifices each adapted and configured to spray water on the corresponding one of the right or left of a user's eyes, wherein the filter is a right filter and which further comprises a left filter, wherein all of the water flowing out from the right grouping of orifices flows through right filter, and all of the water flowing out from the left grouping of orifices flows through left filter.

Wherein the drain aperture is located between the right and left filters.

Wherein the filter impedes the transport of particles in the water greater in size than about seventy microns, and permits the transport of particles in the water less than about forty microns.

Wherein the source is a light emitting diode, or the light source is electrically activated, and which further a source of electricity located on the housing and providing electricity to the light source, or the source of electricity is a battery, or the source of electricity is a photocell.

Wherein the light source is a portion of the housing fabricated from a luminescent material, or the material is phosphorescent, or the material comprises one of zinc sulfide or strontium aluminate.

Wherein the nozzle includes right and left groupings of flow orifices, and the light source is located between the right grouping and the left grouping.

Wherein the plurality of flow nozzles is in a pattern adapted and configured to flow water upward more than about two inches and less than about 12 inches toward the face of the user.

Wherein the rotating is about ninety degrees, or is about one hundred eighty degrees.

Wherein the housing is generally cylindrical, the plurality of flow orifices are located on a round cylindrical side and the aerated nozzle is located on an end of the cylindrical shape.

Wherein the nozzle assembly and the fitting form a T-shape, or the nozzle assembly and the fitting form an in-line shape.

Wherein the basin is a sink in a residential building, or the basin is part of an emergency wash system in an industrial building.

Wherein the internal fluid flowpath includes a tubular conduit having a tubular wall including the plurality of apertures, the apertures being spaced apart from one another along the first flowpath in the direction of flow, each aperture permitting the flow of water across the tubular wall.

Wherein the providing includes an eyewash nozzle, and which further comprises receiving water by the eyewash nozzle from the shutoff valve.

Which further comprises flowing water generally upward from the eyewash nozzle.

Wherein the providing includes a drench shower nozzle, and which further comprises receiving water by the shower nozzle from the shutoff valve, or which further comprises flowing water generally downward from the shower nozzle.

Wherein a portion of the water entering the interior from the inlet passes through the apertures and impinges on the boundaries of the holes.

Wherein the deflecting member has a mushroom shape including a head and a stem, the stem being supported by the plate, the head being opposite of the inlet.

Wherein the deflecting member substantially deflects water provided by the inlet from flowing directly into the holes, except for the water provided by the inlet that flows though the apertures.

Wherein the plurality of holes is a first plurality, and the dispensing plate includes a second plurality of holes arranged circumferentially around the first plurality, the second plurality being adapted and configured to receive water from the inlet after the water is deflected by the deflecting member.

Wherein said the apparatus includes a flow control valve to limit the maximum flow of water through the plurality of orifices to a predetermined range, wherein said flowing water upward includes automatically limiting the upward flow of water to a predetermined range, and wherein said flowing water downward is not limited to the predetermined range. While the inventions have been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. An apparatus for an emergency eyewash system, comprising:

a housing including a water spray nozzle having a plurality of flow orifices oriented to provide substantially vertical upward flow of water, an inlet for receiving water, an internal chamber receiving water from the inlet and providing the water toward said flow orifices, a drain aperture located within the chamber adapted and configured for gravity-assisted draining from the bottom of the chamber, and a filter having an inlet side receiving water from the inlet and an outlet side providing filtered water, and said drain aperture is located to drain water that collects between said inlet of said housing and the inlet side of said filter.

2. The apparatus of claim 1 wherein said drain aperture is located between said inlet of said housing and the inlet side of said filter.

3. The apparatus of claim 1 wherein said drain aperture is located to drain water that collects between said water spray nozzle and the outlet side of said filter.

4. The apparatus of claim 1 wherein said filter defines a total flow area through which water flows toward said spray nozzle, and the total flow area is substantially perpendicular to the vertical direction of the flow of water from said spray nozzle.

5. The apparatus of claim 1 wherein said filter is shaped as a flat disk, and the centerline of the disk is horizontally oriented.

6. The apparatus of claim 1 wherein said water spray nozzle includes right and left separated groupings of flow orifices each adapted and configured to spray water on the corresponding one of the right or left of a user's eyes, wherein said filter is a right filter and which further comprises a left filter, wherein all of the water flowing out from said right grouping of orifices flows through right filter, and all of the water flowing out from said left grouping of orifices flows through left filter.

7. The apparatus of claim 6 wherein said drain aperture is located between said right and left filters.

8. The apparatus of claim 1 wherein said filter impedes the transport of particles in the water greater in size than about seventy microns, and permits the transport of particles in the water less than about forty microns.

9. An apparatus for an emergency eyewash system, comprising:

a housing including an inlet for receiving water, a water spray nozzle having a plurality of flow orifices adapted and configured to provide vertically upward flow of water, the plurality of flow orifices extending across an area;

a drainage basin having a water drainage outlet, said flow orifices being located above said basin; and a source of light located on said housing centrally within the area of the flow, said source being oriented to provide light vertically upward;

wherein said nozzle includes right and left groupings of flow orifices, and said light source is located between the right grouping and the left grouping.

10. The apparatus of claim 9 wherein said source is a light emitting diode.

11. The apparatus of claim 9 wherein said light source is electrically activated, and which further comprises a source of electricity located on said housing and providing electricity to said light source.

12. The apparatus of claim 11 wherein said source of electricity is a battery.

13. The apparatus of claim 11 wherein said source of electricity is a photocell.

14. The apparatus of claim 9 wherein said light source is a portion of said housing fabricated from a luminescent material.

15. The apparatus of claim 14 wherein the material is phosphorescent.

16. The apparatus of claim 15 wherein the material comprises one of zinc sulfide or strontium aluminate.

17. The apparatus of claim 1 wherein said drain aperture is adapted and configured to simultaneously wash debris collected on the inlet side of said filter during said gravity-assisted draining.

18. The apparatus of claim 1 wherein said drain aperture is adapted and configured to automatically flush debris from said filter during said draining.

19. The apparatus of claim 1 wherein said drain aperture is located to drain water flowing backward from said flow orifices and through said filter.

20. The apparatus of claim 1 which further comprises a shut off valve having opened and closed positions and providing water in the opened position to the inlet of said housing, wherein moving said shut off valve to the closed position results in water in the internal chamber flowing in reverse direction and through the drain aperture.

21. The apparatus of claim 1 wherein the drain aperture is adapted and configured to permit draining from the chamber to a drain.

* * * * *